US010953675B2

(12) United States Patent
McNestry et al.

(10) Patent No.: US 10,953,675 B2
(45) Date of Patent: Mar. 23, 2021

(54) PRINTER

(71) Applicant: VIDEOJET TECHNOLOGIES INC., Wood Dale, IL (US)

(72) Inventors: Martin McNestry, Derbyshire (GB); Gareth Walley, Nottingham (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 16/472,557

(22) PCT Filed: Dec. 22, 2017

(86) PCT No.: PCT/EP2017/084503
§ 371 (c)(1),
(2) Date: Jun. 21, 2019

(87) PCT Pub. No.: WO2018/115495
PCT Pub. Date: Jun. 28, 2018

(65) Prior Publication Data

US 2020/0001635 A1 Jan. 2, 2020

(30) Foreign Application Priority Data

Dec. 22, 2016 (GB) ..... 1621983

(51) Int. Cl.
*B41J 2/325* (2006.01)
*B41J 25/312* (2006.01)
(Continued)

(52) U.S. Cl.
CPC ..... *B41J 25/312* (2013.01); *B41J 2/325* (2013.01); *B41J 2/3558* (2013.01); *B41J 25/308* (2013.01); *B41J 25/316* (2013.01)

(58) Field of Classification Search
CPC ..... B41J 2/325; B41J 2/3558; B41J 25/308; B41J 25/316
See application file for complete search history.

(56) References Cited

U.S. PATENT DOCUMENTS 4,300,846 A 11/1981 Rose et al.
2016/0185146 A1 6/2016 McNestry et al.

FOREIGN PATENT DOCUMENTS

JP S5370448 A 6/1978
JP H07329368 A 12/1995
(Continued)

OTHER PUBLICATIONS

PCT/EP2017/084503 International Search Report and Written Opinion, dated Apr. 13, 2018, 20 pages.
Search Report for GB1621983.4, dated Jun. 22, 2017, 3 pages.

*Primary Examiner* — Lamson D Nguyen
(74) *Attorney, Agent, or Firm* — Wolter Van Dyke Davis, PLLC; Robert L. Wolter

(57) ABSTRACT

A printer comprising a printhead configured to selectively cause a mark to be created on a substrate provided adjacent to the printer, the printhead having a first configuration in which the printhead is spaced apart from the printing surface and a second configuration in which the printhead is configured to press the substrate against a printing surface during a printing operation. The printer further comprises a printhead drive assembly configured to cause movement of the printhead towards and away from the printing surface between the first and second configurations, the printhead drive assembly comprising a permanent magnet and an electromagnet. When the electromagnet is in a first condition, an attractive magnetic force is generated between the permanent magnet and the electromagnet, and when the electromagnet is in a second condition, a repulsive magnetic force is generated between the permanent magnet and the electromagnet, each of said attractive and repulsive magnetic forces being configured to one of urge the printhead away from and towards the printing surface. The printhead drive assembly is configured such that, when the printhead is in each of the first and second configurations, it is retained
(Continued)

in that configuration by the printhead drive assembly when the electromagnet is in the first condition, the printhead being retained in one of the first and second configurations by said attractive magnetic force generated between the permanent magnet and the electromagnet.

25 Claims, 16 Drawing Sheets

(51) Int. Cl.

| | |
|---|---|
| ***B41J 2/355*** | (2006.01) |
| ***B41J 25/308*** | (2006.01) |
| ***B41J 25/316*** | (2006.01) |

(56) References Cited

FOREIGN PATENT DOCUMENTS

| | | |
|---|---|---|
| JP | H11320855 A | 11/1999 |
| WO | 2015052531 | 4/2015 |

PRINTER

The present invention relates to a printer. More particularly, but not exclusively, the present invention relates to a thermal printer in which movement of a printhead towards and away from a printing surface against which printing is to take place is caused, at least in part by the interaction between a permanent magnet and an electromagnet.

Thermal transfer printers use an ink carrying ribbon. In a printing operation, ink carried on the ribbon is transferred to a substrate which is to be printed. To effect the transfer of ink, the printhead is brought into contact with the ribbon, and the ribbon is brought into contact with the substrate. The printhead contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

Direct thermal printers also use a thermal printhead to generate marks on a thermally sensitive substrate. A print head is brought into direct contact with the substrate. When printing elements of the print head are heated, whilst in contact with the substrate, marks are formed on the regions of the substrate which are adjacent to printing elements which are heated.

Movement of the printhead towards and away from the printing surface is, in some prior art printers, effected pneumatically by an air cylinder which presses the printhead into contact with the printing surface and any substrate and ribbon (where present) located between the printhead and the printing surface. Such an arrangement is effective but has associated disadvantages. In particular, it is usually not readily possible to vary the pressure applied by the printhead, and use of the printer requires an available supply of compressed air. Alternatively a printhead may be moved towards and away from the printing surface by a motor.

It is an object of some embodiments of the present invention to provide a novel thermal printer which obviates or mitigates at least some of the disadvantages of prior art thermal printers, whether set out above or otherwise.

According to a first aspect of the invention there is provided a printer comprising a printhead configured to selectively cause a mark to be created on a substrate provided adjacent to the printer, the printhead being configured to press the substrate against a printing surface during a printing operation. The printer further comprises a printhead drive assembly configured to cause movement of the printhead towards and away from the printing surface, the printhead drive assembly comprising a permanent magnet and an electromagnet. When the electromagnet is in a first condition, an attractive magnetic force is generated between the permanent magnet and the electromagnet. When the electromagnet is in a second condition, a repulsive magnetic force is generated between the permanent magnet and the electromagnet. Each of said attractive and repulsive magnetic forces is configured to one of urge the printhead away from and towards the printing surface.

The use of an electromagnet and a permanent magnet allows a magnetic interaction between the two magnetic components to be controlled, so as to generate attractive or repulsive forces of different magnitudes. For example, the magnetic field of the permanent magnet can be allowed to magnetise a portion of the electromagnet—thereby leading to magnetic attraction therebetween, even when the electromagnet is de-energised. Further, the magnetic field of the permanent magnet can be reinforced by a magnetic field generated by the electromagnet, so as to cause a magnetic attraction strength to be increased. Alternatively, if the magnetic field of the permanent magnet is opposed by, and even overcome by, a magnetic field generated by the electromagnet, a magnetic repulsion can be brought about. More generally, the magnetic interaction between the various magnetic components to be controlled so as to control forces acting on components of the printhead assembly, for example to cause movement of the printhead during and between printing operations. Moreover, the use of a permanent magnet in this configuration allows some forces to be generated without an electromagnet being energised at all times, thereby reducing the heat generated by such an electromagnet.

The attractive magnetic force may be configured to urge the printhead away from the printing surface. The repulsive magnetic force may be configured to urge the printhead towards the printing surface.

The printer may comprise a controller arranged to control the printhead drive assembly. The controller may be arranged to control the electromagnet. The controller may be arranged to control an energisation condition of the electromagnet.

In the first condition the electromagnet may be de-energised. In the first condition the permanent magnet may be configured to cause an attractive force to be generated between the permanent magnet and the electromagnet. The first condition is an example of an energisation condition.

That is, in the first condition, the electromagnet may be configured so as to be turned off. In particular, in the first condition the electromagnet may be configured so as not to generate a magnetic field. The electromagnet, may, however, still be magnetised by the magnetic field produced by the permanent magnet, resulting in an attractive force being generated between the permanent magnet and the electromagnet. This allows an attractive force to be generated even in an un-powered state.

In the second condition the electromagnet may be energised in a first direction, such that a repulsive force is generated between the permanent magnet and the electromagnet. That is, in the second condition the electromagnet may be configured to cause a repulsive force to be generated between the permanent magnet and the electromagnet. The second condition is an example of an energisation condition.

For example, the electromagnet may be energised so as to cause a magnetic pole to be generated which acts to repel a corresponding magnetic pole provided by the permanent magnet. The corresponding magnetic pole provided by the permanent magnet may be adjacent to the generated magnetic pole.

In a third condition the electromagnet may be energised in a second direction, such that a second attractive force is generated between the permanent magnet and the electromagnet. The second direction may be opposite to the first direction.

For example, the electromagnet may be configured so as to cause a magnetic pole to be generated which acts to attract an opposite magnetic pole provided by the permanent magnet. The second attractive force may have a larger amplitude than the attractive force generated by the permanent magnet in isolation.

The electromagnet may comprise a soft magnetic element and a coil. The permanent magnet may comprise a hard magnetic material such as neodymium (e.g. grade N42) or samarium-cobalt.

The electromagnet may be energised to generate a magnetic field in a first direction and a second direction opposite to the first direction. The electromagnet may be energised by causing a current to flow within the coil. The coil may be operably associated with the soft magnetic element such that a magnetic field generated by the coil is coupled to the soft magnetic element, causing a magnetic pole to be formed at a surface of the soft magnetic element, the polarity of the pole depending upon the direction of the generated magnetic field.

The coil may be wound around at least a portion of said soft magnetic material, such that, when an electrical current is caused to flow in said coil, a magnetic field is generated in said soft magnetic element. The direction of the magnetic field may depend upon the direction of current flow within the coil.

The soft magnetic element may be a ferromagnetic element.

The printhead drive assembly may be configured to cause the printhead to press against the printing surface during a printing operation. The printhead drive assembly may be configured to cause the printhead to press against the printing surface during a printing operation with a printing force.

During printing operations, the substrate may be transported along a predetermined path adjacent to the printer. The printhead may be caused to press the substrate against the printing surface during a printing operation.

The printing force may be a predetermined printing force. The predetermined printing force may be varied based upon a property of the printer and/or the substrate.

The printhead drive assembly may comprise a resilient biasing member. The printing force may be at least partially generated by said resilient biasing member.

The resilient biasing member may be a spring, such as, for example a coil spring. The printing force may be generated substantially solely by the resilient biasing member.

The printing force may be generated, at least partially, by a magnetic force.

The printhead may be urged in a direction away from the printing surface by a magnetic force.

The printhead may be urged in a direction away from the printing surface by a magnetic force at least partially generated by the permanent magnet.

The printhead may have a first configuration in which the printhead is spaced apart from the printing surface and a second configuration in which the printhead is extended towards the printing surface. In the second configuration, the printhead may be pressed against the printing surface. In the second configuration, the printhead may be configured to press the substrate against the printing surface.

By pressed against the printing surface, it is not intended to mean, or indeed required, that the printhead is in direct contact with the printing surface. Rather, it is meant that the printhead is urged towards, and resisted by, the printing surface. However, some material (e.g. the substrate, and/or an ink carrying ribbon) may be present between the printhead and the printing surface when the printhead is pressed against the printing surface. Moreover, it will be appreciated that in some configurations (for example where one or more of a printing surface, a substrate, and a ribbon is not present) when the printhead is in the second configuration is may not be resisted by any external component. Thus, the second configuration may be considered to be an extended configuration in which the printhead would be in contact with a printing surface, if a printing surface is present.

The first configuration may be referred to as a non-printing configuration, in which the printhead is maintained in a position that is spaced apart from the printing surface. The second configuration (in which the printhead is configured to press the substrate against the printing surface) may be referred to as a printing configuration.

The printhead drive assembly may be configured to cause movement of the printhead between the first and second configurations. The printhead drive assembly may be configured such that, when the printhead is in each of the first and second configurations, it is retained in that configuration by the printhead drive assembly when the electromagnet is in the first condition, the printhead being retained in one of the first and second configurations by said attractive magnetic force generated between the permanent magnet and the electromagnet.

The printhead drive assembly may further comprise a resilient biasing member. The printhead may be retained in the other one of the first and second configurations by a force generated by the resilient biasing member.

The printhead drive assembly may further comprise a second permanent magnet, the printhead being retained in the other one of the first and second configurations by an attractive magnetic force generated between the second permanent magnet and the electromagnet. For example That is, rather than a resilient biasing member, the second permanent magnet could be used to retain the printhead in the other on of the first and second configurations.

In the first condition the electromagnet may be de-energised, or energised at a sufficiently low level that the overall forces exerted on the printhead by the printhead drive assembly cause the printhead to be retained in whichever of the first and second conditions the printhead is in.

The printhead may be urged towards the first configuration by the permanent magnet.

The magnitude of the urging force generated by the action of the permanent magnet may be dependent upon the position of the printhead. The magnitude of the urging force generated by the action of the permanent magnet may follow an inverse relationship with the distance between the printhead and the first configuration. Thus, the closer the printhead is to the first configuration, the stronger the urging force generated by the action of the permanent magnet to urge the printhead towards the first configuration.

The printhead may be urged towards the second configuration by the resilient biasing member.

The magnitude of the urging force generated by the resilient biasing member may be dependent upon the position of the printhead. The magnitude of the urging force generated by the resilient biasing member may be in part inversely proportional to the distance between the printhead and the first configuration. Thus, the closer the printhead is to the second configuration (and the further the printhead is from the first configuration), the weaker the urging force generated by the resilient biasing member to urge the printhead towards the second configuration.

The first and second configurations may be stable configurations.

That is, when the printhead is in either of the first or second configurations, the printhead will remain in the respective configuration, even with the printer powered off, unless acted on by an external motive force.

When the printhead is in the second configuration, the urging force generated by the resilient biasing member may be greater than the urging force generated by the permanent magnet. When the printhead is in the first configuration, the urging force generated by the permanent magnet may be greater than the urging force generated by the resilient biasing member.

In other words, the printhead may have two stable configurations, the first configuration and the second configuration. When in either of the two stable configurations, the printhead is urged towards that configuration by a force which overcomes a force urging the printhead towards the other of the two configurations. Thus, an additional force may be required to cause the printhead to move away from one of the two stable configurations. However, once the printhead has moved sufficiently far from the respective stable configuration (e.g. under the influence of the additional force), the opposing urging force dominates, resulting in the printhead moving to the other of the two stable configurations and remaining there. At some point of equilibrium between the first and second configurations the urging forces in each direction are balanced, however this is an unstable configuration since either side of this point of equilibrium, one or other of the urging forces will dominate to pull the printhead to the respective one of the first and second configurations.

Therefore, it will be understood that in either of the first or second configurations, when there is no current flowing within the coil of the electromagnet, the resilient biasing member may be configured to urge the printhead towards the second configuration, and the permanent magnet may be configured to urge the printhead towards the first configuration. However, in either of the first and the second configurations, a resultant force is generated, the resultant force being the difference between the forces generated by the resilient biasing member and the permanent magnet. In the first configuration, the resultant force may be negative, and may act to pull the printhead away from the printing surface. In the second configuration the resultant force may be positive, and may act to push the printhead towards the printing surface. The resultant force in the second configuration may be referred to as the printing force.

When the printhead is in the first configuration, the printhead may be caused to move towards the second configuration by a magnetic force generated by the electromagnet. That is, the printhead may be caused to move from the first configuration towards the second configuration by a force generated when the electromagnet is energised.

The electromagnet may be energised when a voltage is applied to the electromagnet. The applied voltage may comprise a plurality of pulses. The applied voltage may be pulse width modulated as is well known in the art. The applied voltage may cause a current to flow in the coil. The magnitude of the force generated when the electromagnet is energised may depend upon the magnitude of current flowing within the coil of the electromagnet.

The magnitude of the applied current may be sufficient to generate a force which, in combination with the force produced by the resilient biasing member in the first configuration, is greater than, and in a direction substantially opposite to, the urging force generated by the attraction of the permanent magnet to the soft magnetic material of the electromagnet.

The force generated by the electromagnet due to the application of a current may cause the printhead to move sufficiently far from the first configuration that the urging force generated by the resilient biasing member is greater than the urging force generated by the permanent magnet, and thus the printhead is caused to move towards, and remain in, the second configuration, until or unless acted upon by a counteracting force.

When the printhead is in the second configuration, the printhead may be caused to move towards the first configuration by a force generated by the electromagnet.

The magnitude of the applied current may be sufficient to generate a force which, in combination with the force produced by the permanent magnet, is greater than, and in a direction substantially opposite to, the urging force generated by the resilient biasing member in the second configuration.

The force generated by the electromagnet due to the application of a current may cause the printhead to move sufficiently far from the second configuration that the urging force generated by the permanent magnet is greater than the urging force generated by the resilient biasing member, and thus the printhead is caused to move towards, and remain in, the first configuration, until or unless acted upon by a counteracting force.

The printing force may comprise a first force component generated by a resilient biasing member and a second force component generated by the electromagnet.

For example, the printing force may be modified by suitable control of the electromagnet, allowing adjustment to be made to the printing force based upon a number of different inputs.

The first force component may comprise a fixed component. The second force component may comprise a variable component.

By appropriate control of the current supplied to the electromagnet, the magnetic field generated by the electromagnet can be controlled so as to generate a second force component having a predetermined magnitude. In this way, the overall printing force can be varied so as to cause a predetermined printing force to be exerted on the printing surface by the printhead.

The printing force may be varied so as to achieve optimum print quality. For example, the printing force may be varied based upon feedback (e.g. optical feedback) which provides data indicative of print quality. Alternatively or additionally, the printing force may be varied based upon characteristics of one or more of the ribbon (e.g. ribbon type, ribbon width), the printhead (e.g. printhead width) or the substrate (e.g. substrate material). For example, the controller may be arranged to process information indicating friction of the ribbon against the printhead, and to determine the force to be generated by the printhead drive assembly accordingly.

Alternatively or additionally, the current supplied to the electromagnet may be controlled so as to cause a predetermined printing force to be generated in spite of different printer configurations. For example, the current supplied to the electromagnet may be varied so as to compensate for different printing surface positions.

The magnitude of the second force component may vary based upon the magnitude of current supplied to the electromagnet.

The direction of the second force component may vary based upon the direction of current supplied to the electromagnet.

The printing force may comprise a third component generated by the permanent magnet, the third component acting in a opposite direction to the first component generated by the resilient biasing member.

The electromagnet may be controlled based upon a position of the printhead. A magnitude of current supplied to the electromagnet may be controlled based upon a position of the printhead. A magnitude of current supplied to the electromagnet may be controlled based upon a velocity of the printhead.

The electromagnet may be controlled based upon printhead position data. The use of printhead position data to control the electromagnet allows the printhead drive assembly to be controlled in a closed loop manner. In this way, the electromagnet can be controlled in such a way to ensure that the printhead moves in a controlled and predictable way, and such that excess forces (e.g. due to impact between system components) are reduced.

Said printhead position data may comprise data indicative of a position of the printhead.

The printer may further comprise a printhead position sensor configured to generate a printhead position signal. The electromagnet may be controlled based upon said printhead position signal.

The sensor may be an optical sensor. The sensor may comprise an emitter and a receiver.

Said printhead position data may comprise the printhead position signal. Said printhead position data may be derived from the printhead position signal. Said printhead position data may comprise data indicative of a position of the printhead relative to the printing surface.

The printhead position sensor may be configured to generate a signal indicative of a separation between a portion of the printhead and a printer reference location, said printer reference location being provided at a substantially fixed separation from the printing surface during movements of the printhead towards and away from the printing surface. The printer reference location may be referred to as a target.

The electromagnet may be controlled based upon a position of the printhead so as to generate a predetermined force. The magnitude of current supplied to the electromagnet may be controlled based upon a position of the printhead so as to generate a predetermined force. That is, dependent upon the position of the printhead, the electromagnet may be controlled such that a particular force (i.e. a force having a particular direction and/or magnitude) is exerted upon the printhead by the printhead drive apparatus.

The electromagnet may be controlled so as to control an impact force of the printhead with the printing surface. The magnitude of current supplied to the electromagnet may be controlled so as to control an impact force of the printhead with the printing surface. The electromagnet may be controlled so as to reduce the impact force of the printhead with the printing surface. The magnitude of current supplied to the electromagnet may be controlled so as to reduce the impact force of the printhead with the printing surface. For example, a current may be applied to the electromagnet in a first direction for a first period of time, which current causes the printhead to begin movement towards the printing surface. However, prior to the printer making contact with the printing surface (but after the printhead passing the point at which it would return to the first configuration if the current were removed), a current may be applied to the electromagnet in a second direction, opposite to the first direction. The current in the second direction may cause the printhead to decelerate, such that when contact is made with the printing surface, the velocity, and thus the impact, is reduced. Such a reduction in impact may prevent or reduce damage to components of the printhead and printhead drive assembly.

The electromagnet may be controlled so as to reduce an impact force of the printhead assembly with other components of the printhead drive assembly. The magnitude of current supplied to the electromagnet may be controlled so as to reduce an impact force of the printhead assembly with other components of the printhead drive assembly. For example, the current supplied to the electromagnet may be controlled so as to control the impact force between the permanent magnet and the soft magnetic element.

A property of the printhead may be determined based upon a property of the electromagnet.

The property of the printhead may be the location of the printhead. Thus, the position of printhead relative to other components of the printer may be determined based upon said property of the electromagnet. Contact between various components of the printhead drive assembly, or more generally between components of the printer and/or components of an industrial apparatus with which the printer is associated, may be determined based upon said property of the electromagnet. For example, contact of the printhead with the printing surface may be determined based upon said property of the electromagnet. Similarly, contact (even indirect contact, for example, via one or more intermediate components) between the permanent magnet and the soft magnetic element (e.g. when the printhead is retracted from the printing surface) may be determined based upon said property of the electromagnet.

The property of the printhead may be a movement of the printhead. The property of the printhead may be a movement of the printhead in a direction substantially perpendicular to the path of the substrate past the printhead. Thus, any movement of the printhead relative to other components of the printer may be determined based upon said property of the electromagnet. For example, an unexpected movement of the printhead (e.g. due to contact between the printhead and components of the printer and/or components of an industrial apparatus with which the printer is associated) may be identified based upon said property of the electromagnet.

The property of the printhead may be determined during movement of the printhead between the first configuration and the second configuration, and vice versa. The property of the printhead may be determined during movement of the printhead in a direction which is parallel to the path of the substrate past the printhead and/or in a direction which is perpendicular to the path of the substrate past the printhead. Alternatively, the property of the printhead may be determined whilst the printhead is expected to be stationary in at least one of the direction which is parallel to the path of the substrate past the printhead and the direction which is perpendicular to the path of the substrate past the printhead. For example, where the printhead is expected to be stationary in the direction which is perpendicular to the path of the substrate past the printhead (e.g. during a printing stroke, when the printhead is moving in a direction which is parallel to the path of the substrate past the printhead) any movement of the printhead in the direction perpendicular to the path of the substrate past the printhead direction may be detected based upon said property of the electromagnet.

The controller may be arranged to monitor the property of the electromagnet. The monitored property may comprise a component indicative of a position of the printhead. The monitored property may comprise a component indicative of a movement of the printhead. The monitored property may comprise a component indicative of a velocity of the printhead. The component may comprise a fluctuation in the monitored property of the electromagnet. The fluctuation may be generated by interaction between the magnetic fields of the permanent magnet and the electromagnet. For example, the fluctuation may be caused by a back electromotive force (back-EMF) induced in the windings of the electromagnet.

The property of the electromagnet may be current flowing in windings of the electromagnet. The component may comprise a fluctuation in current flowing in windings of the electromagnet. The current fluctuation may be generated by interaction between the magnetic fields of the permanent magnet and the electromagnet. The current fluctuation may be a transient decrease or increase in the magnitude of current flowing in windings of the electromagnet.

The property of the electromagnet may be voltage across windings of the electromagnet. The component may comprise a fluctuation in the voltage across windings of the electromagnet. The voltage fluctuation may be generated by interaction between the magnetic fields of the permanent magnet and the electromagnet. The voltage fluctuation may be a transient increase or decrease in the magnitude of voltage across the windings of the electromagnet. For example, where no current is expected to be flowing in the windings of the electromagnet, any back-EMF induced in the windings may cause a voltage to be generated across the terminals of the windings, the voltage being readily detected.

The controller may be arranged to generate a control signal for the electromagnet based upon said monitored property.

The controller may be arranged to monitor said property of the electromagnet during a first movement of the printhead drive assembly. The controller may be arranged to generate a control signal for the electromagnet in a second movement of the printhead drive assembly based upon said monitored property.

In this way, the controller can iteratively monitor the accuracy with which the printhead drive assembly is controlled and modify the control signals so as to gradually improve the system performance.

The controller may be arranged to monitor said property of the electromagnet during a plurality of first movements of the printhead drive assembly, and generate a control signal for the electromagnet in a second movement of the printhead drive assembly based upon said monitored property.

In a first movement of the printhead drive assembly, the controller may generate a control signal having a nominal magnitude. The controller may be configured to modify the control signal magnitude for a second movement of the printhead drive assembly based upon said monitored property. For example, if the printhead was observed to move at a predetermined time with reference to the application of a control signal to the electromagnet, by increasing the magnitude of the control signal it may be possible cause the printhead to move more quickly after the application of the control signal.

The controller may be configured to modify the control signal magnitude for said second movement of the printhead drive assembly based upon said monitored property and a reference property. For example, if it is desired to cause the printhead to move at a predetermined time with reference to the application of a control signal to the electromagnet, by comparing the time at which movement occurred with a reference (i.e. desired) time, it is possible to improve performance in a subsequent movement by modifying the magnitude of the control signal.

The controller may be arranged to control the electromagnet. Controlling the electromagnet may comprise controlling an energisation condition of the electromagnet. Controlling an energisation condition of the electromagnet may comprise causing a predetermined current to flow within windings of the electromagnet. Causing a predetermined current to flow within windings of the electromagnet may comprise causing a current having predetermined magnitude and/or direction to flow. The controller may be arranged to control the current flowing within the electromagnet.

The controller may be arranged to generate data indicative of a printhead velocity based upon said printhead position signal. Said controller may be arranged to control the electromagnet based upon said data indicative of a printhead velocity.

The controller may be configured to receive a signal generated by said printhead position sensor, and to generate said printhead position data based upon said signal.

The controller may be configured to receive a signal generated by said printhead position sensor and to generate a control signal for said printhead drive assembly based upon said signal.

The controller may be arranged to adjust the control signal for said printhead drive assembly based upon said signal generated by said printhead position sensor.

The controller may be further arranged to receive a target printhead position and to generate a control signal for said printhead drive assembly based upon said target printhead position.

The controller may be further arranged to generate a control signal for said printhead drive assembly based upon a target printhead velocity.

The controller may be arranged to generate a control signal for the printhead drive assembly based upon a printhead target signal and a printhead position signal. Said printhead target signal may comprise a printhead target position signal or a printhead target velocity signal.

Said control signal for said printhead drive assembly may be arranged to cause the printhead drive assembly to generate a target output force.

The controller may be arranged to generate data indicative of a target output force to be generated by the printhead drive assembly. Said target output force may be determined based upon said printhead target signal and printhead position data.

The controller may be arranged to generate data indicative of a target electromagnet current based upon said target output force.

The controller may be further arranged to generate said data indicative of a target electromagnet current based upon said printhead position data.

The controller may be arranged to generate data indicative of a target electromagnet current based upon reference data indicative of a relationship between an electromagnet current; a printhead position and a printhead drive assembly output force.

The printer may further comprise a current sensor configured to generate an output indicative of an actual current flowing in said electromagnet.

The controller may be arranged to generate a printhead drive assembly control signal based upon said data indicative of a target electromagnet current and data indicative of an actual electromagnet current. Said data indicative of said actual electromagnet current may comprise data derived from said output of the current sensor.

The printhead may comprise a printhead drive assembly control connection configured to provide a printhead drive assembly control signal to said printhead drive assembly.

The printhead drive assembly control connection may be configured to receive a printhead drive assembly control signal from the controller. Said printhead drive assembly control signal may be provided from the controller to the printhead drive assembly via a connection provided on the printhead.

The controller may be provided in a fixed location with reference to a housing of the printer. The printhead and the printhead drive assembly may be arranged to move in a direction parallel to the printing surface. By providing the control signal to the printhead drive assembly via the printhead, it is possible to reduce the complexity of connections within the printer. For example, control signals for the printhead (e.g. image data) may be passed to the printhead via a flexible ribbon cable. By passing control signals for the printhead drive assembly along the same ribbon cable, it is possible to reduce the number of separate connections between fixed locations (with reference to the printer housing) and movable location.

The printhead drive assembly may be arranged to cause the printhead to move from the first configuration to the second configuration before the commencement of a printing operation, and to cause the printhead to move from the second configuration to the first configuration after said printing operation.

The printing operation may comprise creating a mark on the substrate.

A plurality of printing operations may be carried out in rapid succession (for example, to print a corresponding plurality of lines of an image), with the printhead drive assembly being arranged to cause the printhead to move from the first configuration to the second configuration before the commencement of a first one of the plurality of printing operations, and to cause the printhead to move from the second configuration to the first configuration after a last one of said plurality of printing operations.

The printhead and the printhead drive assembly may each be arranged to move in a direction substantially parallel to the printing surface. Such movement in a direction parallel to the printing surface allows a printing stroke to be completed in so-called intermittent printing.

The printhead drive assembly may be configured to cause movement of the printhead in a direction substantially perpendicular to the path of the substrate past the printhead.

Thus, the printhead may be arranged to be moved in directions which are both parallel and perpendicular to the path of the substrate past the printhead.

The substrate may be configured to be advanced along a substrate path adjacent to the printhead in a printing direction. The printhead and the printhead drive assembly may be each arranged to move in a direction substantially parallel to the printing direction.

The printhead may comprise a plurality individually energisable printing elements arranged in a linear array extending in a direction substantially parallel to the printing surface. The linear array may extend in a direction substantially perpendicular to the printing direction.

The printhead drive assembly may comprise a first component and a second component. The first and second components of the printhead drive assembly may be configured to move towards and away from each other, thereby causing the printhead to move towards and away from the printing surface. The resilient biasing member may be provided between said first and second components of the printhead drive assembly. The first component of the printhead drive assembly may comprise said electromagnet. The second component of the printhead drive assembly may comprise said permanent magnet. The resilient biasing member may be configured to urge said first and second components of the printhead drive assembly apart. The resilient biasing member may be configured to resist movement of the first and second components of the printhead drive assembly towards each.

The printer may comprise a printhead assembly, the printhead assembly comprising the printhead and the printhead drive assembly. The printhead assembly may be configured to move in a direction substantially parallel to the printing surface.

The printhead assembly may further comprise a first support member configured to support the first component of the printhead drive assembly, and the a second support member configured to support the second component of the printhead drive assembly and the printhead.

The first and second support members may be configured rotate about a pivot. The pivot may be a common pivot.

The printhead position sensor may be configured to generate a signal indicative of a separation between said first and second components of the printhead drive assembly. Said first component may comprise said portion of the printhead. Said second component may comprise provide said printer reference location.

The printer may further comprise a printhead carriage. The printhead and the printhead drive assembly may be mounted upon the printhead carriage. The printhead carriage may be arranged to move in a direction substantially parallel to the printing surface.

The printer may be a thermal printer. The printhead may be configured to be selectively energised so as to generate heat which causes the mark to be created on the substrate.

The printer may be a thermal transfer printer. The printhead may be configured to be selectively energised so as to cause ink to be transferred from an ink carrying ribbon to the substrate so as to cause the mark to be created on the substrate. The ribbon may be configured to be advanced along a ribbon path adjacent to the printhead in a printing direction.

The thermal transfer printer may further comprise first and second spool supports each being configured to support a spool of ribbon; and a ribbon drive configured to cause movement of ribbon from the first spool support to the second spool support. The printhead may be configured to selectively transfer ink from the ribbon to the substrate so as to cause the mark on said substrate, the printhead pressing the print ribbon and substrate together against the printing surface.

The printhead may be configured to cause the mark to be created on a thermally sensitive substrate.

According to a second aspect of the invention there is provided a controller for a printer. The printer comprises a printhead configured to selectively cause a mark to be created on a substrate provided adjacent to the printer, the printhead having a first configuration in which the printhead is spaced apart from a printing surface and a second configuration in which the printhead is configured to press the substrate against the printing surface during a printing operation.

The thermal printer further comprises a printhead drive assembly configured to cause movement of the printhead towards and away from the printing surface between the first and second configurations, the printhead drive assembly comprising a permanent magnet and an electromagnet.

When the electromagnet is in a first condition, an attractive magnetic force is generated between the permanent magnet and the electromagnet, and when the electromagnet is in a second condition, a repulsive magnetic force is generated between the permanent magnet and the electromagnet, each of said attractive and repulsive magnetic forces being configured to one of urge the printhead away from and towards the printing surface.

The printhead drive assembly is configured such that, when the printhead is in each of the first and second configurations, it is retained in that configuration by the printhead drive assembly when the electromagnet is in the first condition, the printhead being retained in one of the first and second configurations by said attractive magnetic force generated between the permanent magnet and the electromagnet.

The controller is configured to control an energisation condition of the electromagnet so as to cause the printhead drive assembly to cause movement of the printhead towards and away from the printing surface; and to cause the printhead to be retained in each of the first and second configurations.

The controller may be further configured to control the energisation of the printhead so as to cause the printhead to generate heat which causes a mark to be created on the substrate.

According to a third aspect of the invention there is provided a control circuit comprising a controller to second aspect of the invention.

According to a fourth aspect of the invention there is provided a method of operation a printer according to the first aspect of the invention.

According to a fifth aspect of the invention there is provided a method of controlling a printhead drive assembly of a printer. The printer comprising a printhead configured to selectively cause a mark to be created on a substrate provided adjacent to the printer. The printhead has a first configuration in which the printhead is spaced apart from a printing surface, and a second configuration in which the printhead is configured to press a substrate against the printing surface during a printing operation, Said printhead drive assembly is configured to cause movement of the printhead towards and away from a printing surface between the first and second configurations. The printhead drive assembly comprises a permanent magnet and an electromagnet.

The printhead drive assembly is configured such that when the electromagnet is in a first condition, an attractive magnetic force is generated between the permanent magnet and the electromagnet, and when the electromagnet is in a second condition, a repulsive magnetic force is generated between the permanent magnet and the electromagnet. Each of said attractive and repulsive magnetic forces is configured to one of urge the printhead away from and towards the printing surface. When the printhead is in each of the first and second configurations, it is retained in that configuration by the printhead drive assembly when the electromagnet is in the first condition. The printhead is retained in one of the first and second configurations by said attractive magnetic force generated between the permanent magnet and the electromagnet.

The method comprises controlling an energisation condition of the electromagnet so as to cause the printhead drive assembly to cause movement of the printhead towards and away from the printing surface. The method further comprises controlling said energisation condition of the electromagnet so as to cause the printhead to be retained in each of the first and second configurations. The method further comprises controlling said energisation condition of the electromagnet to cause the printhead to press the substrate against the printing surface during a printing operation.

The method may comprise generating a first control signal for the electromagnet to cause the printhead drive assembly to cause movement of the printhead towards the printing surface, and generating a second control signal for the electromagnet to cause the printhead drive assembly to cause movement of the printhead away from the printing surface.

The first control signal may cause a current to flow in a winding of the electromagnet in a first direction. The first control signal may cause the printhead drive assembly to generate a first output force. The second control signal may cause a current to be caused to flow in the winding of the electromagnet in a second direction opposite to the first direction. The second control signal may cause the printhead drive assembly to generate a second output force. The magnitude of the first and/or second output forces may depend upon a magnitude of the current and/or a direction of the current, and/or a position of the printhead.

The method may comprise generating the first control signal prior to the commencement of a printing operation.

The method may comprise generating the second control signal after the completion of a printing operation.

The method may comprise generating a third control signal to cause the printhead drive assembly to control the force exerted by the printhead on the printing surface during a printing operation.

The third control signal may cause the printhead to press against the printing surface with a predetermined printing force The method may comprise receiving a signal generated by a printhead position sensor and controlling said energisation condition of the electromagnet based upon said received output.

The method may comprise receiving a target printhead position and generating a control signal for said printhead drive assembly based upon said target printhead position.

The method may comprise generating data indicative of a target output force to be generated by the printhead drive assembly.

The method may comprise generating data indicative of a target electromagnet current based upon said target output force.

Said data indicative of a target electromagnet current may be further based upon printhead position data.

The method may comprise generating data indicative of a target electromagnet current based upon reference data indicative of a relationship between an electromagnet current; a printhead position and a printhead drive assembly output force.

In this way, characteristics of the printhead drive assembly can be taken in to account. In particular, it will be understood that the printhead drive assembly output force generated will vary for a particular electromagnet current depending upon the current configuration (e.g. spring compression and permanent magnet separation from the electromagnet). Such variation may be highly non-linear.

The method may comprise receiving data indicative of an actual electromagnet current flowing in the electromagnet, and controlling said energisation condition of the electromagnet based upon said received data.

The method may comprise generating a printhead drive assembly control signal based upon said data indicative of a target electromagnet current and said signal indicative of an actual electromagnet current.

Said data indicative of said actual electromagnet current may comprise data derived from an output of a current sensor.

It will, of course, be appreciated that features described in the context of the first and second aspects of the invention can be combined with the third aspect of the invention, and vice versa.

According to a sixth aspect of the invention there is provided a method of operating a printer. The method comprises controlling a printhead drive assembly according to a method of the fifth aspect of the invention. The method further comprises causing the printhead to be selectively energised so as to cause a mark to be created on a substrate provided adjacent to the printer during a printing operation.

The method may comprise generating a first control signal for the electromagnet to cause the printhead drive assembly to cause movement of the printhead towards the printing surface and to be pressed against the printing surface. The method may further comprise, whilst the printhead is pressed against the printing surface, causing the printhead to be selectively energised so as to generate heat which causes a mark to be created on the substrate. The method may further comprise, generating a second control signal for the electromagnet to cause the printhead drive assembly to cause movement of the printhead away from the printing surface.

The method may further comprise, whilst the printhead is pressed against the printing surface, generating a control signal to cause the printhead to be moved in the direction parallel to the printing surface to perform a printing stroke. The method may further comprise, during said printing stroke, causing the printhead to be selectively energised so as to generate heat which causes a mark to be created on the substrate.

The printhead may be energised a plurality of times during said printing stroke. The printhead may be energised a plurality of times during said printing stroke thereby causing a respective plurality of marks to be created on the substrate at a respective plurality of substrate locations.

According to a seventh aspect of the invention there is provided a printhead for a thermal printer comprising a plurality of printing elements associated with a first surface of the printhead, each of the plurality of printing elements being configured to be selectively energised so as to cause a mark to be created on a substrate provided adjacent to the printhead; and a printhead position sensor arranged to generate a signal indicative of a position of the printhead, said printhead position sensor being associated with a second surface of the printhead, said second surface being generally opposite to said first surface.

Providing a printhead position sensor of this type allows the printhead position to be controlled accurately.

The printhead position sensor may be configured to generate a signal indicative of a separation between a portion of the printhead and a reference location during movements of the printhead towards and away from a printing surface.

Said reference location may be provided at a substantially fixed separation from a printing surface. The printing surface may comprise a surface against which the printhead is pressed during printing operations.

The reference location may be provided by a component of a printhead assembly. The signal indicative of a separation between a portion of the printhead and the reference location may be indicative of a position of the printhead relative to the printing surface.

The printhead position sensor may comprise a receiver arranged to receive a signal from a reference location. The reference location may be referred to as a target.

The printhead position sensor may comprise an emitter arranged to emit a signal towards said reference location.

The emitter may be arranged to emit radiation, such as, for example infrared radiation.

The receiver may be arranged to receive a reflected signal reflected by the reference location, the reflected signal being based upon the signal emitted by the emitter.

The receiver may be arranged to detect radiation, such as, for example infrared radiation. The receiver and the emitter may be selected so as to have complementary emission and detection capabilities.

The printhead may further comprise circuitry arranged to generate an output based upon a signal received by the receiver.

Said circuitry may comprise an amplifier. Processing the sensor signal at the printhead allows a signal to be passed to the printer to be of a greater magnitude than that generated by the receiver, thereby increasing the immunity to noise.

The output may be based upon the amplitude of the signal received by the receiver.

The printing elements may be heating elements which heat ink to cause the transfer of ink from an ink carrying ribbon to the substrate so as to cause a mark to be created on the substrate. Alternatively, the printing elements may be heating elements which generate heat so as to cause a mark to be created on a thermally sensitive substrate.

The printing elements may be arranged as a linear array of printing elements. In use, the linear array of printing elements may be configured in a direction perpendicular to a direction of movement of a ribbon and/or substrate past the printhead.

According to an eighth aspect of the invention there is provided a printhead for a printer. The printer comprising a printhead drive assembly configured to cause movement of the printhead towards and away from a printing surface, the printhead drive assembly comprising an electromagnet. The printhead comprises a plurality of printing elements associated with a first surface of the printhead, each of the plurality of printing elements being configured to be selectively energised so as to cause a mark to be created on a substrate provided adjacent to the printhead. The printhead further comprises a printhead drive assembly control connection configured to provide a printhead drive assembly control signal to said printhead drive assembly.

According to a ninth aspect of the invention there is provided a printer comprising a printhead according to one or both of the seventh and eighth aspects of the invention. The printer may be a thermal printer. The printer may be a thermal transfer printer. The thermal transfer printer may comprise first and second spool supports, respectively receiving first and second spools of ink carrying ribbon. The thermal transfer printer may comprise a ribbon drive arranged to cause the transfer of ribbon between said first and second spools in a first direction.

The printer may further comprise a controller, the controller being arranged to receive an output from the printhead: and control an operation of the printer based upon the received output.

Controlling an operation of the printer based upon the received output may comprise generating a control signal for controlling a position of the printhead based upon the signal indicative of a position of the printhead.

It will, of course, be appreciated that features described in the context of any of the above aspects of the invention can be combined with other aspects of the invention.

For example, operations of the controller described in the context of the printer of the first aspect can be performed by the controller of the second aspect. Similarly, features of the methods of the fourth, fifth and sixth aspects can be performed by the controller of the second aspect, or the printer of the first aspect.

There is also provided controller arranged to carry out a method according to any one of the fourth, fifth and sixth aspects of the invention. Moreover, methods described above can be implemented in any convenient form. As such the invention also provides computer programs which can be executed by a processor of a printer so as to cause the printer to be controlled in the manner described above. Such computer programs can be stored on computer readable media such as non-tangible, non-transitory computer readable media.

Embodiments of the invention will now be described, by way of example, with reference to the accompanying drawings, in which.

Figure 1:
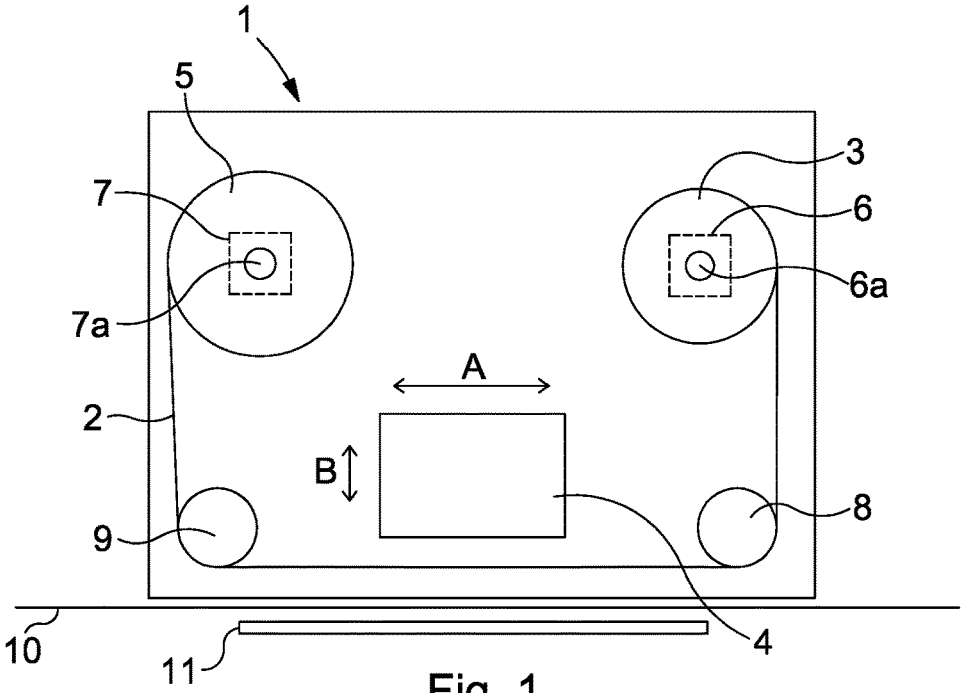
FIG. 1 is a schematic view of a printer in accordance with the present invention.
Figure 5A:
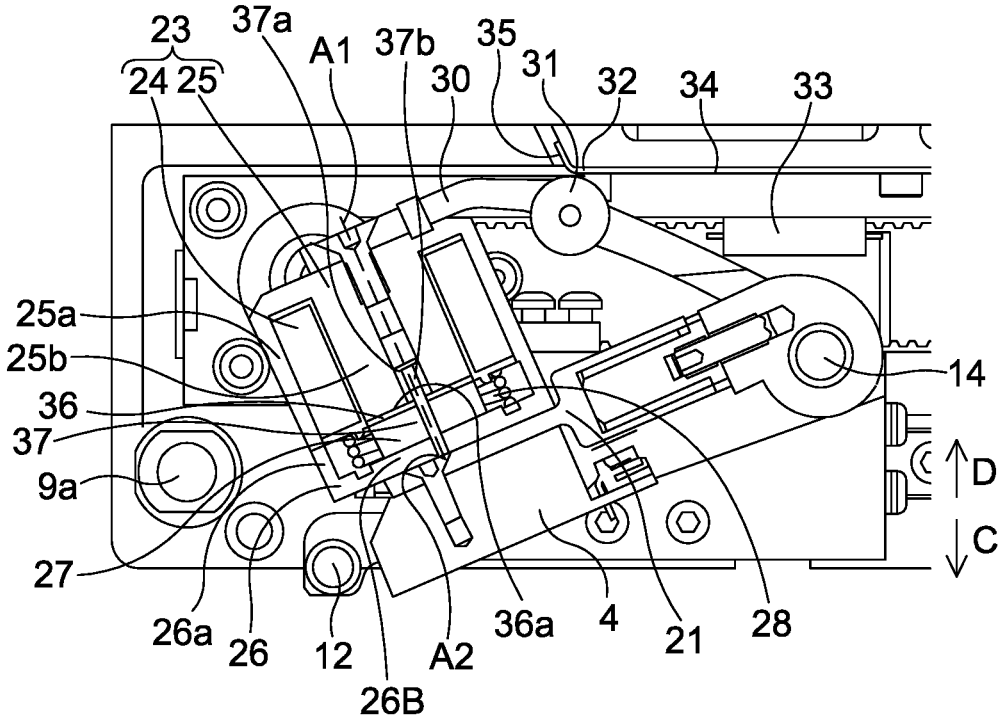
Figure 5B:
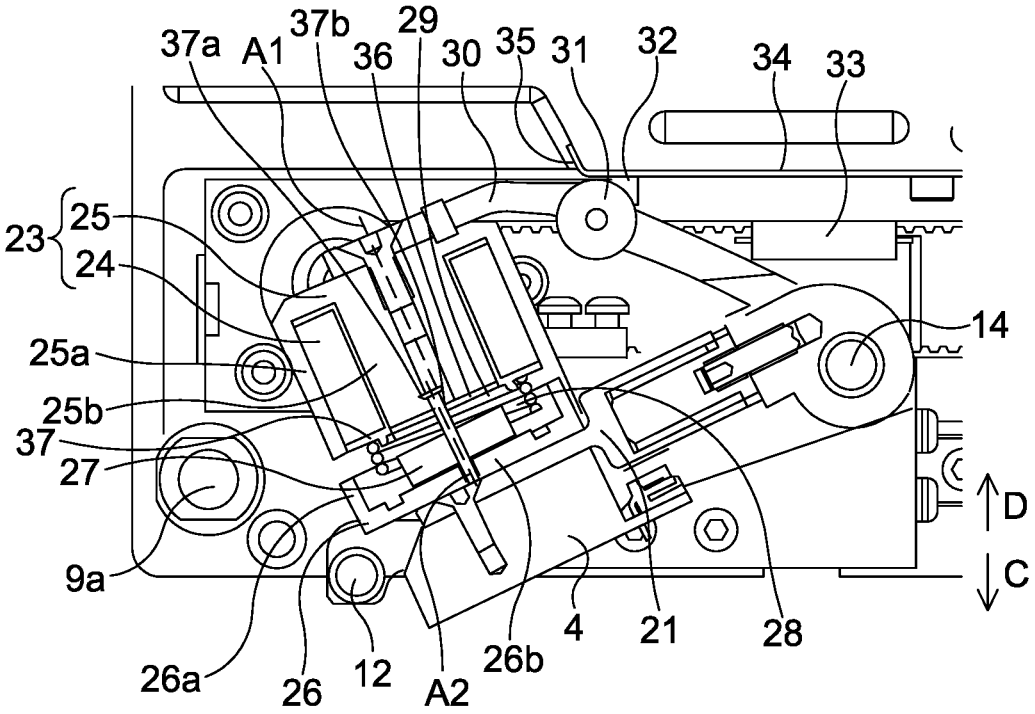
Figure 6A:
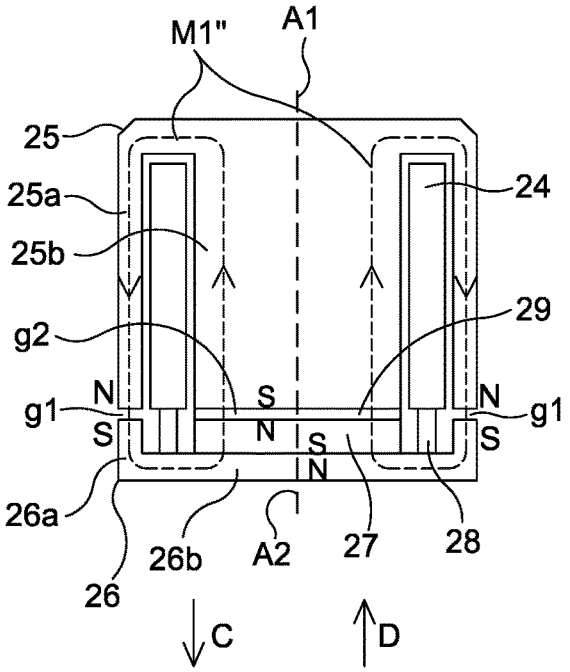
Figure 6B:
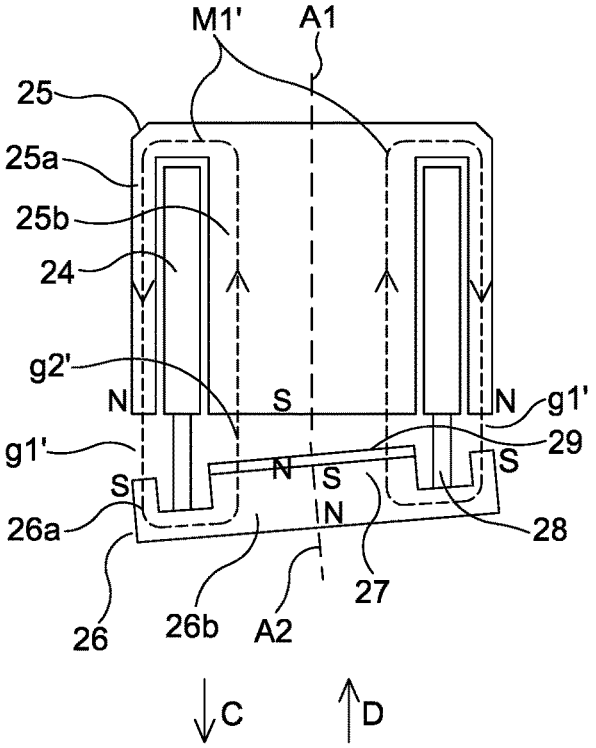
Figure 7:
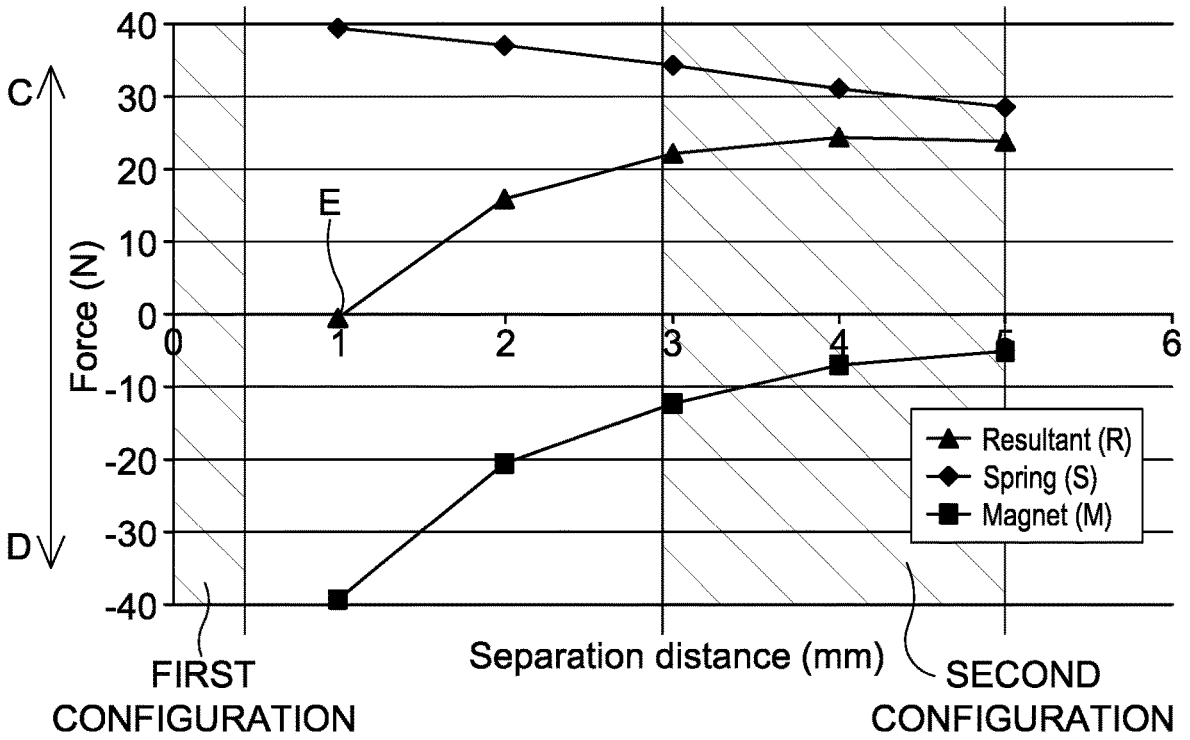

FIGS. 5*a* and 5*b* are a part cut-away front views of part of the printer of FIG. 1 in further detail in first and second configurations respectively;

FIGS. 6*a* and 6*b* are schematic cross-sectional views of a printhead drive assembly of the printer of FIG. 1 in first and second configurations respectively;

FIG. 7 is a graph showing forces generated by components of the printhead drive assembly of FIGS. 5*a* and 5*b;*

Figure 8A:
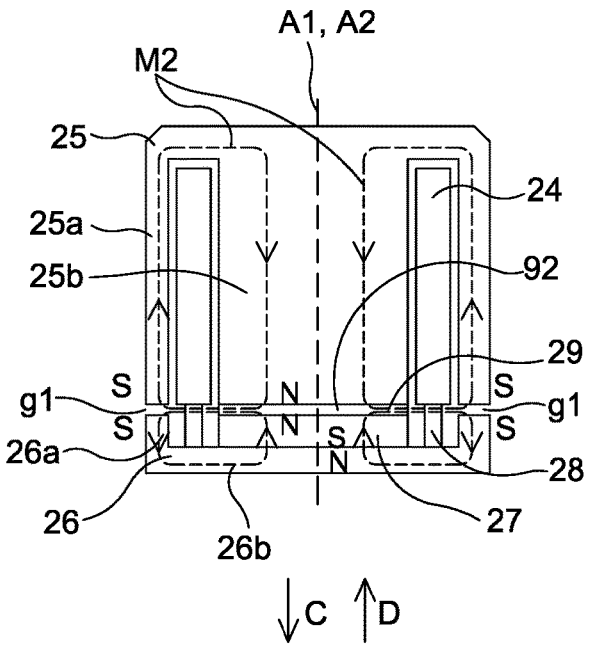
Figure 8B:
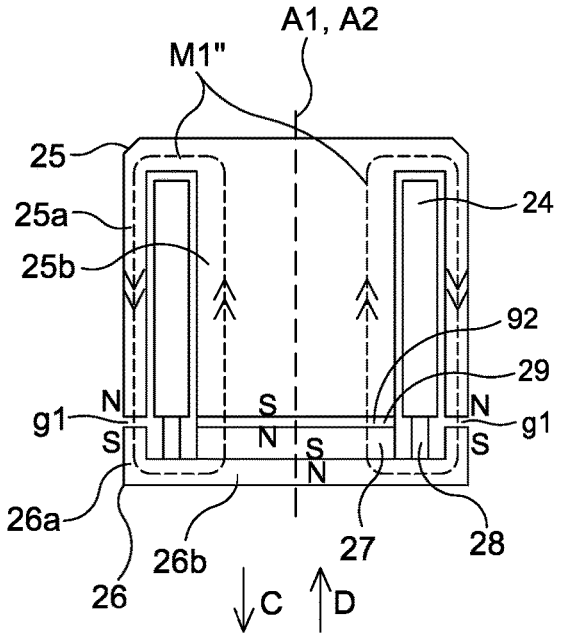
Figure 9:
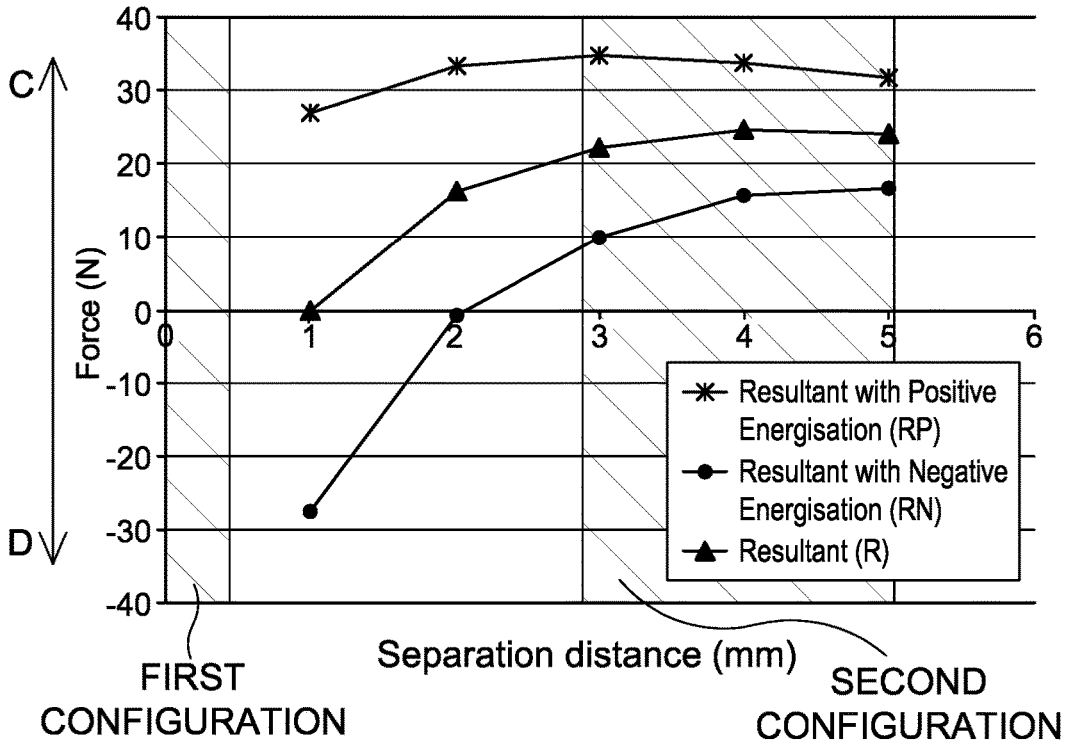

FIGS. 8*a* and 8*b* are schematic cross-sectional views of the printhead drive assembly of FIG. 6*a* in the first configuration in first and second energisation conditions respectively;

FIG. 9 is a graph showing forces generated by components of the printhead drive assembly of FIGS. 6*a* and 6*b* in the energisation conditions respectively shown in FIGS. 8*a* and 8*b;*

Figure 10:
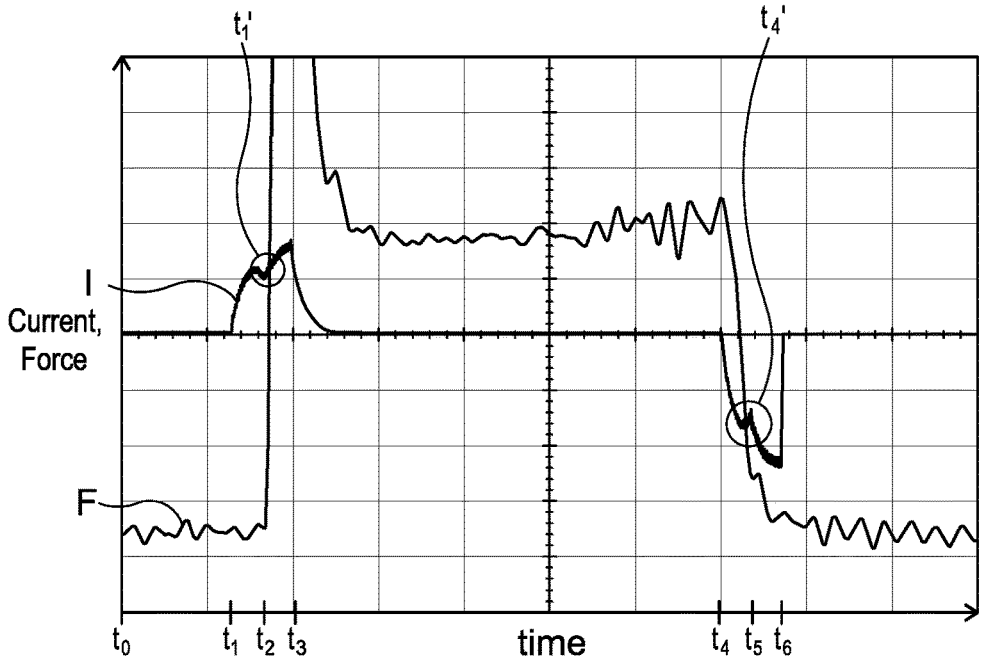

FIG. 10 is a graph showing printing force and current waveforms generated by components of the printhead drive assembly of FIGS. 6*a* and 6*b;*

Figure 11:
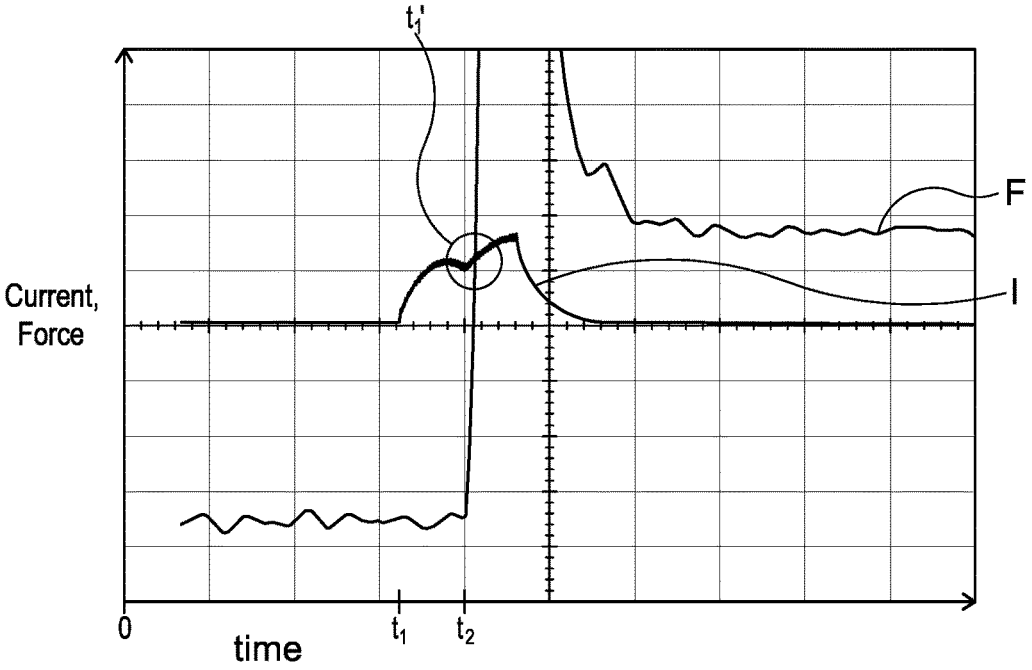
Figure 12:
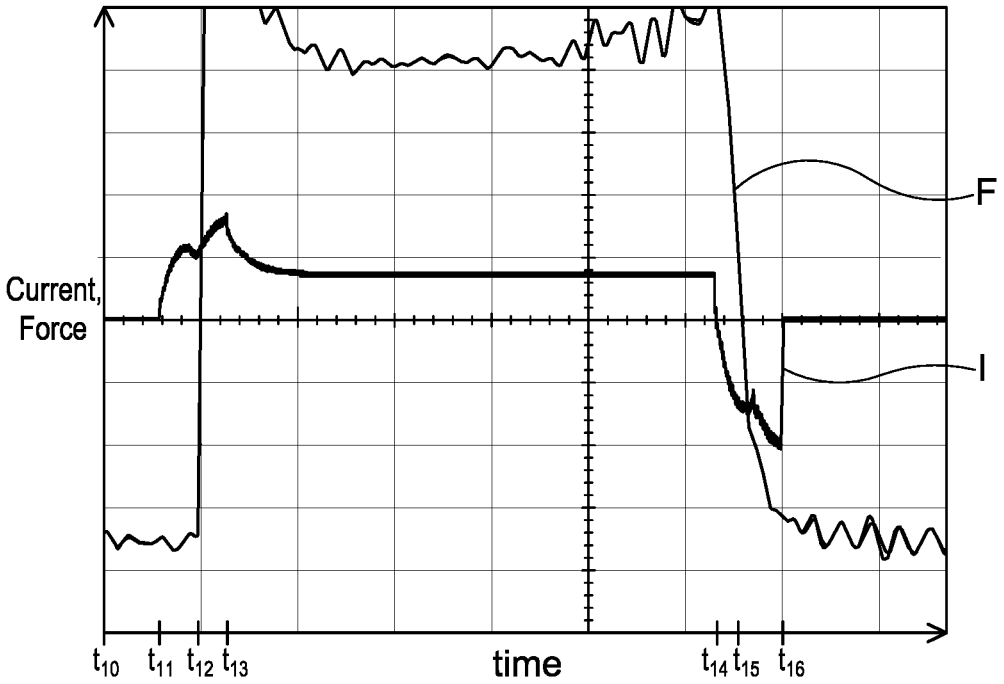
Figure 13:
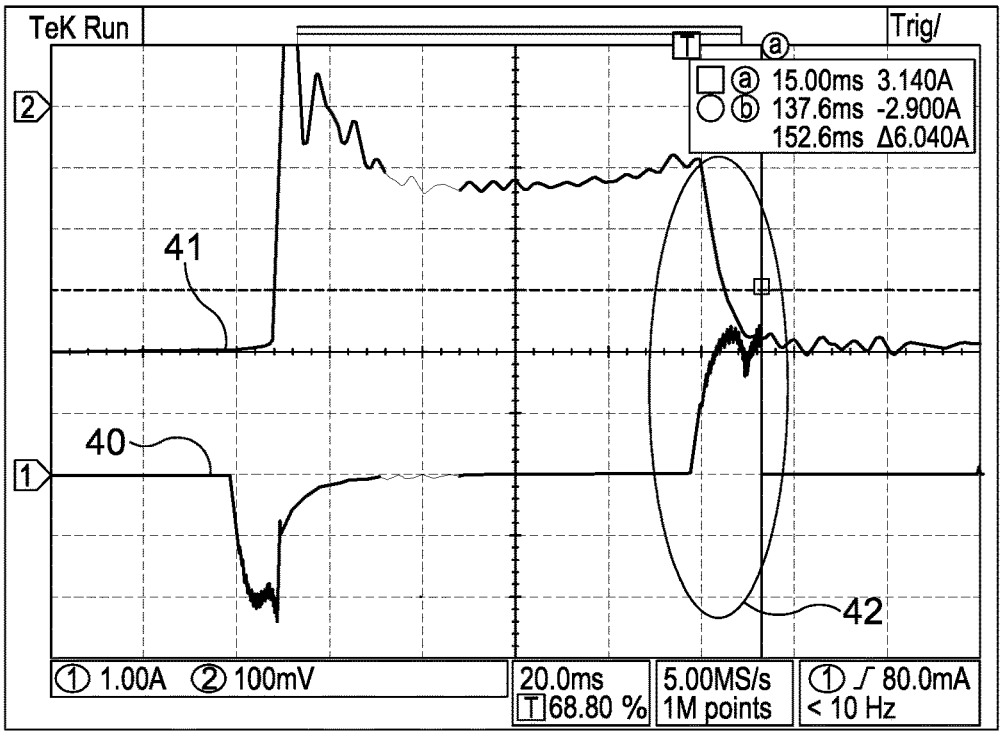

FIG. 11 is a graph showing printing force and current waveforms of FIG. 10 in more detail;

FIG. 12 is a graph showing alternative printing force and current waveforms;

FIG. 13 is a graph showing alternative printing force and current waveforms generated by components of the printhead drive assembly of FIGS. 6*a* and 6*b;*

Figure 14:
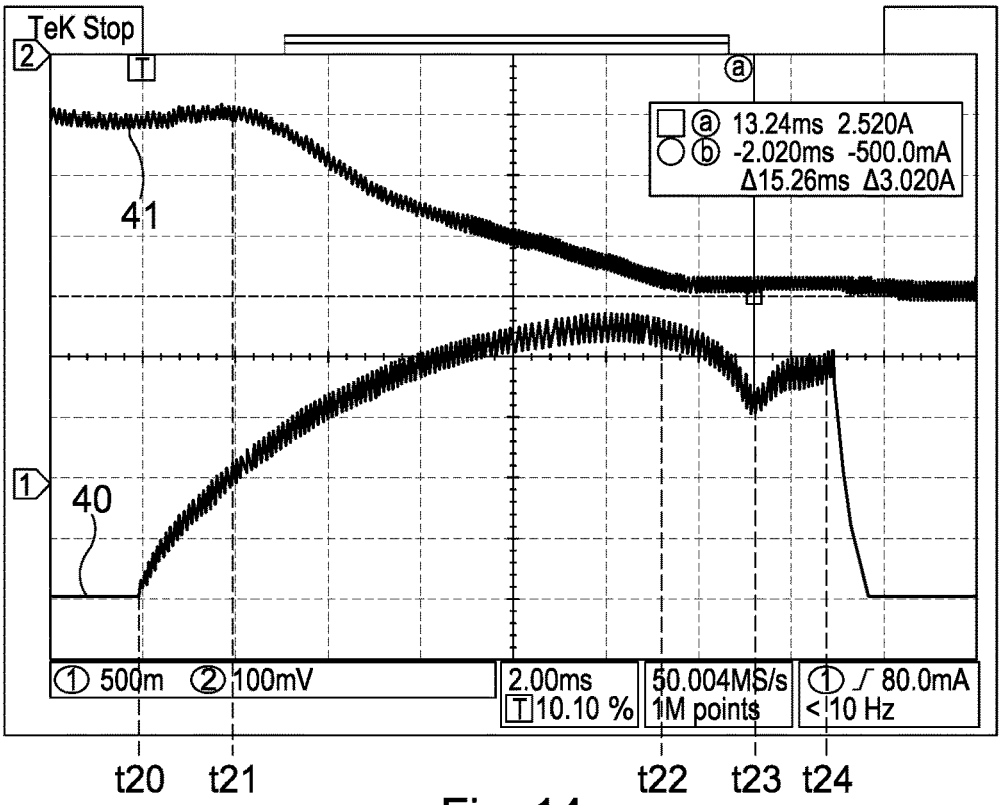
Figure 15:
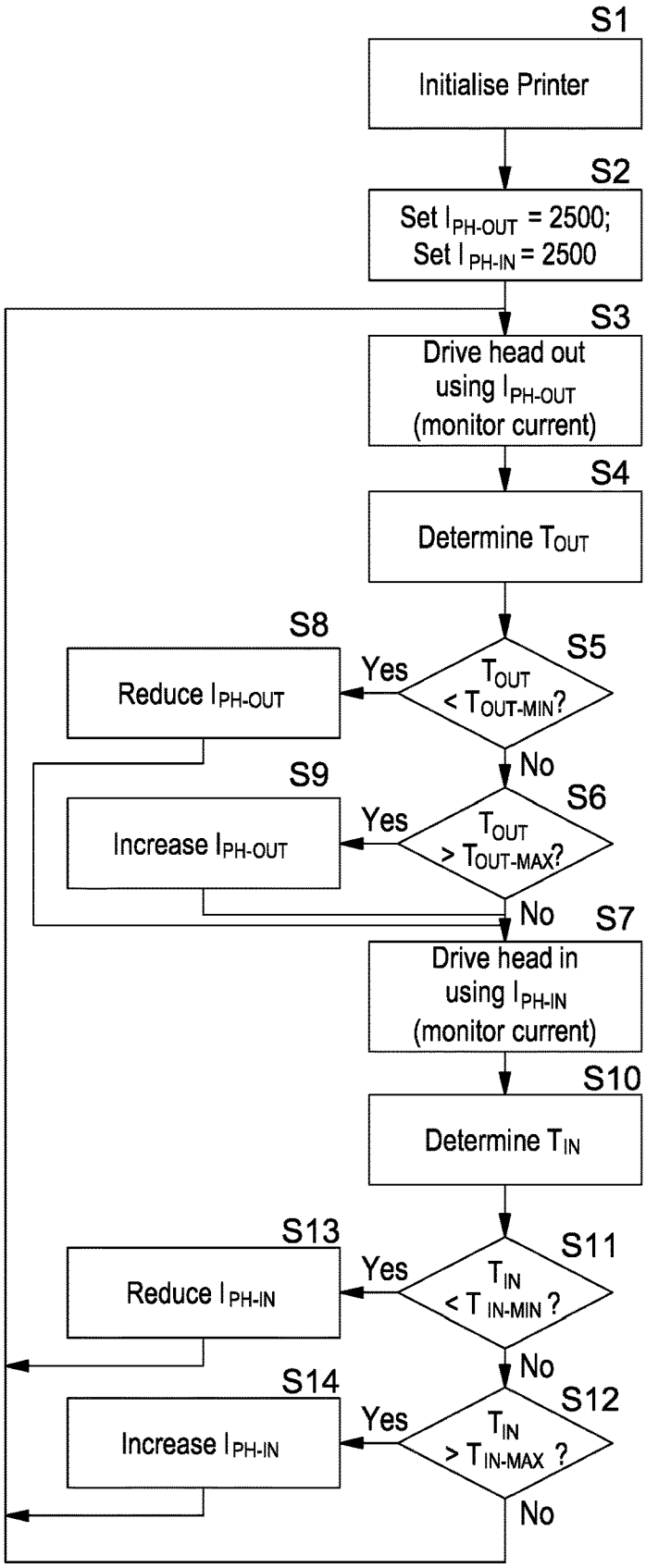
Figure 16:
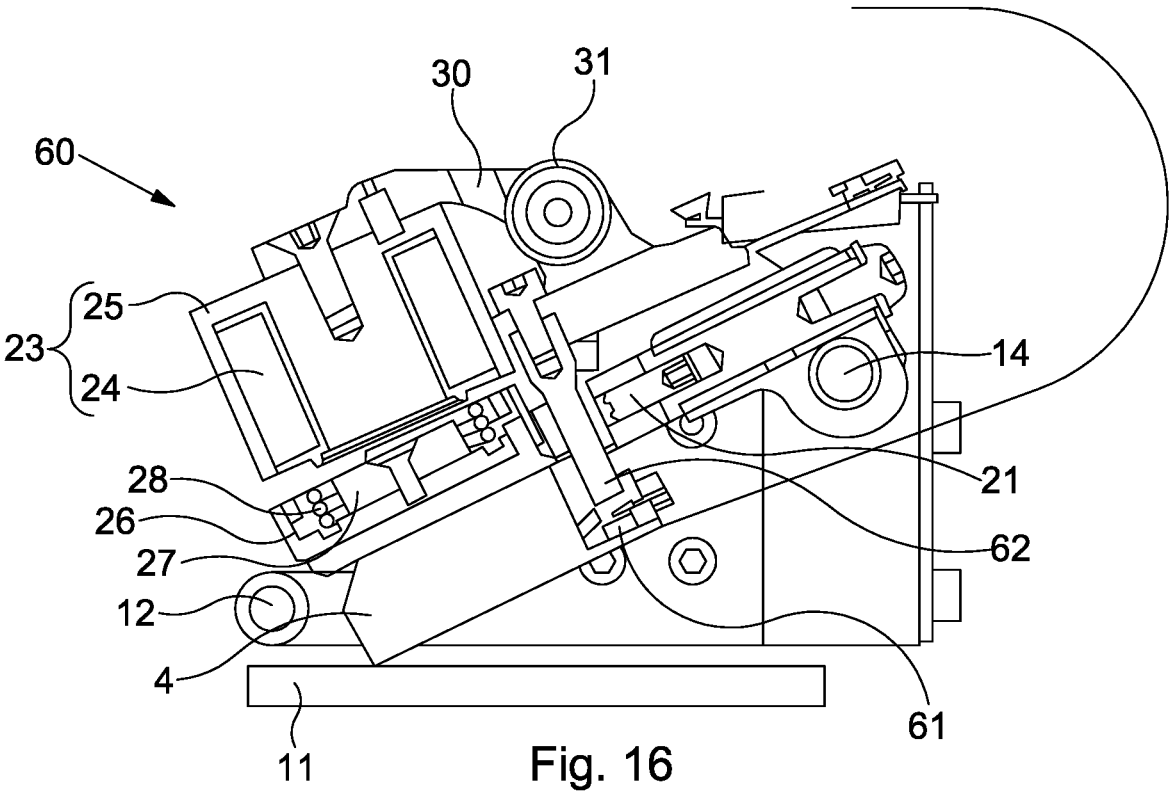
Figure 17A:
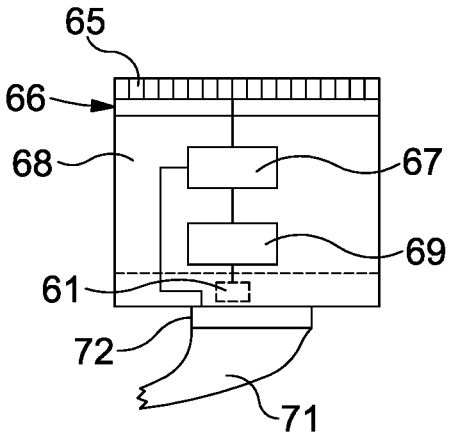
Figure 17B:
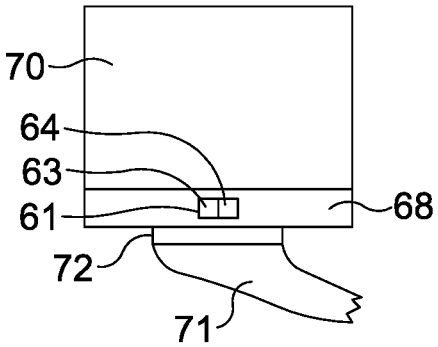
Figure 18:
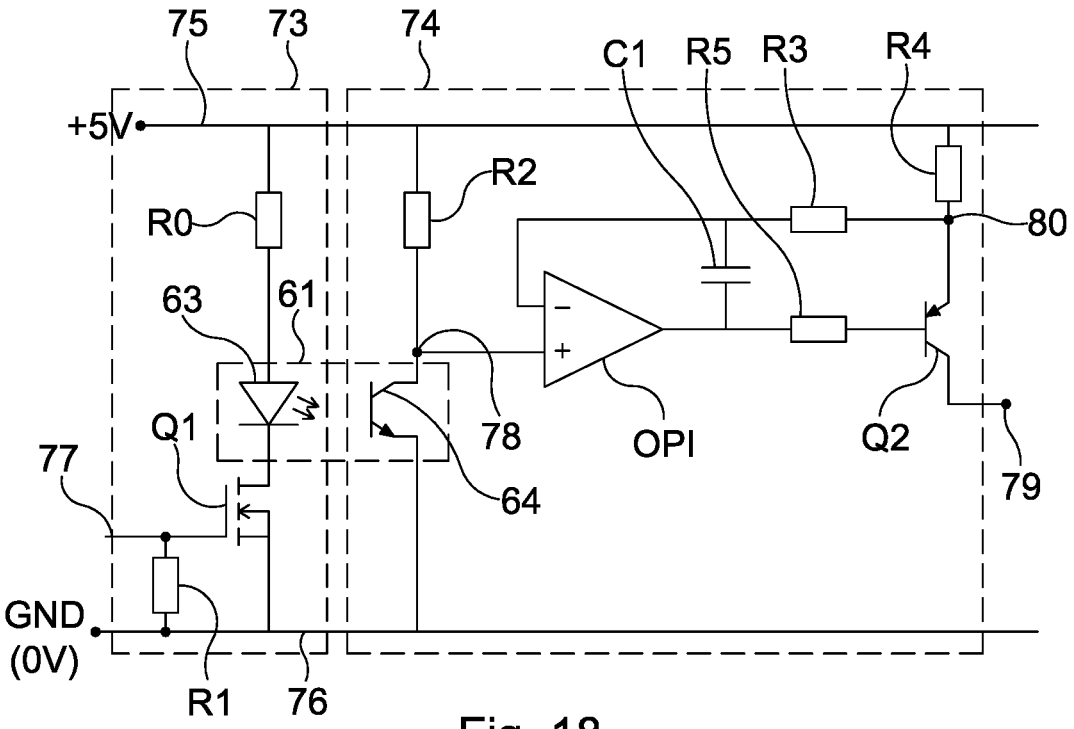

FIG. 14 is a graph showing printing force and current waveforms of FIG. 13 in more detail;

FIG. 15 is flow chart showing a control algorithm for the printhead drive assembly of the present invention;

FIG. 16 is a schematic cross-sectional view of a printhead assembly according to an alternative embodiment of the invention;

FIGS. 17*a* and 17*b* are schematic illustrations of lower and upper surfaces of a printhead according to an embodiment of the invention;

FIG. 18 is schematic view of circuitry provided on the printhead shown in FIGS. 17*a* and 17*b;*

Figure 19:
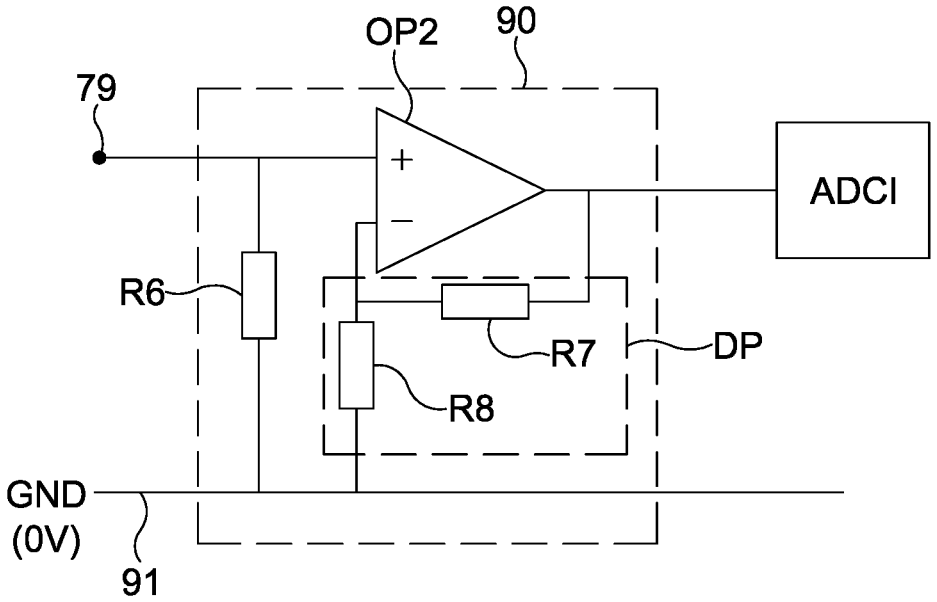
Figure 20:
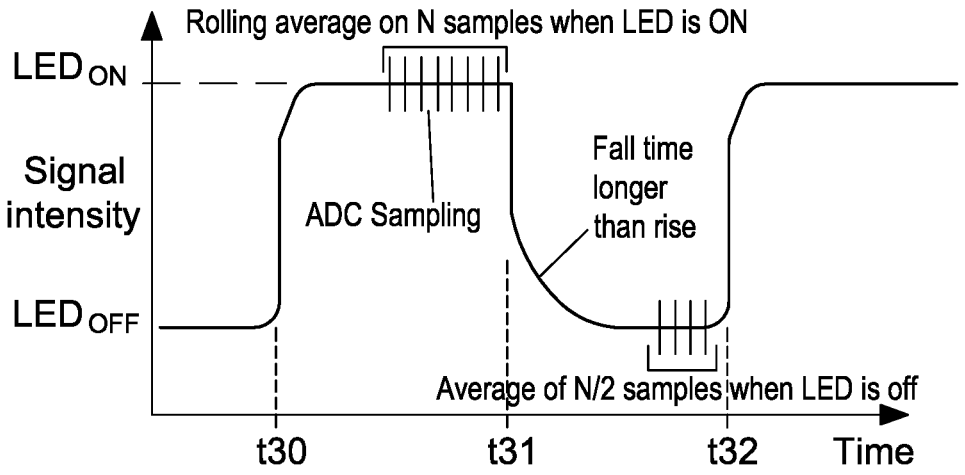
Figure 21:
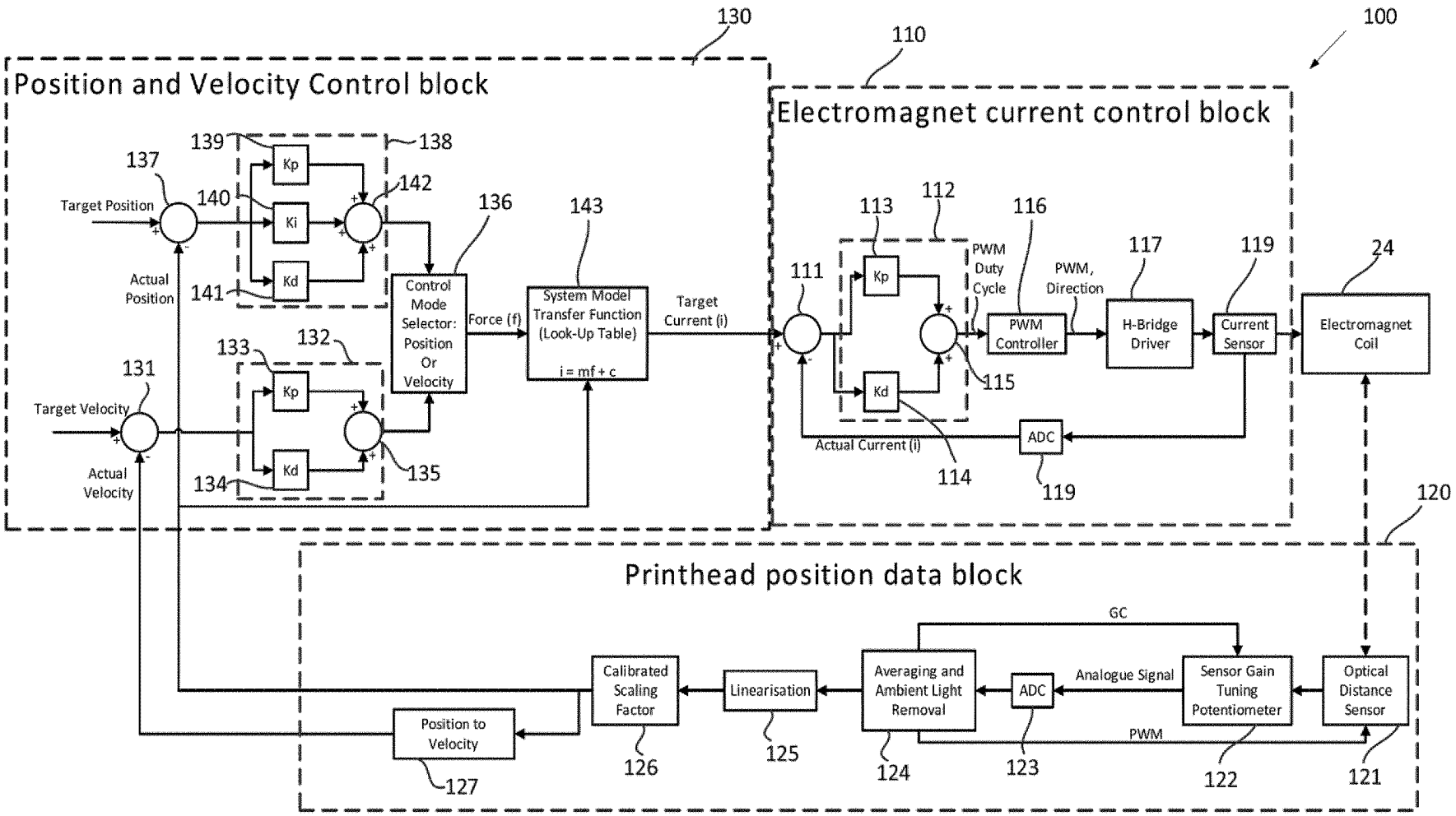
Figure 22:
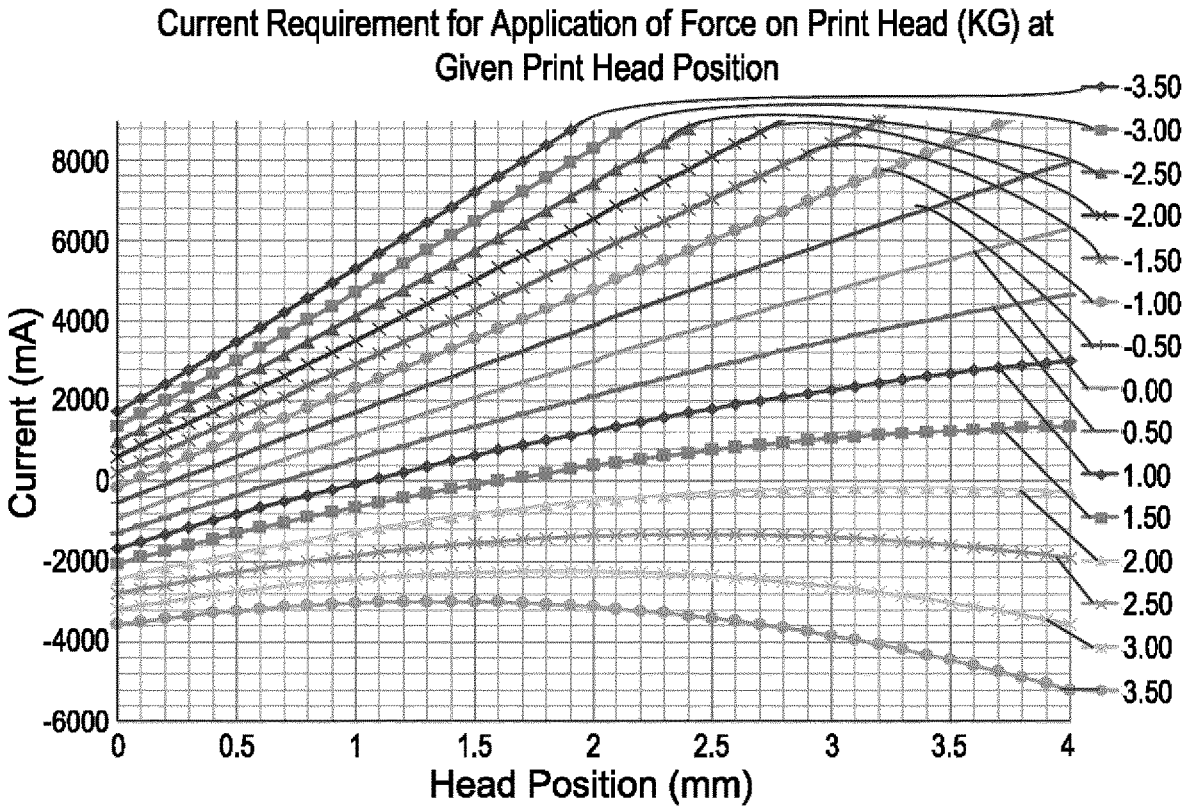
Figure 23:
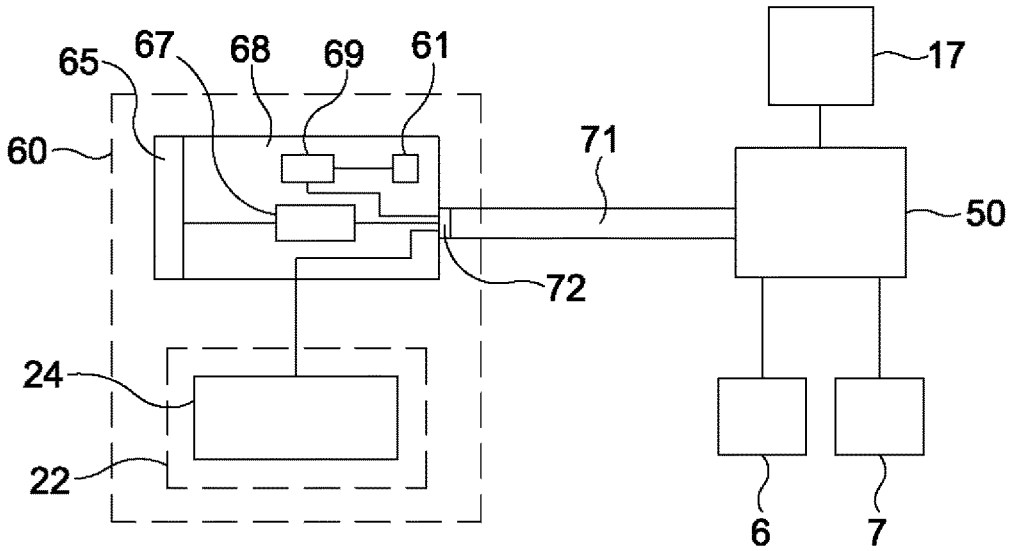
Figure 24:
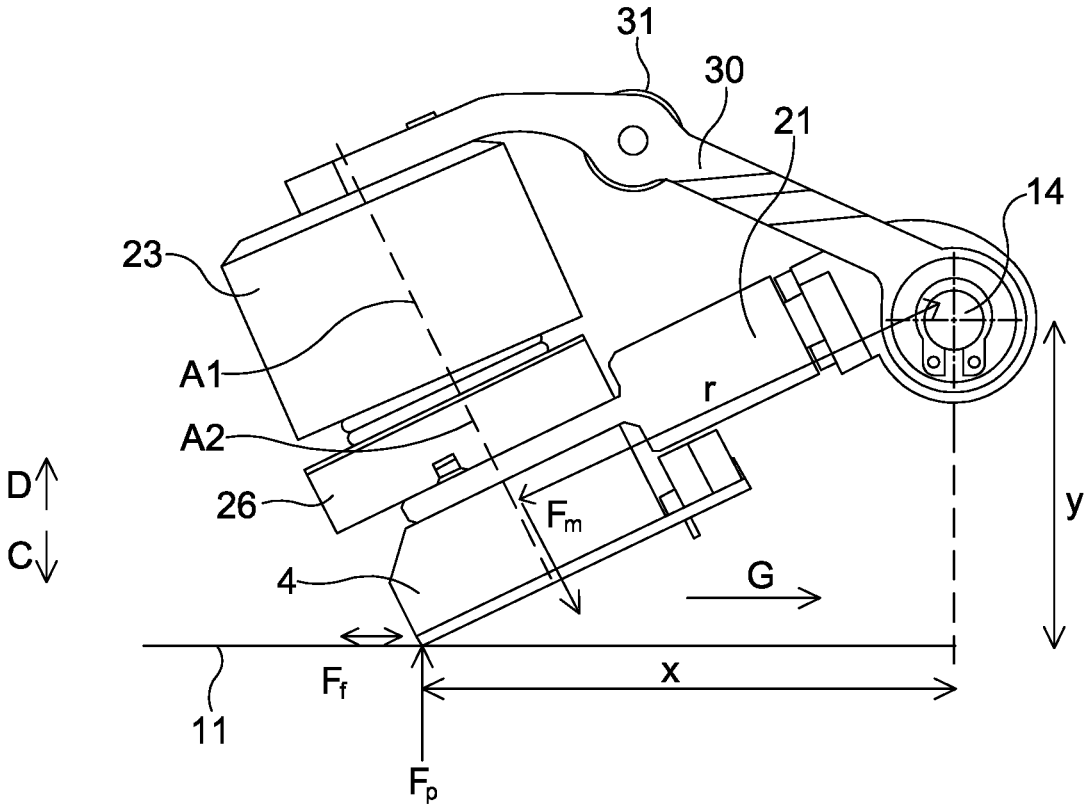

FIG. 19 is schematic view of circuitry provided to process an output of the circuitry of FIG. 18;

FIG. 20 is a schematic illustration of an example signal waveforms generated by the circuitry of FIG. 19;

FIG. 21 shows schematically a printhead drive assembly control arrangement;

FIG. 22 is a graph of reference data relating to characteristics of the printhead drive assembly;

FIG. 23 shows schematically a printer control arrangement according to an embodiment of the invention; and FIG. 24 is a schematic view showing forces acting upon a printhead of the printer of FIG. 1.

Referring to FIG. 1, there is illustrated a thermal transfer printer 1 in which ink carrying ribbon 2 is provided on a ribbon supply spool 3, passes a printhead 4 and is taken up by a ribbon take-up spool 5. The ribbon supply spool 3 is driven by a stepper motor 6 while the ribbon take-up spool is driven by a stepper motor 7. In the illustrated embodiment the ribbon supply spool 3 is mounted on an output shaft 6*a* of its stepper motor 6 while the ribbon take-up spool 5 is mounted on an output shaft 7*a* of its stepper motor 7. The stepper motors 6, 7 may be arranged so as to operate in push-pull mode whereby the stepper motor 6 rotates the ribbon supply spool 3 to pay out ribbon while the stepper motor 7 rotates the ribbon take-up spool 5 so as to take-up ribbon. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In other embodiments the ribbon may be transported from the ribbon supply spool 3 to the ribbon take-up spool 5 past the printhead 4 in other ways. For example only the ribbon take-up spool 5 may be driven by a motor while the ribbon supply spool 3 is arranged so as to provide resistance to ribbon motion, thereby causing tension in the ribbon. That is, the motor 6 driving the ribbon supply spool 3 may not be required in some embodiments. Resistance to ribbon movement may be provided by a slipping clutch arrangement on the supply spool. In some embodiments the motors driving the ribbon supply spool 3 and the ribbon take-up spool 5 may be motors other than stepper motors. For example the motors driving the ribbon supply spool 3 and the ribbon take-up spool 5 may be direct current (DC) motors. In general the motors driving the ribbon supply spool 3 and/or the ribbon take-up spool 5 may be torque controlled motors (e.g. DC motors) or position controlled motors (e.g. stepper motors, or DC servo motors).

Ribbon paid out by the ribbon supply spool 3 passes a guide roller 8 before passing the printhead 4, and a further guide roller 9 and subsequently being taken up by the ribbon take-up spool 5.

The printhead 4 is arranged to press the ribbon 2, and a substrate 10 against a printing surface 11 to effect printing. The printhead may, for example, be a thermal transfer printhead comprising a plurality of printing elements, each arranged to remove a pixel of ink from the ribbon 2 and to deposit the removed pixel of ink on the substrate 10. The printing surface 11 may suitably be a print roller (e.g. in continuous printing modes) or a platen (e.g. in continuous or intermittent printing modes).

The printhead 4 is moveable in a direction generally parallel to the direction of travel of the ribbon 2 and the substrate 10 past the printhead 4, as shown by an arrow A. Further, the printhead 4 is moveable towards and away from the substrate 10, so as to cause the ribbon 2 (when passing the printhead) to move into and out of contact with the substrate 10, as shown by arrow B.

Figure 2:
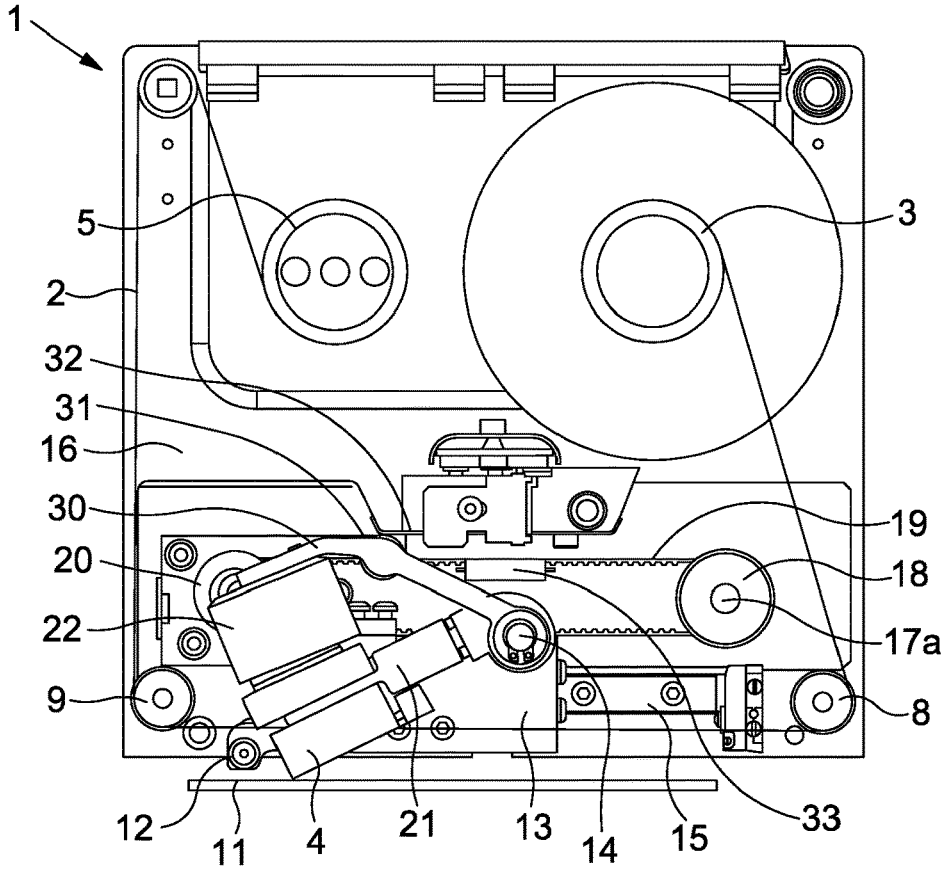
FIG. 2 is a front view of the printer of FIG. 1 in further detail.
Figure 3:
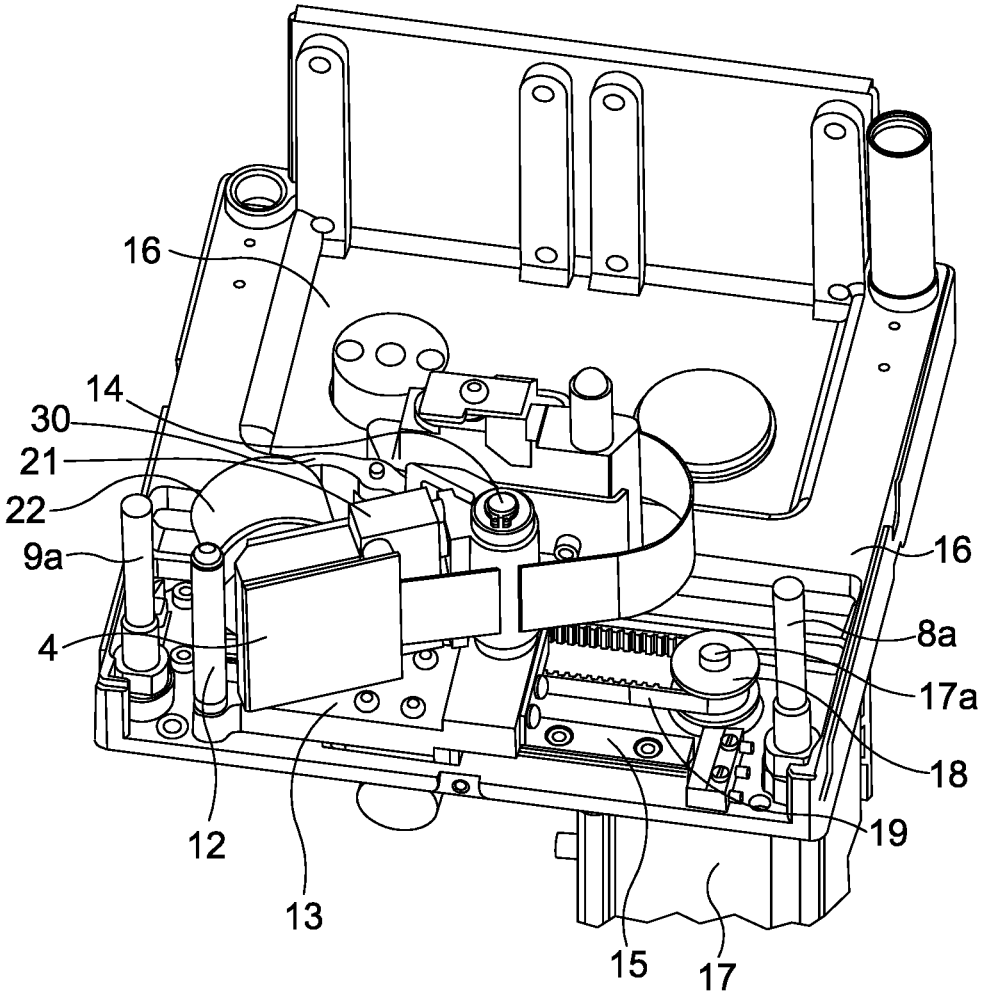
FIG. 3 is a perspective view of the printer of FIGS. 1 and 2 in further detail.

Referring now to FIGS. 2 and 3, the printer 1 is described in more detail. The printhead 4 is pivotally mounted to a printhead carriage 13 for rotation about a pivot 14 thereby allowing the printhead 4 to be moved towards or away from the printing surface 11 (which is shown only in FIGS. 1 and 2). The pivot 14 is a shaft which extends in a direction which is substantially normal to the plane of FIG. 2, with the pivotal movement of components about the pivot being movement in the plane of FIG. 2.

The printhead carriage 13 is displaceable along a linear track 15, which is fixed in position relative to a base plate 16 of the printer 1. A guide roller 12 is also mounted to the printhead carriage 13, which guides the ribbon 2 as it passes between the roller 9, and the printhead 4, and ensures a suitable ribbon angle around the printhead 4 during printing operations.

In use the ribbon may be mounted upon a ribbon cassette (not shown). When the ribbon cassette is installed within the printer 1, the guide rollers 8, 9 (as shown in FIG. 2) are supported by respective support pins 8*a*, 9*a* (as shown in FIG. 3).

The position of the printhead carriage 13 in the direction of ribbon movement (and hence position of the printhead 4 in that direction) is controlled by a motor 17 (as shown in FIG. 3). The motor 17 is located behind the base plate 16 and drives a pulley wheel 18 that is mounted on an output shaft 17*a* of the motor 17. The pulley wheel 18 in turn drives a printhead drive belt 19 extending around a further pulley wheel 20. The printhead carriage 13 is secured to the printhead drive belt 19. Thus rotation of the pulley wheel 18 in a clockwise direction (as seen in FIG. 2) drives printhead carriage 13 and hence the printhead 4 to the left, whereas rotation of the pulley wheel 18 in a counter-clockwise direction drives the printhead 4 to the right.

The belt 19 may be considered to be a form of flexible linkage. However, the term flexible linkage is not intended to imply that the belt behaves elastically. That is, the belt 19 is relatively inelastic in a direction generally parallel to the direction of travel of the ribbon 2 and the substrate 10 past the printhead 4 (i.e. the direction which extends between the pulleys 18 and 20). It will be appreciated, of course, that the belt 19 will flex in a direction perpendicular to the direction of travel of the ribbon 2 and the substrate 10 past the printhead 4, so as to allow the belt 19 to move around the pulleys 18, 20. However, in general, it will be understood that the relative inelasticity ensures that any rotation of the pulley wheel 18 caused by the motor 17 is substantially transmitted to, and causes movement of, the printhead carriage 13, and hence the printhead 4. The belt 19 may, for example, be a polyurethane timing belt with steel reinforcement. For example, the belt 19 may be an AT3 GEN III Synchroflex Timing Belt manufactured by BRECOflex CO., L.L.C., New Jersey, United States.

As shown in FIG. 2, the printhead 4 is mounted on a first side of a support arm 21, the support arm 21 being arranged to pivot about the pivot 14. The arc of movement of the printhead 4 with respect to the pivot 14 is determined by the location of the printhead 4 relative to the pivot 14, which is, in turn, determined by the length of the support arm 21.

Movement of the printhead 4 towards and away from the printing surface 11, and the pressing of the printhead 4 against the ribbon 2, the substrate 10, and the printing surface 11, is controlled by a printhead drive assembly 22 as described in more detail below.

Various operations of the printer 1, such as, for example, ribbon movement between the spools 3, 5 (e.g. by the motors 6, 7), movement of the printhead towards and away from the printing surface 11 (e.g. by the printhead drive assembly 22), and movement of the printhead 4 in a direction parallel to the printing surface 11 (e.g. by the motor 17) are controlled by a controller 50.

A first component of the printhead drive assembly 22 is mounted on a printhead drive assembly arm 30, which is arranged to pivot about the pivot 14 of the printhead carriage 13. The first component of the printhead drive assembly 22 thus moves according to a well-defined relationship with the pivot 14. A second component of the printhead drive assembly 22 is mounted on the support arm 21. The first and second components of the printhead drive assembly 22 can be configured to attract or repel one another, so as to cause the printhead 4 to move towards and away from the printing surface 11 by the action of the printhead drive assembly 22. Given the common pivot 14 about which each of the first and second components of the printhead drive assembly 22 are arranged to pivot, it will be understood that attraction or repulsion of the two components of the printhead drive assembly 22 from one another will cause movement of at least one of those components in an arc about the pivot 14.

The printhead 4, printhead support arm 21, printhead drive assembly 22 and printhead drive assembly arm 30 may together be referred to as a printhead assembly 51.

A bearing 31 is mounted upon the printhead drive assembly arm 30. In use, the bearing 31 bears against a bearing surface 32, which is fixedly attached to the base plate 16 of the printer 1. A spring 33 is provided between the printhead drive assembly arm 30 and the printhead carriage 13, and is arranged to urge the printhead drive assembly arm 30 to rotate in a clockwise direction (as seen in FIG. 2) about the pivot 14. A first portion 34 of the bearing surface 32 extends in a direction substantially parallel to the linear track 15, such that during movement of the printhead carriage 13 back and forth along the linear track 15 (as indicated by arrow A in FIG. 1), the bearing 31 bears against the first portion 34 of the bearing surface 32, and causes the angular position of the printhead drive assembly arm 30 with respect to the pivot 14 to be maintained, such that the printhead drive assembly arm 30 (and the first component of the printhead drive assembly 22 which is affixed thereto) does not move towards or away from the printing surface 11.

It will be appreciated, however, that, during movement of the printhead carriage 13 back and forth along the linear track 15, any extension or retraction of the printhead drive assembly will cause the printhead 4 (which is secured to the second component of the printhead drive assembly 22) to move towards and away from the printing surface 11 respectively.

The bearing surface 32 further comprises a second portion 35 which slopes away from the printing surface 11, which second portion 35 is disposed at the left-hand end of the bearing surface 32 (as seen in FIG. 2). As such, when the printhead carriage 13 is caused to move to the left (as seen in FIG. 2), the bearing 31 is caused (under the urging action of the spring 33) to bear against the bearing surface 32, and to follow the bearing surface 32 as it slopes away from the printing surface 11. Such movement allows the printhead drive assembly arm 30 to rotate in a clockwise direction (as seen in FIG. 2) about pivot 14, thereby causing the first component of the printhead drive assembly 22 to move away from the printing surface 11. It will be understood that for any given configuration of the printhead drive assembly 22, such movement will also cause the printhead 4 to move away from the printing surface 11. Thus, when the printhead carriage 13 is caused to move to the left (as seen in FIG. 2), all components of the printhead assembly 51 will move together to the left. Further, as the bearing 31 follows the bearing surface 32 as it slopes away from the printing surface 11, all of the components of the printhead assembly 51 rotate together in a clockwise direction (as seen in FIG. 2) about the pivot 14, thereby causing the printhead assembly 51 to move away from the printing surface 11.

Figure 4:
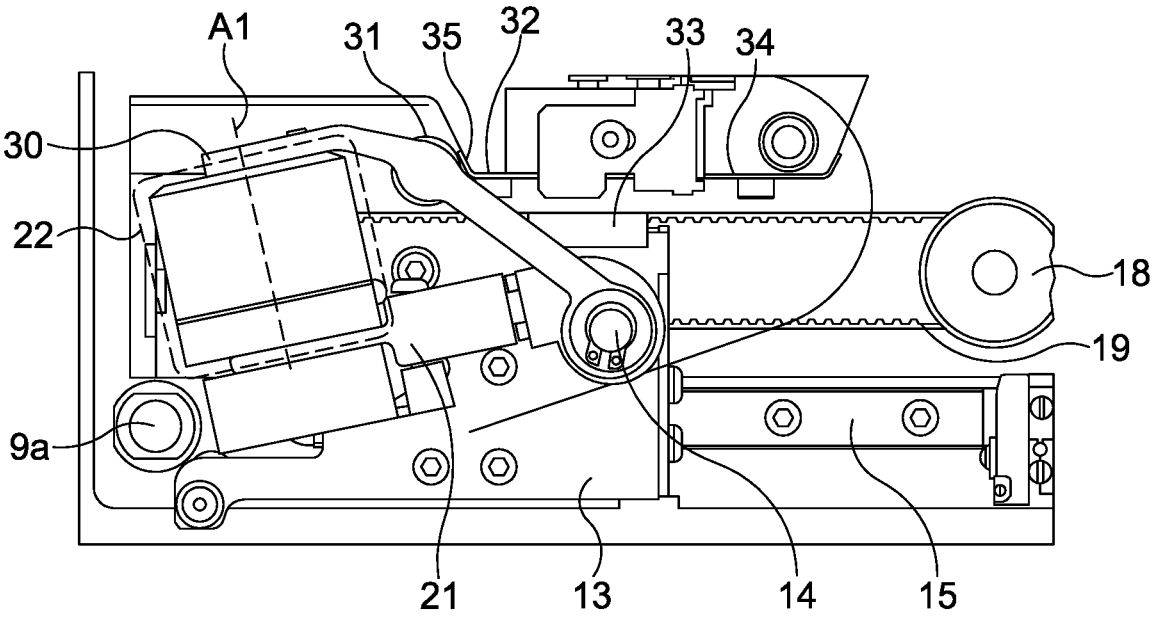
FIG. 4 is a front view of part of the printer of FIG. 1 in a parked configuration.

Referring now to FIG. 4, the printhead assembly 51 is shown in a configuration in which the bearing 31 is engaged with the second portion 35 of the bearing surface 32. This configuration may be referred to as a parked configuration. The printhead drive assembly arm 30 is shown rotated about pivot 14, such that the printhead drive assembly 22 (and thus the printhead 2) is lifted away from the printing surface 11. This position is not used during normal printing operations. However, during maintenance operations or, for example, when a printer ribbon is changed, this configuration can be used to allow easy access to the ribbon path. In particular, whereas the printer ribbon is usually guided by the printhead 4, when the printhead assembly 51 (and also, therefore, the printhead drive assembly arm 30, printhead drive assembly 22, the support arm 21, and the printhead 4) is in the parked configuration (as shown in FIG. 4) the printhead 4 does not interfere with the ribbon extending between the guide rollers 8 and 9 (which are shown in FIGS. 1 and 2), allowing ribbon to be removed and replaced with ease.

As shown in more detail in FIGS. 5*a* and 5*b*, the printhead drive assembly 22 comprises an electromagnet 23, the electromagnet comprising a coil 24 and a ferromagnetic element 25. The ferromagnetic element is suitably formed from a soft magnetic material (e.g. a ferrous metal, such as iron or mild steel). The coil 24 comprises insulated wire (e.g. copper wire) wrapped around an annular bobbin (not shown), and is inserted into a correspondingly sized annular recess in the ferromagnetic element 25. The annular recess is defined between an outer portion 25*a* of the ferromagnetic element 25, which surrounds the coil 24, and an inner portion 25*b* of the ferromagnetic element 25, which is surrounded by the coil 24.

The outer portion 25*a* and inner portion 25*b* are generally rotationally symmetrical about a common axis A1, and both extend along the axis A1 to a similar extent. A face of the inner portion 25*b* which faces generally downwards (in the orientation shown in FIGS. 5*a* and 5*b*) lies in parallel to, but slightly offset from an outer face of the outer portion 25*a*. In more detail, the face of the inner portion 25*b* is set back from the outer face of the outer portion 25*a* such that the outer portion 25*a* extends further along the axis A1 than the inner portion 25*b*. As described in more detail below, a retaining plate 36 is provided on the lower face of the inner portion 25*b*, such that the lower face of the retaining plate 36 (in the orientation shown in FIGS. 5*a* and 5*b*) lies in close proximity to a common plane with an outer face of the outer portion 25*a*.

The soft magnetic nature of the ferromagnetic element 25 allows magnetic fields generated when a current is passed through the coil 24 to be intensified, the magnetic field preferentially flowing in the low reluctance material of the ferromagnetic element 25. The electromagnet 23 is attached to the printhead drive assembly arm 30, which is in turn attached (via pivot 14) to the printhead carriage 13 for movement therewith. The electromagnet 23 defines the first component of the printhead drive assembly 22.

The printhead drive assembly 22 further comprises a target 26. The target is formed from a soft magnetic material (e.g. a ferrous metal, such as iron or mild steel) and is generally cup shaped. The target 26 comprises a rim portion 26*a* which extends away from a flat central portion 26*b*. The flat central portion 26*b* is generally disc-shaped, the rim portion 26*a* extending in a first direction from the disc around a perimeter thereof. The rim portion 26*a* and central portion 26*b* are generally rotationally symmetrical about an axis A2, as illustrated in FIGS. 5*a* and 5*b*).

The target 26 is fixedly mounted on the support arm 21, on a second side of the support arm 21, opposite to the first side (upon which the printhead 4 is mounted). The rim portion 26*a* extends from the disc portion 26*b* in a direction away from the support arm 21—extending towards the electromagnetic element 25. A cylindrical recess is defined within the rim portion 26*a*.

The printhead drive assembly 22 further comprises a permanent magnet 27. The permanent magnet 27 is disc shaped, and is mounted to the flat central portion 26*b* within the cylindrical recess formed within the rim portion 26*a*. The permanent magnet 27 is mounted generally concentrically within the outer rim portion 26*a* on the flat central portion 26*b* (and is therefore centred about the axis A2). The outer rim portion 26*a* of the target 26 surrounds the permanent magnet 27. The rim portion 26*a* extends from the central portion 26*b* by an amount which is approximately equal to the thickness of the permanent magnet 27. As such, the face of the permanent magnet 27 which is furthest from the support arm 21 lies in a common plane, or in close proximity to a common plane, with an outer face of the rim portion 26*a*.

The outer rim portion 26*a* has an internal diameter which is greater than the external diameter of the permanent magnet 27. As such, an annular recess is formed therebetween.

The external diameter of the permanent magnet 27 is also substantially equal to the diameter of the inner portion 25*b* of the ferromagnetic element 25. Similarly, the internal and external diameters off the outer portion 25*a* of the ferromagnetic element 25 are of similar dimensions to the corresponding internal and external diameters of the rim portion 26*a* of the target 26. As such, the annular recesses formed within the target 26 (i.e. between the permanent magnet 27 and the rim portion 26*a*) and the ferromagnetic element 25 (i.e. between the outer portion 25*a* and the inner portion 25*b*) have similar radial extent.

The second component of the printhead drive assembly 22 is formed from the target 26 and the permanent magnet 27.

In an embodiment, the ferromagnetic element 25 may, for example, have an external diameter of 30 mm and a length along the axis A1 of 20 mm. The coil 24 may comprise approximately 330 turns of 0.5 mm diameter wire.

The permanent magnet 27 is formed from a material which generally retains magnetisation in the absence of an external magnetic field (i.e. a hard magnetic material). An appropriate hard magnetic material may, for example, be neodymium grade N42. An alternative hard magnetic material may, for example, be samarium-cobalt. The hard magnetic material may be selected so as to provide a permanent magnet with a high magnetic strength.

In an embodiment, the permanent magnet 27 may have an external diameter of 14 mm, an internal recess having an internal diameter of 2 mm, and a thickness (in a direction parallel to the axis A2) of 4 mm. The target 26 may have an outer diameter of 30 mm, and a thickness (in a direction parallel to the axis A2) of 7 mm.

It will, however, be appreciated that alternative materials and dimensions may be used as required. As described above, the two components of the printhead drive assembly 22 are arranged such that, each component is mounted upon a respective one of the printhead drive assembly arm 30 and the support arm 21, for rotation in a common plane (i.e. in the plane of FIGS. 5*a* and 5*b*) about the pivot 14.

When the printhead 4 is in a position spaced apart from the printing surface 11—i.e. in a first configuration—(which is shown in FIG. 5*a*), the components of the first and second components of the printhead drive assembly 22 are generally concentrically arranged, such that the axes A1 and A2 are co-linear. On the other hand, when the printhead 4 is in a configuration in which it is extended towards the printing surface 11 (i.e. a second configuration, as shown in FIG. 5*b*), the second component of the printhead drive assembly 22 is rotated with respect to the first component, such that the axes A1 and A2 are inclined to one another. However, it will be appreciated that the length of arms 21, 30 (which may, for example, be in the region of 75 mm), and the relatively small separation between the first and second components in the second configuration (which may, for example, be in the region of 5 mm), ensures that the first and second components of the printhead drive assembly are still generally aligned with one another, even where the axes A1 and A2 are not precisely co-linear.

It will, of course be appreciated that other arrangements are also possible. For example, the mounting positions of the first and second components may be reversed (i.e. the first component being mounted to the support arm 21 and so on).

The printhead drive assembly 22 further comprises a spring 28. The spring 28 is a coil spring 28, and is received within the annular recess formed between the permanent magnet 27 and the rim portion 26*a*. The spring 28 is also aligned and concentric with the axes A1 and A2 in the first configuration. The spring 28 is a compression spring which urges the first and second components of the printhead drive assembly 22 apart from one another (as described in more detail below). The spring may, for example, be a spring manufactured by Lee Springs, Brooklyn, N.Y., having a part number LC055K01S. In an embodiment, the spring may have a free (i.e. uncompressed) length of around 19 mm. However, in use, such a spring may be pre-compressed by approximately 11 mm prior to assembly of the printhead drive assembly 22. That is, in its most extended state during normal operations, the spring 28 may still be compressed from its relaxed state by around 11 mm.

The spring 28 may be arranged to bear against a portion of each of the first and second components of the printhead drive assembly 22. For example, in some embodiments a first end of the spring 29 may be received in a feature provided in the coil bobbin (not shown). A second end of the spring 29 may be received in a feature provided in an annular spacer (not shown) which is provided around the permanent magnet 27.

The printhead drive assembly further comprises a limit screw 37. The limit screw 37 passes through the central recess within the permanent magnet 27, and is secured to the target 26 via threaded engagement with a bore provided therein. The limit screw 37 is generally concentric with the axis A2. However, the limit screw 37 extends beyond the upper surface of the target 26 and the permanent magnet 27. In particular, the limit screw extends into a recess provided within the inner portion 25*b* of the ferromagnetic element 25. The limit screw 37 comprises a head 37*a* having a greater diameter than a shank 37*b*. The head 37*a* is received within the recess within the inner portion 25*b*, although, in use, does not make contact with the walls of the recess. The shank 37*b* of the limit screw 37 passes through a slot 36*a* provided within the retaining plate 36. The slot 37*a* has a width in a direction out of the plane of the figure in the orientation shown in FIG. 5*a* which is larger than the diameter of the shank 37*b*, but smaller than the diameter of the head 37*a*. As such, the retaining plate 36 is configured to prevent the head 37*a* of the limit screw 37 passing through the slot 36*a*, thereby preventing the support arm 21 rotating about the pivot 14 more than a predetermined angular amount relative to the printhead drive assembly arm 30.

As such, the limit screw 37 and retaining plate 36 cooperate to prevent over extension of the printhead 4 away from the body of the printer when there is no printing surface 11 in place.

The retaining plate 36 may, for example, be formed from a similar soft magnetic material (e.g. mild steel) as the ferromagnetic element 25, and may, therefore act to guide the magnetic field in the same way as the ferromagnetic element 25. The retaining plate 36 may thus be considered to be part of the ferromagnetic element 25.

The printhead drive assembly 22 further comprises a bumper 29, as shown most clearly in FIG. 5*b*. The bumper 29 is a thin rubber disc, which is provided between the opposing faces of the permanent magnet 27 and the inner portion 25*b* of the ferromagnetic element 25 (or, more particularly, the retaining plate 36). The bumper 29 prevents direct contact between the permanent magnet 27 and the ferromagnetic element 25, and thus maintains a minimum separation therebetween.

Given the well-known relationship between the magnitude of magnetic force and separation between attracted magnetic bodies (i.e. the magnitude of the force being approximately inversely proportional to the square of the separation), it will be understood that by including the bumper 29, excessive attractive forces between the permanent magnet 27 and the ferromagnetic element 25 are prevented. That is, in the absence of the bumper 29, if the permanent magnet 27 and the ferromagnetic element 25 were allowed to come into direct contact, the attractive force therebetween may be of such great magnitude that, in use, it may not be possible to overcome the attraction. Of course, alternative techniques and arrangements may be used to prevent excessive forces from being generated, such as, for example, some other form of mechanical stop which prevented relative movement between some part of the support arm 21 and the printhead carriage 13, or similar. Thus, the bumper 29 is not an essential component of the printhead drive assembly 22.

In the arrangement illustrated in FIG. 5*a*, that is where the printhead 4 is in a position spaced apart from the printing surface 11 (i.e. the first configuration, or a first position), the permanent magnet 27, target 26 and the ferromagnetic element 25 form a magnetic circuit. The magnetic circuit is further illustrated in FIG. 6*a*, which shows schematically a path of the magnetic field M1 within the permanent magnet 27, the target 26, and the ferromagnetic element 25. In particular, magnetic field lines flow from a south pole formed at the lower face of the inner portion 25*b* of the ferromagnetic element 25, through the inner portion 25*b* of the ferromagnetic element 25 before passing into the outer portion 25*a* of the ferromagnetic element 25. The magnetic field M1 then passes through a first air gap g1 between the lower face of the outer portion 25*a* of the ferromagnetic element 25 (which forms a north pole) and the upper face of the rim portion 26*a* of the target 26 (which forms a south pole). The field M1 then passes down through the rim portion 26*a* of the target 26, and via the central portion 26*b* of target 26 to the lower face of the permanent magnet 27. Finally, the magnetic field M1 passes through the permanent magnet 27, and then through a second gap g2 between the upper face of the permanent magnet 27 (a north pole) and the lower face of the inner portion 25*b* of the ferromagnetic element 25 (a south pole). It will be appreciated that the gap g2 may be substantially filled by the bumper 29. That is, the gap g2 may not be an air gap. However, the bumper 29 may be formed from a material having a magnetic permeability which is similar to that of air.

The provision of the ferromagnetic element 25 and the target 26, both of which are formed from ferromagnetic materials, provides a path of relatively high magnetic permeability (or low reluctance). This ensures that the magnetic circuit described is complete, and that the magnetic forces are focused so as to bring about the desired effect (i.e. generating magnetic forces between the first and second components of the printhead drive assembly 22). Moreover, while such forces would exist without the provision of the target 26, and in particular the rim portion 26*a*, and the outer portion 25*a* of the ferromagnetic element 25, these elements provide a low reluctance (i.e. high permeability) return path for the magnetic field M1, and strengthen the magnetic interaction between the ferromagnetic element 25 and the permanent magnet 27, meaning that a lower overall magnetic field strength is required when compared to an arrangement in which no return path was provided to achieve the same operating forces. The formation of a complete magnetic circuit allows more efficient use to be made of a magnetic field of a given strength.

Further, the well-defined nature of the magnetic path M1 enhances the contrast that is possible between the above described configuration (i.e. the first configuration where the printhead 4 is in a position spaced apart from the printing surface 11, and the permanent magnet 27 is close to the ferromagnetic element 25, as illustrated in FIGS. 5*a* and 6*a*) and the second configuration (or a second position) in which the printhead 4 is close to the printing surface 11 (i.e. the permanent magnet 27 is spaced apart from the ferromagnetic element 25), as illustrated in FIGS. 5*b* and 6*b*.

In the second configuration, there is a less well-defined low reluctance magnetic circuit formed between the permanent magnet 27 and the ferromagnetic element 25, and thus the attraction therebetween is reduced with respect to the first configuration. In particular, in the second configuration, increased first and second air gaps g1', g2' contribute to a significant weakening of the magnetic interaction between the permanent magnet 27 and the ferromagnetic element 25. A magnetic path M1' is shown, however, it will be appreciated that the gaps g1' and g2' make up a significant proportion of the overall path M1' (especially when compared to the small proportion of path M1' which is formed by gaps g1 and g2).

In is noted that in both of the configurations shown in FIGS. 6*a* and 6*b*, the electromagnet 23 is in a de-energised condition.

It is further noted that in each of the configurations shown in FIGS. 5*a*, 5*b*, the bearing 31 is engaged with the first portion 34 of the bearing surface 32 (and not the second portion 35), and thus the printhead 4 is not in the parked configuration. It will be appreciated that, as shown in FIG. 4, when the carriage 13 is moved so as to cause the printhead to move to the parked configuration, the printhead will usually (although not necessarily) be in the first configuration (i.e. the permanent magnet 27 being close to the ferromagnetic element 25).

Detail of the operation of the printer 1 will now be described in more detail. There are generally two modes in which the thermal transfer printers can be used, which are sometimes referred to as a "continuous" mode and an "intermittent" mode. In both modes of operation, the apparatus performs a regularly repeated series of printing cycles, each cycle including a printing phase during which ink is transferred to the substrate 10, and a further non-printing phase during which the printer is prepared for the printing phase of the next cycle.

In continuous printing, during the printing phase the printhead 4 is brought into contact with the ribbon 2, the other side of which is in contact with the substrate 10 onto which an image is to be printed. The printhead 4 is held stationary during this process—the term "stationary" is used in the context of continuous printing to indicate that although the printhead 4 will be moved into and out of contact with the ribbon 2, it will not move relative to the ribbon path in the direction in which ribbon 2 is advanced along that path.

Both the substrate 10 and ribbon 2 are transported past the printhead 4 generally, but not necessarily, at the same speed.

In intermittent printing, the substrate 10 is advanced past the printhead 4 in a stepwise manner such that during the printing phase of each cycle the substrate 10 and generally but not necessarily the ribbon 2 are stationary. Relative movement between the substrate 10, the ribbon 2, and the printhead 4 are achieved by displacing the printhead 4 relative to the substrate 10 and ribbon 2. Between the printing phases of successive cycles, the substrate 10 is advanced so as to present the next region to be printed beneath the printhead 4 and the ribbon 2 is advanced so that an unused section of ribbon is located between the printhead 4 and the substrate 10. Accurate transport of the ribbon 2 is used to ensure that unused ribbon is always located between the substrate 10 and printhead 4 at a time that the printhead 4 is advanced to conduct a printing operation.

The printer 1 is primarily configured to carry out intermittent mode printing. That is, printing is effected on the substrate 10 whilst that substrate 10 is effectively stationary with respect to the printer 1, and in particular the printhead 4. Each printing operation thus requires coordinated control of various movements of the printhead 4 and the ribbon 2. However, it will be appreciated that the printer 1 can also be used for continuous mode printing.

During the printing phase the printhead 4 is brought into contact with the ribbon 2, pressing the ribbon 2 against substrate 10 and the printing surface 11 with a predetermined printing force. It will be appreciated that for each set of circumstances (e.g. type of ribbon, type of printhead, type of substrate, printing speed, size of contact area etc.) the optimal printing force may be different, and that controlling the printhead force has a significant effect on the print quality. The predetermined printing force may, for a corner edge printhead 4 having a width of 32 mm, for example, be a force of around 1.2 kilogram-force (kgf). It will further be appreciated that the printing force may also depend upon angle between the printhead 4 and the printing surface 11 (the printhead angle). For example, a printing force of around 1.2 kgf may be used where the printhead angle is 26 degrees, but may be altered in different arrangements (which may have different printhead angles).

After the predetermined printing force has been established between the printhead 4 and the printing surface 11 (and the intermediate ribbon 2 and substrate 10), the printhead 4 continues to be moved in a direction parallel to the printing surface 11 so as to print an image. Such movement of the printhead in a direction parallel to the direction of the ribbon path past the printhead 4 may be referred to as a printing stroke.

As the printhead 4 is moved across the ribbon 2 and substrate 10, different printing elements are energised so as to cause different regions of ink to be transferred to the substrate 10 at different positions, allowing an image to be formed. It will be appreciated that maintaining the printing force between the printhead 4 and the printing surface 11 is necessary to maintain a consistent print quality throughout an image.

Once the printhead 4 has travelled the full length of a printed image (i.e. it has completed a printing stroke), the movement is halted and the printing phase is complete. During the non-printing phase which follows, the printhead 4 is withdrawn from contact with the ribbon 2, substrate 10, and printing surface 11, before being moved in a direction parallel to the printing surface 11 opposite to the earlier movement during the printing phase, so as to be ready to print a further image. During this non-printing phase the ribbon 2 is advanced by a linear amount which corresponds to the length of a printed image such that a new and un-printed portion of ribbon 2 is adjacent the substrate 10 prior to the start of the next image. The substrate 10 may also be advanced during this non-printing phase (although details of the substrate movement are not discussed in detail herein).

Control of the movement of the printhead 4 towards and away from the printing surface 11 (and the substrate 10) is effected by appropriate control of the printhead drive assembly 22, and more particularly the electromagnet 23. In general terms, the printhead 4 is urged towards the printing surface 11 by the spring 28, and away from the printing surface by the attraction of the permanent magnet 27 towards the ferromagnetic element 25. However, the electromagnet 23 allows the magnetic field in and around the ferromagnetic material 25 to be controlled so as to cause the printhead 4 to move from the first configuration where it is spaced apart from the printing surface 11, to the second configuration, in which is it in contact with the printing surface 11, as described in more detail below.

More particularly, the arrangement of the spring 28 provides a force which urges the printhead 4 towards the printing surface 11. It will be appreciated that, according to Hooke's law, the force exerted by the spring 28 varies substantially linearly with respect to the compression and extension of the spring 28. As described in more detail above, the spring is arranged such that it abuts, at the first end, the ferromagnetic element 25, and at a second end, the target 26, which is fixed to the support arm 21 and printhead 4. Thus, during movement of the printhead 4 towards the ferromagnetic element 25 the spring 28 is compressed, and the force exerted by the spring 28 on the printhead 4 (towards the printing surface 11) increases.

On the other hand, movement of the printhead 4 away from the ferromagnetic element 25 allows the spring 28 to be extended (and therefore relaxed), and the force exerted by the spring 28 on the printhead 4 (towards the printing surface) to decrease. The variation of force exerted on the printhead 4 by the spring 28 varies substantially linearly with respect to a change in separation between the ferromagnetic element 25 and the permanent magnet 27.

It will be appreciated that the linear variation of the spring force is subject to an offset. That is, the separation at which the spring force falls to zero is beyond the operational range of the printhead drive assembly 22. This is a result of the pre-compression of the spring 28. As such, at all operational separations there is a non-zero spring force exerted by the spring 28 urging the printhead 4 toward the printing surface 11. Thus, in the absence of any other forces acting on the printhead 4 (and assuming that the effect of gravity is negligible when compared to the force of the spring 28), the spring 28 will force the printhead 4 to be in contact with the printing surface 11. The magnitude of the force exerted by the spring 28 as a function of the separation between the ferromagnetic element 25 and the permanent magnet 27 (which separation also corresponds to the position of the printhead 4) is shown in FIG. 7, indicated by line S.

In the graph of FIG. 7, positive forces correspond to forces acting to urge the printhead 4 in a direction towards the printing surface 11, and vice versa.

As described above, in some embodiments the spring may have a free length of around 19 mm, and may be pre-compressed by approximately 11 mm prior to assembly of the printhead drive assembly 22. Thus, when the printhead is in the second configuration, the spring may be compressed so as to have a length of around 8 mm. On the other hand, when the printhead is in the first configuration, the spring may be compressed so as to have a length of around 5 mm. The force generated by the spring varies substantially linearly with the compression of the spring.

As can be seen in FIG. 7, when the separation between the ferromagnetic element 25 and the permanent magnet 27 is around 1 mm, the force generated by the spring is around 40 N. The spring force gradually decreases to around 29 N at a separation of around 5 mm.

In addition to the spring force acting on the printhead 4, the permanent magnet 27 is also arranged to generate a force which acts on the printhead 4. In particular, the permanent magnet 27 exerts an attractive force on the ferromagnetic element 25. The attractive force of the permanent magnet 27 acts in the opposite direction to the spring force described above, hence they are shown on the graphs as negative numbers.

As is well known, the magnitude of the attractive force exerted by a permanent magnet on a ferromagnetic material is approximately inversely proportional to the square of the separation between the magnet and the ferromagnetic material. As such, the magnitude of the force between the permanent magnet 27 (which is securely attached to the printhead 4) and the ferromagnetic element 25 increases as the permanent magnet 27 approaches the ferromagnetic element 25, and the separation therebetween reduces. Thus, the force exerted by the permanent magnet 27 is strongest when the separation is smallest, and vice versa. However, whereas the spring force (described above) varies linearly with the separation, the magnetic force varies according to an inverse relationship with the separation. The magnitude of the force exerted by the permanent magnet 27 as a function of the position of the printhead 4 is shown in FIG. 7, indicated by line M.

For example, in the embodiment described above, when the separation between the ferromagnetic element 25 and the permanent magnet 27 is around 1 mm, the force generated by the permanent magnet is around minus 40 N. The magnitude of the force generated by the permanent magnet gradually decreases to around minus 5 N at a separation of around 5 mm. However, unlike the change in spring force, the magnetic force does not vary linearly within this range, and varies according to a predetermined inverse relationship with the separation. It will be appreciated that the relationship between magnetic field strength and separation will depend upon many factors relating to materials and geometry, and may not correspond strictly to an inverse square relationship. Techniques such as finite element analysis may be used to model the magnetic field. Alternatively, physical prototypes may be used to allow measurements of the forces generated by the magnetic fields at certain gaps and distances to be made. Such models or measurements may then be used to modify design parameters as required in order to provide a controlled overall force.

In the absence of any additional forces, it will be appreciated that the force of the spring 28 acts to urge the printhead 4 towards the printing surface 11, and the force of the permanent magnet 27 acts to urge the printhead 4 away from the printing surface 11. Given that each of those forces acts on the printhead 4 and varies based upon the position of the printhead 4 in a different way (i.e. linearly vs. an inverse square relationship), at each position of the printhead 4 there will be a resultant force which depends upon the position. Such a resultant force is shown in FIG. 7 indicated by line R. It will be appreciated that the force indicated by line R is an algebraic sum of the forces M and S, each of which varies as described above.

Thus, when the separation between the ferromagnetic element 25 and the permanent magnet 27 is around 1 mm, the resultant force is around 0 N. The resultant force gradually increases to around +22 N at a separation of around 3 mm, +25 N at a separation of around 4 mm and +25 N at a separation of around 5 mm. It will be appreciated that the forces illustrated in FIG. 7 are static forces generated by each of the force generating components (i.e. the spring 28 and magnet 27) without taking into account reaction forces generated by other components of the printer and the environment in which it operates, or other properties of the system as a whole. As such, the forces illustrated are somewhat higher than may be exerted on the printing surface 11 during printing operations. For example, ribbon tension may cause the print force to be reduced. Similarly, the geometry of pivot 14, and friction between the printhead 4 and ribbon 2, may also cause the print force to vary (as described in more detail below with reference to FIG. 13).

Advantageously, the variation of the resulting print force with distance, as indicated by line R on the graph in FIG. 7, has a substantially flat portion between approximately 3 and 5 mm separation. This means that a substantially constant print force can be achieved over a range of separations between the permanent magnet 27 and the ferromagnetic element 25, which correspond to a useful range of the positions of the printing surface 11. This is important as it allows the printer to print consistently across a large range of printing installations, allowing for a reasonable amount (e.g. 2 mm) of variation in the distance between the printing surface 11 and the printer.

As can be seen from FIG. 7, at a small separation (i.e. less than 1 mm) between the permanent magnet 27 and the ferromagnetic element 25 (i.e. the first configuration illustrated in FIGS. 5*a* and 6*a*), the force generated by the permanent magnet 27 (which is at its largest) is sufficient to overcome the force generated by the spring 28, which acts in the opposite direction. Thus, when the separation is less than a certain value, the resultant force R acts in a direction to urge the printhead 4 away from the printing surface 11, further reducing the separation.

On the other hand, at a large separation between the permanent magnet 27 and the ferromagnetic element 25 (as illustrated in FIGS. 5*b* and 6*b*), the force generated by the permanent magnet 27 (which is at its smallest) is overcome by the force generated by the spring 28, which acts in the opposite direction. Thus, when the separation is greater than the certain value, the resultant force R acts in a direction to urge the printhead 4 towards from the printing surface 11, further increasing the separation.

It will be appreciated, therefore, that the resultant force acting on the printhead 4 in either of the first configuration (i.e. when spaced apart from with the printing surface 11, which is also referred to as a retracted position) or in the second configuration (i.e. when in contact with or close to the printing surface 11, which is also referred to as an extended position) is such that the printhead 4 is urged further towards that configuration, and is urged away from an equilibrium position (i.e. a position where the two opposing forces cancel one another out). The equilibrium position is identified by the point E in the graph of FIG. 7, and, in the illustrated example, corresponds to a separation between the permanent magnet 27 and the ferromagnetic element 25 of around 1 mm. Examples of possible first and second configuration distances are shown shaded in FIG. 7.

Such a balance of forces results in the printhead 4, once in the retracted or extended position, remaining in that position in a stable manner unless caused to move away from that position by an additional force. There are, therefore, two stable configurations for the printhead 4—the first configuration (the retracted position—as shown in FIG. 5*a*) and the second configuration (the extended position—as shown in FIG. 5*b*).

In operation, such an additional force can be provided by operation of the electromagnet 23. That is, the electromagnet 23 is arranged so as to be able to reinforce or counteract the force generated by the permanent magnet 27. When the coil 24 is energised so as to generate a magnetic field in a first direction the magnetic field causes the permanent magnet 27 to be further attracted to the electromagnet 23. However, when the coil 24 is energised so as to generate a magnetic field in a second direction the magnetic field causes the permanent magnet 27 to be less attracted to, or even repelled from the electromagnet 23. In this way, the printhead drive assembly 22 is able to modulate the forces on the printhead 4. The interaction of these forces generated by the electromagnet 23 and the forces generated by the permanent magnet 27 and the spring 28 will now be described in more detail.

FIG. 8*b* shows the printhead drive assembly 22 in the first configuration, and with the coil 24 of the electromagnet 23 energised so as to reinforce the force generated by the permanent magnet 27. The magnetic circuit is substantially as illustrated in FIG. 6*a*. However, a magnetic field M1" is established which is stronger than that in FIG. 6*a*, with contributions from both the permanent magnet 27 and the electromagnet 23 which reinforce one another. Thus, the magnetic fields generated by the permanent magnet 27 and the electromagnet 23 reinforce one another, resulting in an attractive force being created between the first and second components of the printhead drive assembly 22, acting on the target 26 (and the printhead—not shown—which is attached to the target) in the direction D.

FIG. 8*a*, on the other hand, which also shows the printhead drive assembly 22 in the first configuration, shows the coil 24 of the electromagnet 23 energised so as to counteract the force generated by the permanent magnet 27. The magnetic circuit is altered with respect to that illustrated in FIGS. 6*a* and 8*a*. In particular, a first magnetic field M2 is established within the electromagnet 23, and a second, opposing, magnetic field is established in the permanent magnet 27 and target 26. As can be seen, opposing north poles are created at either sides of the gap g2, with opposing south poles created at either sides of the gap g1. Thus, the magnetic fields generated by the permanent magnet 27 and the electromagnet 23 oppose one another, resulting in a repulsive force being created between the first and second components of the printhead drive assembly 22, acting on the target 26 (and the printhead—not shown—which is attached to the target 26) in the direction C.

The strength of the magnetic field generated by the electromagnet 23 is, to an approximation, linearly related to the current flowing through the coil 24. As such, it is possible to accurately control the magnitude of the magnetic field strength, and thus the strength of the magnetic force, by controlling the magnitude of the current flowing through the coil 24 according to a predetermined relationship. Further, the direction of the magnetic field generated also corresponds to the direction of current flowing through the coil 24, allowing directional control to be achieved. It will be appreciated that many electromagnets which are used in conjunction with a soft magnetic element allow only magnetic attraction. That is, a magnetic field in either direction causes temporary magnetisation of the ferromagnetic element such that an attraction occurs. However, the use of a permanent magnet allows both attractive and repulsive forces to be generated, allowing far greater control of the forces applied to the printhead 4.

As will be appreciated from the description of the resultant force above (as illustrated by the line R in FIG. 7), if the attractive or repulsive force generated by the electromagnet 23 is sufficient to cause the printhead 4 to move to a location beyond the equilibrium point (starting from whichever of the first and second configurations was the starting point), when the current applied to the electromagnet 23 is removed, the printhead 4 will move to the other one of the first and second configurations from the starting point. Thus, all that is required from the electromagnet 23 in order to move the printhead 4 from one configuration to the other configuration is for a force to be generated of sufficient strength, and for sufficient duration, for the printhead 4 to move past the equilibrium point E. After that, even if the electromagnet 23 is de-energised, the forces generated by the spring 28 or permanent magnet 27 will cause the printhead 4 to continue moving until it reaches the first or second configuration.

Considering FIG. 9, in which the line R shows the resultant force shown in FIG. 7, the line RP shows a resultant force which is generated by the combination of the spring 28, the permanent magnet 27 and the electromagnet 23, when the coil 24 is energised with a current of three amps in a positive sense (+3 A). It can be seen that the line RP is a shifted version of the line R—the shift being a result of the additional force generated by the electromagnet 23 in the direction C (as indicated in FIGS. 5 to 8). Thus, it will be appreciated that, whatever the position of the printhead 4, if a current of plus three amps is caused to flow in the coil 24, the resultant force will be in the direction C, and will cause the printhead 4 to be urged towards the printing surface 11.

As can be seen in FIG. 9, when a current of plus three amps is caused to flow in the coil 24, and when the separation between the ferromagnetic element 25 and the permanent magnet 27 is around 1 mm, the resultant force is around +27 N. The resultant with positive energisation (RP) peaks at around +35 N at a separation of around 3 mm before falling slightly to a force of around +32 N at a separation of around 5 mm.

On the other hand, a line RN shows a resultant force which is generated by the combination of the spring 28, the permanent magnet 27 and the electromagnet 23, when the coil 24 is energised with a current of three amps in a negative sense (−3 A). It can be seen that the line REN is a shifted version of the line R—the shift being a result of the additional force generated by the electromagnet 23 in a direction D (as indicated in FIGS. 5 to 8).

Thus, when a current of minus three amps is caused to flow in the coil 24, and when the separation between the ferromagnetic element 25 and the permanent magnet 27 is around 1 mm, the resultant force RN is around −27 N. The resultant with negative energisation (RN) drops to around 0 N at a separation of around 2 mm before rising to a force of around +18 N at a separation of around 5 mm.

Thus, it will be appreciated from the forces illustrated in FIG. 9 that, provided the range of separation is maintained below around 2 millimetres, whatever the position of the printhead 4, if a current of minus three amps is caused to flow in the coil 24, the resultant force will be in the direction D, and will be sufficient to cause the printhead 4 to be urged away from the printing surface 11 (i.e. to retract the printhead back to its first configuration). It will be appreciated (although not shown in the graph of FIG. 9) that to retract the printhead 4 from separation distances of greater than 2 mm will require a higher negative current then 3 amps. For example, a current of around −6 A may be used to retract the printhead 4 from a separation distance of around 4 mm.

It will further be appreciated that the forces involved and required current levels will depend upon a particular configuration (e.g. separation distances, spring constants, number of turn in the windings of the electromagnet, magnetic characteristics of each component in the magnetic circuit etc.), and may be altered accordingly.

In this way, and provided the separation is maintained within a standard range of operation (e.g. between 2 mm and 4 mm), irrespective of the position of the printhead 4, the printhead 4 can be caused to move between the first configuration and the second configuration as required.

It will be appreciated that the standard range of operation can be controlled so as to ensure correct operation for a particular arrangement, and combination of spring strength, magnetic force, and current level. Thus, while the allowable range of operation is around 2 mm (i.e. between separations of 2 and 4 mm) in the illustrated example, this range can be increased (or reduced) as required for a particular application. Similarly, the equilibrium point (in this case, a separation of around 1 mm) can be varied as required by appropriate design choices.

Moreover, whereas the forces generated by the permanent magnet 27 and spring 28 are always applied (and vary based upon the position of the printhead 4), forces are only required to be generated by the electromagnet 23 for brief periods to achieve printhead 4 control. As such, only short pulses of current are required to be supplied to the coil 24 of the electromagnet 23 when movement is required, allowing the electromagnet 23 to remain cool in operation. As described in more detail below with reference to FIGS. 10 to 12, pulses of current may be required to be supplied to the coil 24 of the electromagnet 23 for a duration which is short when compared to the duration of a printing cycle, (e.g. 15 milliseconds) each printing cycle including a printing phase during which ink is being transferred to a substrate, and a further non-printing phase during which the apparatus is prepared for the printing phase of the next cycle.

That is, where an electromagnet (e.g. a solenoid) is used to cause movement in a mechanical system, it is common for such an electromagnet to remain energised for extended periods of time, resulting in significant heat being generated in the coils. Such heat can be detrimental to the continued reliable operation of the system concerned and is thus disadvantageous. However, the above described arrangement makes use of the interaction between magnetic and spring forces to bias the printhead in a bi-stable manner such that only short pulses of magnetic force are required to be generated by the electromagnet for actuation. This enables the printhead drive assembly to operate 'cold', in that the electromagnet does not need to be continuously energised when the printhead is in one of the two stable configurations.

Moreover, a reliable and predictable printing force can be generated by appropriate selection of the spring 28. That is, once the printhead 4 has been caused to move from the retracted position to the extended position (by a short pulse of current being applied to the coil 24 of the electromagnet 23, as described above), the spring 28 will cause the printhead 4 to be urged towards, and therefore pressed against, the printing surface 11 by a force which depends upon the relative position of the printhead 4 and the ferromagnetic element 25. That is, the spring force depends solely upon the degree of extension or compression of the spring 28, while any counter force generated by the permanent magnet 27 (which will exert a relatively small attractive force on the ferromagnetic element 25) is also predictable. Thus, the printer 1 can be operated to carry out printing operations with a constant print force being generated by the spring 28, with no current being required to be applied to the coil 24.

Such printing operations may be performed while the printhead carriage 13 is held stationary with respect to the printer body (i.e. continuous printing), or while the printhead carriage 13 is caused to move with respect to the printer body (i.e. intermittent printing).

Then, when printing operations have been completed (i.e. after an image has been printed) the printhead 4 is retracted by the application of a pulse of current to the coil 24, which causes an attractive force to be generated between the electromagnet 23 and the permanent magnet 27 which is sufficient to overcome the force of the spring 28. The printhead 4 is thus moved from the second configuration (i.e. the extended position) to the first configuration (i.e. the retracted position).

FIG. 10 shows an example current and force waveform, which illustrates the use of a current pulse applied to the electromagnet 23 to cause printhead movement as described above. The horizontal axis shows time, with the full range shown covering a duration of 200 ms. The vertical axis shows voltages which are indicative of either force or current, as indicated by lines F and I respectively. In particular, the line F represents the force applied by the printhead 4 to the printing surface 11. The line I represents the current applied to the electromagnet 23. The illustrated data was obtained during test printing operations, with the force data obtained by a load cell arranged to take the place of a printing surface.

In the example illustrated in FIG. 10, at time t0 the current is zero and the printhead is in the first configuration so the printing force is also effectively zero (although there is some noise visible). At time t1 a current is applied to the coil 24 in a positive direction, with the current I showing an increase immediately thereafter, the current gradually rising to a peak level. It will be appreciated that the inductive nature of the coil 24 restricts the rate at which the current can rise. Shortly after the current is applied to the coil 24, at time t2, the printing force F rises from zero. The printing force F at first overshoots, then gradually stabilizes at level which approximately corresponds to a force of around 1.2 kgf. At a time t3, shortly after t2, the current pulse is turned off, with the current level I in the coil 24 returning to zero. The positive current is applied for a total duration of around 15 milliseconds (i.e. between times t1 and t3). It will be appreciated that once the current is applied to the coil 24 at time t1 a repulsive magnetic force is a generated between the electromagnet 23 and the permanent magnet 27 which urges the printhead 4 towards the second configuration. Thus, once that force is sufficient to reverse the magnetisation of the ferromagnetic element 25 caused by the permanent magnet 27, the printhead 4 is caused to move towards the second configuration. Once the printhead 4 comes into contact with the printing surface 11 (and, in this case, the load cell) the printing force F rises, and movement of the printhead 4 in the direction perpendicular to the printing surface 11 ceases.

Then, for a period of time, the printing force F remains substantially stable at 1.2 kgf, while the current I remains at zero. This period is when printing operations are performed. In intermittent printing, during this period the printhead carriage 13 is moved along the linear track 15 causing the printhead 4 to move along the printing surface 11, so as to perform a printing stroke.

The printing force F continues at around 1.2 kgf until time t4, when a negative current pulse is applied to the coil 24. Again the current magnitude rises gradually to a peak level. As this current increases, an attractive force is generated between the electromagnet 23 and the permanent magnet 27 which urges the printhead 4 away from the extended position (i.e. towards the retracted position). Once that force is sufficient to overcome the force of the spring 28, the printhead 4 is caused to move towards the retracted position. Such movement continues until the permanent magnet 27 makes contact with the bumper 29, after which movement of the printhead 4 in the direction perpendicular to the printing surface 11 ceases. Once the printhead 4 loses contact with the printing surface 11 (or, in this case the force plate) the measured printing force F falls rapidly. Thus, at a time t5, shortly after the onset of current at t4, the printing force rapidly falls away. In the illustrated example, a force is applied for a total duration of around 110 ms, of which around 90 ms corresponds to a desired printing force of around 1.2 kgf.

The negative current is then removed at time t6, after which the current I returns to zero, and the printing force F remains at zero. The negative current is applied for a total duration of around 15 ms (i.e. between times t4 and t6).

It is noted that prior to the application of current in the negative direction (at time t4), some oscillation in the printing force is observed. This is a result in the printing stroke being completed, and the printhead 4 ceasing to move along the printing surface 11.

It is further noted that the rise of current in both the positive and negative directions, after times t1 and t4, a dip in the current is visible, as indicated by t1' and t4' respectively. These dips correspond to the point at which the printhead 4 makes contact with the printing surface (t1'), and the point at which the permanent magnet 27 makes contact with the bumper 29 (t4'). In each case, the mechanical impact and change in the forces experienced by printhead drive assembly 22 cause a change in the electrical impedance seen by the circuit driving current into the coil 24. This effect may be considered to be similar in nature to a back electromotive force (back-EMF) signal which can be observed in motor operation.

In particular, back-EMF may refer to a voltage induced in a conductor (i.e. the coil 24) which moves relative to a magnetic field (or, equally, when a magnetic field moves relative to a conductor). The induced voltage may be proportional to a rate of change of magnetic flux, which in turn corresponds to the rate of change of position of the permanent magnet 27. The voltage generated across the coil 24 by the movement of the permanent magnet 27 appears across the coil 24 such that it counteracts the drive voltage applied to the coil 24. It will be understood that when the permanent magnet is suddenly decelerated (for example when the printhead 4 makes contact with the printing surface 11) there is a sudden change in back-EMF. Depending on the nature of the drive electronics used to energise the coil 24, this change in back—EMF may, for example, be detectable as either a dip in the current drawn by the coil 24, or an increase in the voltage across the coil 24, or both.

FIG. 11 shows in more detail the current and force waveforms around the t1' dip. The horizontal axis shows time, with the full range shown covering a duration of 100 ms. The vertical axis again shows voltages which are indicative of either force or current, as indicated by lines F and I respectively. It can be seen that the dip generally corresponds to the point at which the printing force increases rapidly at time t2.

Such observable current characteristics can be used to improve operation of the printhead drive assembly 22. For example the dip t1' referred to above can be used to identify the point in time at which the printhead 4 makes contact with the printing surface 11, and thus allows the current pulse causing that movement to be terminated. Such feedback can be of particular use where a load cell (or other sensor) is not provided on the printing surface 11.

Similarly, the dip t4' referred to above can be used to identify the point in time at which the permanent magnet 27 makes contact with the bumper 29, and thus allows the current pulse causing that movement to be terminated. The rise of force at around time t2 occurs approximately 8 ms after the application of current at time t1. The current then begins to fall rapidly around 6 ms after the rise of force rise at around time t2. It can be seen that the print force stabilises around 20 ms after it first begins to rise at time t2.

In some embodiments, the current flowing within the coil 24 can provide useful information regarding unexpected events, or errors in operation. For example, any unexpected movement of the printhead 4 during operation (e.g. due to impact with a foreign object) could cause a back-EMF signal to be generated, which could be detected by appropriate monitoring of the current flowing within the coil 24 regardless of whether or not the coil 24 was energised.

More generally, it will be appreciated that the actual current flowing within the coil 24 can provide useful information regarding the system configuration and operation, with it being possible for subsequent control to be performed based upon that information.

In one such form of subsequent control, the time at which a characteristic back-EMF signal is observed during a first printhead movement can be used to modify the control signals for during a second, subsequent, printhead movement.

In more detail, it will be understood that, as described in detail above, the movement of the printhead towards and away from the printing surface is caused by the combination of forces generated by the permanent magnet 27, electromagnet 23 and spring 28. In particular, movement from one stable position towards the other stable position is caused by a current flowing in the electromagnet, causing a force imbalance to be generated and the printhead position to change.

However, it will also be appreciated that these forces are not generated immediately upon the application of a voltage across terminals of the electromagnet. Rather, it is well known that the current flowing in the electromagnet (which has a predetermined inductance) will rise in dependence upon the magnitude of the applied voltage, the inductance and the resistance. In particular, in a circuit in which a resistance is placed in series with an inductor, the current flowing in the inductor as a function of time from the application of a voltage (assuming no current flows at time zero) can be calculated as follows:

$$I(t) = \frac{V}{R}[1 - e^{-Rt/L}]$$

where:

I(t) is the current flowing in the inductor as a function of time

V is the applied voltage

R is the resistance of the resistor t is the time; and

L is the inductance of the inductor.

Thus, assuming that the force generated by the electromagnet varies in proportion to the current flowing in the electromagnet, when the electromagnet is energised, the force generated will rise according to an exponential relationship having a time constant L/R. Of course, it will be understood that where a PWM drive signal is used to drive the inductive coil, the current characteristic may be a function of the duty cycle of the applied waveform as well as the applied voltage.

During this rise in force, the force will at first rise quickly, and then more slowly as the maximum current/force is approached. At some point during this rise, the force generated by the electromagnet will be sufficiently large to overcome the opposing forces of the permanent magnet or spring, causing the printhead to move from whichever of the stable positions it is in. This force level may be referred to as an operational force.

So as to provide for a degree of insensitivity to external disturbances, it may be desirable to configure the printhead drive assembly such that the operational force is achieved during the relatively flat region of the current/force curve described above. As such, it will be understood that the precise time after the initial application of a voltage at which the operational force is achieved, may vary from one operation to the next. However, in general terms, the minimum operational force will be attained at approximately the same time after the application of voltage during similar printing operations.

In addition to the current rise described above, the actual current observed during an operation of the printhead drive assembly will be modified by back-EMF signals caused during the actuation of the printhead drive assembly.

FIG. 13 shows the measured current during a printing operation. In the example illustrated in FIG. 13, electromagnet current is indicated by a current line 40, while the measured printing force is indicated the by the force line 41. Details of the printing operation are generally similar to those described above with reference to FIG. 10, and will not, therefore, be described in detail here. It is noted, however, that the current signals shown in FIG. 13 have an opposite direction to those in FIG. 10. A printhead retraction pulse 42 can be seen in FIG. 13, and is discussed in more detail with reference to FIG. 14.

In particular, FIG. 14 shows the force and current waveforms 40, 41, from the pulse 42 in more detail. As can be seen at time t20 the current begins to increase from zero. It can be observed that the current shows evidence of the pulse width modulated (PWM) switching at which is used to obtain a desired current level in the inductive electromagnet coil. The PWM switching is carried out at a frequency of around 10 kHz.

However, the general shape of current increase can be seen (ignoring the high frequency switching waveform).

It will be observed that at time t21, approximately 2 ms after the start of current increase, the printing force begins to decrease. It can be understood that as soon as the electromagnet begins to generate a magnetic force, this will begin to reduce the force applied by the printhead on the printing surface, even if the resultant force is still pushing the printhead towards the printing surface. Thus from the time t21 to a time t22, the printing force gradually decreases, until it is approximately zero. At that time (i.e. t22), the printhead begins to lose contact with the printing surface.

It can also be observed that at around time t22, the magnitude of the current waveform 40 ceases to increase, and begins to decrease in magnitude. This can be understood to be a result of the back-EMF generated by the movement of the printhead 4 (and associated printhead drive assembly components) in the magnetic field generated by the electromagnet 23.

Further, at a time t23, which is approximately 1.5 ms after the time t22, the current waveform 40 gradient exhibits an abrupt reversal, such that the magnitude of the current waveform 40 ceases to decrease, and begins to increase in magnitude once again. This time (i.e. t23) is understood to correspond to point at which the moveable printhead drive assembly components (i.e. permanent magnet 27, target 26) come into contact with the bumper 29, and abruptly stop their movement.

After time t23, the current continues to rise for a short time until time t24, at which point the electromagnet current is switched off abruptly. It will be understood that immediately after the time t23, the moveable printhead drive assembly components may rebound from the contact with the bumper 29, causing yet further deviation in the current waveforms from that which would be observed if the current of the electromagnet was observed in isolation.

Thus, from the above discussion of the monitored current waveforms, it can be understood that waveform exhibits characteristic features (caused by the interaction of the back-EMF originating signals, and the inductive currents) during the actuation of the printhead drive assembly. Moreover, as discussed in more detail below, it is possible to finely tune the control of the printhead drive assembly during subsequent printing operations, by modifying the magnitude and timing of the applied voltage, so as to influence the printing movement.

For example, it will be appreciated that the duration of printhead drive pulse (whether to move the printhead 'in' or 'out'), can be selected. Such a selection is made based upon the desired time at which printhead movement takes place, and the time taken for the force to rise to the operational level. Of course, some contingency may also be included, such that even if a printhead begins to move later than expected, the printhead will still complete the intended movement before the current pulse is removed.

That is, given the known electrical response characteristics of the electromagnet, the printhead drive pulses are applied at a predetermined time prior to the intended time at which the printhead will begin to move. Moreover, the amplitude of the applied pulse is selected so as to provide the required force at the appropriate time. For example, in the example illustrated in FIGS. 13 and 14, the printhead begins to move during the relatively flat part of the current characteristic, approximately 12 ms after the onset of the current pulse.

However, it will be understood that by increasing the voltage applied to the electromagnet, it will be possible to increase the rate at which this critical force is established, thus causing printhead movement to occur at a shorter time after the voltage is applied. Conversely, by reducing the voltage applied to the electromagnet, it will be possible to decrease the rate at which this critical force is established, thus causing printhead movement to occur at a greater time after the voltage is applied.

During operation of the printing the current may be monitored. If, during such monitoring, characteristic features associated with printhead movement are identified, it can be determined if the printhead began to move at the predetermined time, prior to that time, or after that time.

Then, in a subsequent operation, the current applied to the electromagnet can be modified (i.e. increased or decreased) so as to attempt to cause the printing movement to occur at the predetermined time (or closer thereto). In this way, the detection of characteristic features associated with printhead movement can be used to provide feedback, such that the printer operation is modified, and such that intended operational performance can be achieved more readily.

It will be understood that this process may not be exact. That is, rather the movement time being based solely upon the current flowing in the electromagnet, any number of external noise sources are also present (e.g. vibrations, possibly variable distance between printer and printing surface, temperature variation, mechanical wear, etc.). Thus, rather than a single predetermined time at which movement should begin, in some embodiments a range of acceptable movement times are possible (e.g. a lower bound and an upper bound).

Similarly, the precise point at which movement begins (i.e. time t22) may be difficult to detect, given the noisy signal trace, and subtle change in current level. However, it will be appreciated that other characteristic points may also be used, such as, for example the abrupt change in gradient of current at time t23, which may be known, from empirical studies for a particularly printer arrangement, to occur at a fixed time after the time t22.

However, it will be appreciated that it is not essential that a particular point in time and associated current characteristic are attributed to particular printhead movements. In general terms, it will be understood that, empirically, it is possible to identify a current characteristic, and a range of timings for that characteristic which correspond to acceptable printing behaviour, and a range of drive current waveforms that lead to such acceptable behaviour.

In general terms, it will be understood that if the drive current it too low, the printhead movement may be too late, resulting in poorly coordinated printing. Conversely, if the drive current it too high, the printing movement may be too soon, and the printhead may move more quickly between the stable positions, risking mechanical wear and damage.

It will of course, be appreciated that whereas the above described embodiment allows the drive current waveform to become substantially flat before movement occurs, other arrangements are possible.

For example, if more rapid operation is required, a higher current level could be used, which resulted in the operating force being generated during the period when the current level was rising steeply. In such an embodiment, the detectable back-EMF characteristic associated with printhead movement may vary from that described above. However, some features characteristic of printhead movement may still be identifiable.

It will, of course, be understood that the level of current provided to the electromagnet is an engineering design choice, with a compromise between power supply requirements, electromagnet geometry, speed of operation, reliability and maintenance performance, amongst many parameters.

Thus, upon initialisation of the printer, during a first printing operation a predetermined power level may be selected, the predetermined power level being selected so as to exceed any likely power level required during routine operation. Then, during the first operation, the timing of the movement signal will be monitored, and the power level to be applied during the second operation modified accordingly. The power level selected may eventually settle at a stable level. The rate at which this settling occurs may depend upon the magnitude of changes applied at each step. However, it may be convenient for stable operation to have been established after around ten printing operations. Of course, during 'stable' operation, minor adjustments may be made to the applied power level as required. In this way, feedback is used to continually adjust the power level in operation.

Furthermore, it will be understood that a particular operational parameter or configuration may vary during continued operation of a printer. For example, where a printer operates in a pull-drag configuration (i.e. with ribbon being pulled through a tape path by a single drive means, while a resistive force is applied to the supply spool), the resistive force applied to the supply spool may vary between the beginning of a reel of ribbon (where the radius of the supply spool is large), and the end of a spool (where the radius of the supply spool is relatively small). In such an arrangement, it is possible that ribbon tension increases by a factor of, for example, 2-3 during the use of a single reel or ribbon.

Of course, it will be understood that when the printhead is driven out (i.e. towards the printing surface), it will be required to overcome any tension in the ribbon (in addition to the electromagnet and spring being required to overcome the forces of the permanent magnet). As such, during the operation of such a printer, the force required to perform printhead movement may change gradually during continued operation.

In one such example of printer operation, the current level applied to the electromagnet is provided with a value indicative of magnitude having arbitrary units. Assuming that a printer is initialised for operation having a full reel (e.g. 250 m) of ribbon, during a first printing operation, a current level of 2500 (arbitrary units) may be applied to cause a printhead out movement, and may be expected to result in the printhead moving more quickly (and forcefully) than is required. It will be understood that during the first several printing operations, the current level will be modified, so as to cause the printhead movement to occur within the predetermined time period. During such operations, after 10 printing operations, the stable value associated with the current level may be expected to be around 800 (arbitrary units). The current level of 800 (i.e. approximately one third of the maximum value) may represent a low 'normal' value in operation when the reel is almost full.

While it will be understood that actual current levels will depend upon many design factors, in some embodiments a printhead out current value $I_{PH_OUT}$ of 2500 corresponds to an actual current value of approximately 5 amps, while a printhead out current value $I_{PH_OUT}$ of 800 corresponds to an actual current value of approximately 1.6 amps.

Of course, a printer may be started and stopped without a full reel of ribbon. Thus during a printing operation in which the printer in initialised when the reel of ribbon is approximately half used, during a first printing operation, a printhead out current value $I_{PH_OUT}$ of 2500 may be applied. Then, during the first several printing operations, the current level will be modified, so as to cause the printhead movement to occur within the predetermined time period. During such operations, after 10 printing operations, the printhead out current value $I_{PH_OUT}$ may be expected to be around 1300 (where there is half a reel of ribbon).

Similarly, during a printing operation in which the printer in initialised when the reel of ribbon is almost entirely used, during a first printing operation, a printhead out current value $I_{PH_OUT}$ of 2500 may still be applied. Then, during the first several printing operations, the current level will be modified, so as to cause the printhead movement to occur within the predetermined time period. During such operations, after 10 printing operations, the printhead out current value $I_{PH_OUT}$ may be expected to be around 1800 (where there is almost no half ribbon remaining on a reel). Thus, whereas a default high level of current is used immediately after initialisation, this parameter is adjusted rapidly to a current level appropriate for the particular printer configuration.

It will be understood that the ribbon tension level may have an effect on the current level required for printhead in movement, although this is would likely to be of a significantly smaller magnitude than the effect described above with reference to the printhead out movement.

Various other operating variables may also have an effect on the current level required for printhead movement. One such operating variable is the platen gap, which corresponds to the distance moved by the printhead 4 during before and after each printing operation. Whereas a nominal platen gap may be specified as 2 mm, minimum and maximum values of 1.5 and 2.5 mm respectively may be used. Thus, in use, a printer may be configured to have a platen gap between 1.5 and 2.5 mm. Of course, when the printhead 4 is driven out (i.e. into contact with the printing surface 11) it need only be driven until the equilibrium point is reached, after which the spring force dominates the force of the permanent magnet, and the electromagnet is no longer required to contribute to the printhead movement. However, during printhead retraction, the exact platen gap may affect the force required. That is, considering the force levels described above with reference to FIG. 9, while the resultant characteristic (RN) is relatively flat, there is still some deviation in force required to retract the printhead across an expected operating range.

Thus, the stable current level required to retract the printhead during operation with a 1.5 mm gap may correspond to a printhead in current value $I_{PH\text{-}IN}$ of around 1100, whereas the stable current level observed during operation with a 2.5 mm gap may correspond to a printhead in current value $I_{PH\text{-}IN}$ of around 1900. That is, for a larger platen gap, a higher current level may be required.

Thus, while a single default high level of current (e.g. 2500) may be used immediately after initialisation for both printhead in and printhead out movements, this level is adjusted rapidly during operation to current levels appropriate for the printer configuration.

Indeed, it will be understood that the use of a default high level of current immediately after initialisation and subsequent refinement based upon monitored feedback signals allows correct operation to be established rapidly regardless of ribbon state and platen distance, as well as other operating variables (some or all of which parameters may not be known to the printer controller 50).

Further, the current level required to move the printhead out may depend upon one set of parameters (e.g. the amount of ribbon remaining on a reel), while the current level required to move the printhead in may depend upon a different (possibly overlapping) set of parameters (e.g. platen distance). Thus, the current level required for printhead in (retraction) is likely to be different to that required for printhead out (extension) in most operating circumstances. Both values may have different default values, different acceptable timing periods, different trends during continued operation, and may thus use different optimisation routines.

From the discussion of the waveforms shown in FIG. 14 above, it will be understood that the printhead 4 is moving between times t22 and t23, which movement or 'flight time' has a duration of approximately 2 ms. It will also be appreciated that while this primary movement is abruptly terminated at time t23 (although some rebound may follow), the start of movement is more gradual. Indeed, it may be difficult to accurately determine the precise moment in time at which the printhead starts to move (even with the assistance of a load cell, which will not be present in most operational configurations). Thus, given the effect of the printhead movement on the current waveform even after the primary movement has ceased (e.g. during the period after t23), it will be understood that the current waveform for a full printing operation may be required to be overserved to properly understand the effect of the back-EMF on the current waveform, or to identify characteristic waveform features.

Thus, performing any form of control of the printhead movement based upon characteristics detected during same printing operation may be difficult. For example, while it is described above that it may be desirable to provide a reverse current to the electromagnet 23 prior to impact, it would not only be difficult to detect a movement until it had ended (i.e. by detecting the impact point t23), but given the inductive nature of the coil, it would be difficult to cause a significant reverse current to flow sufficiently quickly to have a material effect.

However, by using the techniques described above, it is possible to adjust the current levels based upon monitored parameters over one or more printing operations to have a desirable operating characteristic based upon timing and measured peak force. For example while the current level may be adjusted during operation based upon monitored timings, tuning parameters (e.g. how current level adjustments are made based upon monitored timings, default current levels etc.) may be determined during a calibration phase for a particular type of printer.

It is noted, however, that current levels should be reduced with caution, given that the possible result of providing a pulse which has insufficient power (or duration) to cause printhead movement could be extremely detrimental to printing operation (i.e. a printhead may fail to complete an expected 'in' or 'out' movement, possibly leading to poor quality printing, missing printing, and/or printer component damage.

Conversely, current levels may be increased with far less caution, given that the possible result of providing a pulse which has too much power is that the printhead moves more quickly than is optimal, and impact between printer components exceeds an optimal range. While some increased wear and tear may be expected, it is unlikely that damage will occur within a short time scale (provided a safe maximum threshold is not exceeded). It will be understood, however, that if excess drive current levels are maintained for an extended period of time, mechanical damage (i.e. accelerated wear) may occur.

FIG. 15 provides a flow diagram illustrating an example of processing carried out by the printer controller 50 to perform a control technique described in general terms above. At step S1, the printer is initialised (e.g. after being powered up). Processing then passes to step S2, where the value of current (which is indicative of current magnitude) for printhead out pulses $I_{PH\text{-}OUT}$ and printhead in pulses $I_{PH\text{-}IN}$ are set to default values of 2500 (arbitrary units).

Processing then passes to step S3 (assuming that a print instruction has been received) where the controller 50 causes the printhead 4 to be driven out towards the printing surface 11 by the printhead drive assembly 22. During this movement, the current flowing within the electromagnet 23 is monitored. The current may be monitored in any convenient way, such as by monitoring a voltage developed across a small value resistor placed in series with the electromagnet 23.

Processing then passes to step S4 where, based upon the monitored current, a printhead out movement time $T_{OUT}$ is determined. Such a determination may be based upon the identification of a characteristic within the current waveform, for example as described above with reference to FIG. 14 (with the necessary changes made to modify the process for a printhead out movement, rather than a printhead in movement).

Of course, the waveform shape may differ for each of the printhead out and printhead in operations. However, for each successive 'in' or 'out' operation, the current waveform is expected to have a substantially similar form, allowing characteristic points to be identified. Such identification may be carried out empirically, for example by carrying out operations while capturing images of the printhead movement with a high-speed camera, allowing correspondence between particular current waveform characteristics and physical movements to be established.

For example, a point in time which is in some way indicative of the moment the printhead begins to move may be determined based upon the monitored current. The printhead out movement time $T_{OUT}$ may then be determined to be the time after the application of the current pulse that the printhead began to move. Of course, different reference points may be selected as required.

Once the printhead out movement time $T_{OUT}$ has been determined, processing passes to step S5, where the printhead out movement time is compared to a minimum acceptable threshold value $T_{OUT\text{-}MIN}$. If the printhead out movement time $T_{OUT}$ is above the minimum acceptable threshold value $T_{OUT\text{-}MIN}$, processing passes to step S6, where the printhead out movement time $T_{OUT}$ is compared to a maximum acceptable threshold value $T_{OUT\text{-}MAX}$. If the printhead out movement time $T_{OUT}$ is below the maximum acceptable threshold value $T_{OUT\text{-}MAX}$ (and also above the minimum acceptable threshold value $T_{OUT\text{-}MIN}$), the printhead out movement time $T_{OUT}$ is considered to be within an acceptable range, and processing passes to step S7.

At step S5, if the printhead out movement time $T_{OUT}$ is below the minimum acceptable threshold value $T_{OUT\text{-}MIN}$, processing passes to step S8, where the stored printhead out current value $I_{PH\text{-}OUT}$ is reduced (so as to cause the printhead to move more slowly in subsequent printing operations). Processing then passes to step S7.

At step S6, if the printhead out movement time is above the maximum acceptable threshold value $T_{OUT\text{-}MAX}$, processing passes to step S9, where the printhead out current value $I_{PH\text{-}OUT}$ is increased (so as to cause the printhead to move more quickly in subsequent printing operations). Processing then passes to step S7.

Thus, the processing of steps S5 and S6 allows a comparison to be made between the printhead out movement time $T_{OUT}$ and a reference range ($T_{OUT-MIN}$ to $T_{OUT-Max}$). If the printhead out movement time falls outside the reference range, a suitable adjustment is made to the printhead out current value $I_{PH-OUT}$ in on of steps S8 or S9.

It will, however, be appreciated that this processing may be carried out in any convenient way. For example, the printhead out movement time $T_{OUT}$ may be compared to a single reference value, with adjustments made based upon the difference (positive or negative) from that reference value. Similarly, the adjustments made to head out pulse value may be carried out in any convenient way. For example the size of any adjustment may be in some way based upon the difference between the printhead out movement time $T_{OUT}$ and the reference range (or value). Alternatively, a fixed adjustment may be made (e.g. +/−100) each time the processing of one of steps S8 or S9 is carried out. Further still, the adjustment made may be based upon data relating to more than one printing operation (e.g. based upon an average error value, or cumulative error value), and/or may take into account previous adjustments made. In some embodiments a form of PID control may be implemented.

As step S7 (once the current printing operation has been completed), the controller 50 causes the printhead 4 to be driven 'in', away from the printing surface 11, by the printhead drive assembly 22. During this movement, the current flowing within the electromagnet 23 is again monitored.

Processing then passes to step S10 where, based upon the monitored current, a printhead in movement in time $T_{IN}$ is determined. Such a determination may be based upon the identification of a characteristic within the current waveform, for example as described above with reference to FIG. 14. For example, the printhead in movement time $T_{IN}$ may be determined to be the time after the application of the current pulse at time t20 that the printhead began to move (i.e. time t21).

Once the printhead in movement time $T_{IN}$ has been determined, processing passes to step S11, where the printhead in movement time $T_{IN}$ is compared to a minimum acceptable threshold value $T_{IN-MIN}$. If the printhead in movement time $T_{IN}$ is above the minimum acceptable threshold value $T_{IN-MIN}$, processing passes to step S12, where the printhead in movement time $T_{IN}$ is compared to a maximum acceptable threshold value $T_{IN-MAX}$. If the printhead in movement time $T_{IN}$ is below the maximum acceptable threshold value $T_{IN-MAX}$ (and also above the minimum acceptable threshold value $T_{IN-MIN}$), the printhead in movement time $T_{IN}$ is considered to be within an acceptable range, and processing returns to step S3, where a new printing operation can begin (at an appropriate time).

Returning to step S11, if the printhead in movement time $T_{IN}$ is below the minimum acceptable threshold value $T_{IN-MIN}$, processing passes to step S13, where the printhead in current value $I_{PH-IN}$ is reduced (so as to cause the printhead to move more slowly in subsequent printing operations). Processing then returns to step S3, where a new printing operation can begin.

At step S14, if the printhead in movement time $T_{IN}$ is above the maximum acceptable threshold value $T_{IN_MAX}$, processing passes to step S9, where the printhead in current value $I_{PH-IN}$ is increased (so as to cause the printhead to move more quickly in subsequent printing operations). Processing then returns to step S3, where a new printing operation can begin.

Thus, in a second (or further subsequent) printing operation, the printhead in and out current values $I_{PH-IN}$, $I_{PH_OUT}$ are modified, allowing printing performance to be adjusted during use so as to achieve a desirable timing characteristic.

It will, of course, be appreciated that the examples described above are provided for illustration only, and are not intended to be limiting. Indeed, many alternatives arrangements and modifications to the above described printer are possible.

For example, while it is described that a coil spring is provided between the target 26 and the ferromagnetic element, any form of biasing element may be used to provide this function. Such a biasing element may take any appropriate form (e.g. a leaf spring, or tension spring mounted in a different location). Furthermore, a biasing force may be provided by an entirely different mechanism. For example, a separate magnetic element may be provided which is associated with the printhead support arm 21, and which provides a force which acts in a direction opposite that provided by the permanent magnet 27 and ferromagnetic element 25.

Further still, while a spring is included in the above described embodiment, in some embodiments a biasing element may be omitted entirely. In such embodiments, the printhead may be attracted away from the printing surface by the operation of a permanent magnet (as described above), and may be urged towards the printing surface, when required, by the action of the electromagnet when energised in the appropriate direction. Thus printhead in/out movement and positional control can be accomplished without the need for any mechanical biasing element. In such an arrangement, the magnitude of the force exerted on the printing surface by the printhead is controlled by the strength of the magnetic field generated by the electromagnet (which is related to the current applied to the windings of the electromagnet).

It will be appreciated, however, that in such an arrangement, for the printhead to remain in the extended position, the electromagnet will be required to remain in an energised state. This arrangement may have particular application where the proportion of time where printing is expected to occur is relatively small, and thus where the proportion of time where a current is required to flow within the winding (during which time heat is generated) is also relatively small.

Alternatively, in some embodiments, the printhead drive assembly may comprise a second permanent magnet configured to urge the electromagnet towards the printing surface. That is, rather than relying on the force created by the spring to urge the printhead towards the printing surface, a second magnet may be used. The printhead drive assembly may have two stable configurations as described above. Movement of the printhead towards and away from the printing surface may be caused by a combination of forces generated by the two permanent magnets and the electromagnet. In particular, movement from one stable configuration towards the other stable configuration may be caused by a current flowing in the electromagnet, causing a force imbalance to be generated and the printhead position to change. When in each of the stable configurations, the printhead will be retained in that configuration—even when the electromagnet is de-energised (or energised at a low level)—by an attractive magnetic force generated between the electromagnet and one of the permanent magnets.

Of course, in such an arrangement, a spring (or other mechanical biasing member) may also be included in order to provide additional force components or compliance as required. For example, the printhead may be coupled to a component of the printhead drive assembly by a spring so as to provide a degree of insensitivity to variations in printing surface position and/or to provide an appropriate printing force.

While the electromagnet is described above as being mounted to the printhead drive assembly arm 30, an electromagnet may be provided mounted on the printhead support arm 21, with a permanent magnet being mounted to the printhead drive assembly arm 30. Such a reversal of component positions would not affect the operation of the printhead movements as described above. That is, the printhead drive assembly 22 is described above has having two components which can be cased to attract or repel one another as required. Each of these two components could be mounted on either one of the printhead carriage 13 or the support arm 21 (with the other component mounted on the other one of the printhead carriage 13 or the support arm 21).

Moreover, while the above described embodiment used a printhead carriage 13 and support arm 21 which is pivotally mounted to the printhead carriage 13, other suitable mechanical arrangements can be used as required. For example, the printhead 4 may be mounted to move along a linear slide towards and away from the printing surface 11. All that is necessary is for the printhead to be supported so as to be able to move towards and away from the printing surface under the control of the printhead drive assembly 22. Similarly, the printhead drive assembly arm 30 and bearing surface 32 may be omitted entirely, with alternative structures being provided to allow a parked configuration (if such a configuration is provided at all).

Further alternative arrangements may be provided in some embodiments. For example, while a single coil 24 is described above, multiple coils may be provided, which are arranged to allow a controllable magnetic field to be generated within the ferromagnetic element 25 of the electromagnet 23. Moreover, rather than a single coil which is energised with current in different directions by reversing the connection to a power supply, or by reversing the polarity of the power supply, a centre-tapped coil may be provided to allow a reversible magnetic field to be generated by connecting the centre tap to the negative power supply terminal and one or other ends of the coil to a single positive power supply terminal.

It will, of course, be appreciated that different electromagnet geometries and arrangements can be used where appropriate. For example, instead of a single electromagnet, a plurality of electromagnets may be used. In some embodiments, a plurality of electromagnets are arranged to provide variable attractive or repulsive forces as required. For example, each of a plurality of electromagnets could be used to provide a different force component, with the overall force acting on the printhead at each time being the sum of the various force components. In one such embodiment, a single (master) electromagnet is arranged as described above to provide both attractive and repulsive forces. However, one or more additional electromagnets may be included to provide only repulsive forces. Such an arrangement allows the force applied to the printhead to be provided by multiple actuators, and to be varied as required for a particular application.

In addition to the use of pulses of current to drive the printhead 4 towards and away from the printing surface (and, in some instances, for example where a spring is omitted, to generate a printing force) the current supplied to the coil 24 of the electromagnet 23 can also be used to finely adjust the printing force. For example, when the printhead 4 is in the extended position and the spring 28 is causing a printing force to be exerted on the printing surface 11, a current may be applied to the coil 24 of the electromagnet 23. As described above, such a current will cause a magnetic field to be generated by the electromagnet 23, and a corresponding force to be exerted on the permanent magnet 27 and target 26. By adjusting the magnitude and direction of the current, the magnitude and direction of that force can be adjusted.

For example, by applying a small positive current to the coil 24 when the printhead 4 is in the extended position, the force exerted on the printing surface 11 during printing operations can be increased by a small amount. Conversely, by applying a small negative current to the coil 24 when the printhead 4 is in the extended position, the force exerted on the printing surface 11 can be decreased by a small amount. The constant of proportionality between the applied current and the generated force will depend on the details of the system, however the relationship is substantially linear.

The controller 50 may process information about the desired printing force, and use this information to determine the required current to be caused to flow in the coil 24.

FIG. 12 shows force and current waveforms for one example. The horizontal axis shows time, with the full range shown covering a duration of 200 ms. The vertical axis again shows voltages which are indicative of either force or current, as indicated by lines F and I respectively. As with FIGS. 10 and 11, the line F again represents the force applied by the printhead 4 to the printing surface 11 while the line I again represents the current applied to the electromagnet 23. In this example, a current of approximately 1 amp is known to generate an additional force of around 0.4 kgf.

In the example illustrated in FIG. 12, at time t10 the current is zero, and the printing force is also effectively zero. At time t11 a current is applied to the coil 24 in a positive direction, with the current I showing an increase immediately thereafter. The print force F can be seen to rise from zero at time t12, shortly after t11. At a time t13, shortly after t12, the current level is reduced to a non-zero constant value (around 1 A in this case). Thereafter the printing force gradually stabilizes at level which approximately corresponds to a printing force of around 1.6 kgf.

Then, for a period of time, the printing force F remains substantially stable at 1.6 kgf, while the current remains at 1 amp. This period is when printing operations are performed, with an increased printing force as compared to the configuration illustrated in FIG. 10.

The printing force F continues at around 1.6 kgf until time t14, when a negative current pulse is applied to the coil 24. At a time t15, shortly after the onset of current at t14, the printing force rapidly falls away. The negative current is then removed at time t16, after which the current returns to zero, and the printing force remains at zero.

Of course, if a larger current is caused to flow in the coil during the printing operations, then the printing force will be further increased. On the contrary, if a negative current is applied during the printing operations, then the printing force will be decreased.

In a similar manner, the current caused to flow in the coil 24 during printing operations can be modified to provide a predetermined printing force even where there is variation in printing surface position. For example, where the same current is caused to flow within the coil 24 during printing operations, there may be some difference in printing forces established when comparing a first configuration in which the printhead makes contact with a printing surface when the separation is 3 mm and a second configuration in which the printhead makes contact with a printing surface when the separation is 5 mm. This is a result of variation in the forces generated at different separations. It is noted that while the force characteristic is relatively flat across a range of separations (for example, as illustrated in FIG. 9), the characteristic is not entirely flat.

As such, the current caused to flow within the coil 24 can be modified so as to compensate for different printing surface configurations. More generally, the current caused to flow within the coil 24 can be modified so as to cause a predetermined printing force to be generated, in spite of different printer configurations.

Furthermore, in addition to the use of varying current to vary printing force, the current applied to the windings can be used to control the movement of the printhead 4. In particular, as can be observed from the measured print force F illustrated in FIGS. 10 to 12, upon making contact with the printing surface 11, the printhead 4 tends to rebound, with the print force F first overshooting the desired print force, then oscillating, before gradually settling at the desired force. However, during this period of instability, it may not be possible to perform printing operations.

In some embodiments, such force instability can be reduced by the use of active damping. For example, the shape of the current waveform applied to the coil 24 can be shaped so as to damp the movement of the printhead 4. For example by applying a current in the opposite direction to the main current pulse after movement of the printhead 4 has begun, it is possible to decelerate the printhead 4 prior to it making contact with the printing surface 11 (or, during printhead retraction, prior to the permanent magnet making contact with the bumper 29) so as to provide a 'soft landing'. Such damping can provide a system in which a stable print force is generated more quickly, allowing for increased speed of operation. Further, reducing mechanical impacts experienced by the various components of the printhead drive assembly 22 (e.g. the spring 28) by use of such damping can reduce wear and fatigue on those components, increasing the reliability and service life.

More generally, the current applied to the coil 24 can be altered in a variety of ways to control the printhead movement. For example, the duration of current pulses, the magnitude of current applied, and the shape of each current pulse applied, can all be varied (alone or in combination) to achieve desired force to be exerted on the printhead, in order to achieve a desired mechanical effect.

In some embodiments, a sensor may be provided which generates a signal indicative of a position of the printhead 4. Such a sensor output may be used to control the energisation of the electromagnet 23. For example, instead of (or as well as) use of detected back-EMF pulses referred to above, a signal indicative of a position of the printhead 4 may be used to control the duration, magnitude and/or direction of current pulses applied to the coil 24. Such a sensor may, for example be a rotary encoder arranged to generate a signal indicative of the rotation of the arm 21 about the pivot 14 (which rotation has a predetermined relationship with printhead 4 position).

Alternatively, the sensor may be some form of linear position sensor, for example which directly or indirectly detects a position of the printhead 4, or a sensor which detects a separation between the first and second components of the printhead drive assembly 22 (e.g. a proximity sensor). Such sensor data may be used to control the current applied to the coil 24 to provide damping, or to ensure a predetermined printing force is generated. In particular, sensor data may be used as an input to a control algorithm (e.g. a PID control algorithm) which is arranged to control the position of the printhead 4. The controller 50 may thus process information indicating the position of the printhead 4 and use this information to determine the required current to be supplied to the coil 24, and/or the force to be generated by the printhead drive assembly 22.

One example of such position sensor will now be described with reference to FIG. 16. FIG. 16 shows an alternative printhead assembly 60 which is generally similar to the printhead assembly 51 described above. Components of the alternative printhead assembly 60 that correspond to those described above are labelled using the same numerals. The features and advantages described above with reference to the first embodiment are generally applicable to the second embodiment.

In addition to the components described above, a sensor 61 is provided on an upper surface of the printhead 4. More particularly, the sensor 61 is provided on a surface of the printhead 4 which, in use, faces away from the printing surface 11. The printhead assembly 60 further comprises a target 62, which is arranged to face the sensor 61. The target 62 may, for example, be mounted from part of the printhead assembly arm 30. The target 62 may be adjustably attached to the printing assembly arm 30, so as to enable a relative position of the target 62 and the sensor 61 to be adjusted, for example, during a calibration operation. In use, the sensor 61 is configured to generate a signal which varies based upon the distance between the sensor 61 and the target 62.

As described above, during use, the printhead 4 is caused to move towards and away from the printing surface 11 by the action of the printhead drive assembly 22. During such movement, the printhead 4, as supported by the printhead support arm 21 rotates about the pivot 14 so as to move away from the printhead drive assembly arm 30. However, during such movement of the printhead 4, the printhead assembly arm 30, and the target 62 which is attached thereto, do not move relative to the printing surface 11.

As such, the sensor 61, which is attached to the printhead 4, will move with respect to the target 62, which is attached to the printhead assembly arm 30. Therefore, given a known initial condition, the distance between the sensor 61 and the target 62 has a well-known relationship with the position of the printhead 4 relative to the printing surface 11, and can provide useful information regarding the printhead position. In particular, the distance between the sensor 61 and the target 62 will vary according to an inverse relationship with the distance between the printhead 4 and the printing surface 11.

FIGS. 17*a* and 17*b* show schematically lower and upper surfaces of the printhead 4 (when in the orientation shown in FIG. 16). The sensor 61 comprises an emitter 63 and a receiver 64. The emitter 63 is a radiation source, such as, for example, an LED which emits electromagnetic radiation in the infrared range. The receiver 64 is provided, for example, by a phototransistor. The receiver 64 is suitable for receiving the radiation emitted by the emitter 63.

In an embodiment, the sensor 61 may suitably be provided, for example, by a QRE1113GR Surface Mount Sensor manufactured by Fairchild/ON Semiconductor, Phoenix, Ariz., United States. Such a sensor may be housed in a small form factor SMD package, and may have a detection range of around 5 mm. The sensor 61 may be referred to as a proximity sensor. In particular, the sensor 61 senses the proximity of the target 62.

Of course, it will be appreciated that alternative sensing arrangements can be used as appropriate. For example a photodiode may be used in place of the phototransistor described above. More generally, it will be appreciated that further alternative emitters and receivers may be used, provided that an appropriate combination of emitter and receiver is selected. For example, a wide-angle light source, a laser source, or other LED sources (e.g. using visible light) may also be used in the place of the emitter 63.

Further, in some alternatives an ultrasonic emitter and receiver, or other forms of emitter and receiver, may be used.

Moreover, whereas in the above described embodiment the emitter 63 and receiver 64 are provided in an integrated sensor 61 mounted upon the printhead 4, in alternative embodiments the emitter and receiver may be separate devices, each mounted at different locations upon the printhead 4. Further still, different numbers of integrated sensors, or different numbers of discrete emitters and receivers may be used as appropriate.

Further, in some embodiments the sensor may be passive. That is, an emitter may be omitted entirely. In such an embodiment, a sensor is configured to sense some characteristic from the target. For example, the target may be provided with a magnetic area which can be sensed by the sensor without the need for an emitter. Alternatively, the sensor may be a capacitive sensor, or an inductive sensor, with the target being provided with a region having a characteristic which can be sensed. Alternatively, the sensor and target may be provided in the opposite (or otherwise different) positions to those described above.

More generally, it will be appreciated that the sensor 61 is arranged to generate a signal indicative of a position of the printhead, and that any suitable form, number, or arrangement of sensor(s) may be used.

Referring again to the specific embodiment described briefly above, as shown most clearly in FIG. 17*a*, which shows as the lower surface of the printhead 4 (i.e. as seen looking up from a view point at the printing surface), the printhead 4 comprises a plurality of resistive heating elements 65 mounted on a ceramic substrate 66 and which are provided in a one-dimensional linear array along a first edge of the printhead 4. The printing elements 65 are selectively energised based upon printing requirements (e.g. based upon image data). Printing control signals which are provided to the printing elements 65 may be generated within a printhead controller 67 which is mounted upon a printhead circuit board 68. A sensor interface circuit 69 is also provided on the printhead circuit board 68. The printhead circuit board 68 is attached to a heat sink 70, which also forms part of the printhead 4. The printhead controller 67 communicates with the controller 50 via a flexible ribbon cable 71 which connects to the circuit board 67 via a connector 72.

As noted above, the surface of the printhead 4 which is seen in FIG. 17*a* is that which faces in a generally downward direction as shown in FIG. 1, and that which is provided with printing elements 65. This surface may be referred to as an operating surface of the printhead 4. That is, the operating surface of the printhead 4, as shown in FIG. 17*a*, generally faces the ribbon 2 in normal operation.

However, as noted above, rather than being located on the operating surface of the printhead 4, the sensor 61 is provided on the opposite (upper) surface of the printhead (hence being shown in dashed lines in FIG. 17*a*). The upper surface of the printhead 4 is shown in FIG. 17*b*. The upper surface of the printhead 4 may be referred to as a non-printing surface. The visible components of the printhead 4 are the heat sink 70, the sensor 61, the printhead circuit board 67 upon which the sensor 61 is mounted, and the connector 72. The emitter 63 and receiver 64 are shown adjacent to one another on the upper surface of the printhead 4, both being provided as part of integrated sensor 61.

It will be understood, therefore, that the sensor 61 is mounted on the surface of the printhead 4 which, during printing operations, is arranged to face away from the printing surface 11, and towards the internal components of the printer, such as, for example, the components of the printhead assembly 60, and in particular the printhead drive assembly arm 30, and target 62. This results in the sensor 61 being mounted in such a way that, during printing operations, it is arranged to face away the ribbon 2.

Generally speaking it will be understood that the sensor 61 may be mounted to the printhead in such a way that it is considered to be operatively associated with a non-printing surface of the printhead. For example, in some embodiments the sensor may be provided below the non-printing surface of the printhead, but arranged to sense beyond the non-printing surface of the printhead. For example, an optical sensor may be separated from the non-printing surface by a transparent or translucent material while still being associated with the non-printing surface. Similarly, a magnetic sensor may be separated from the non-printing surface by a material which is penetrable by a magnetic field, allowing the target to be sensed. Alternatively, the body of the sensor 61 may be located on the operating surface of the printhead (i.e. the lower surface shown in FIG. 17*a*), but be arranged such that it 'looks' through one or more holes provided in the printhead circuit board 67.

It will be appreciated that during movements of the printhead 4 the position of the printhead 4 relative to the printing surface will vary. The sensor 61 is configured to generate an output which allows the controller 50 to control the movement of the printhead 4 during such phases of movement as described in more detail below.

FIG. 18 shows the sensor interface circuit 69 in more detail. The sensor interface circuit 69 is arranged to drive the emitter 63 and receive a signal from the receiver 64. The sensor interface circuit 69 is further arranged to amplify the received signal and to generate an output signal which can be provided to the printer controller 50 via the ribbon cable 71. The sensor interface circuit 69 may be considered to comprise an emitter driver circuit 73 and a receiver circuit 74. While both of these circuits 73, 74, are shown in a single circuit diagram, it will, of course, be appreciated that they are effectively separate circuits, operatively coupled by light emitted from the emitter 63 and received by the receiver 64, and may be independently modified.

The emitter driver circuit 73 comprises a positive supply rail 75 which is connected to a +5V voltage supply, a ground rail 76 which is connected to a ground voltage (0 V), a field effect transistor Q1, a resistor R0, and a resistor R1. The anode of the emitter 63 is connected, via the resistor R0, to the supply rail 75, with the cathode switchably connected, via the transistor Q1, to the ground rail 76. The resistor R1 is connected between the gate of the transistor Q1 and the ground rail 76. An input node 77 is provided at the gate of the transistor Q1. The input node 77 is driven, in use, by a PWM signal provided by the printer controller 50, via the ribbon cable 71.

The resistor R0 has a resistance value of 68Ω. The resistor R0 is provided so as to control the current flowing through the emitter 63 when the cathode of the emitter 63 is connected to the ground rail 76 by the transistor Q1. In the described embodiment, assuming a voltage drop of approximately 1 V across the emitter 63, a voltage drop of approximately 4 V will be developed across the resistor R0. This configuration (i.e. a voltage of 4 V being developed across a resistor R0 having a resistance value of 68Ω) will cause a drive current of approximately 59 mA to flow through the emitter 63.

The resistor R1 has a resistance value of 10 kΩ. The resistor R1 is provided so that if the print head is not connected to the ribbon cable (for example during transit), or is driven from a switching source that may be tri-stated (i.e. a high-impedance state, in addition to '1' and '0'), then the gate of the transistor Q1 will not be allowed float, and will thus be less susceptible to ESD damage.

The transistor Q1 is an n-channel FET, and may be provided, for example, by a NX7002AK device as manufactured by Nexperia, Nijmegen, The Netherlands. The transistor is driven by the PWM signal which switches between a high (e.g. 5 V) level and low (e.g. 0 V) level. The PWM signal switches the transistor Q1 on and off, and in turn causes current to flow in the emitter 63 when the transistor is turned on, and causes no current to flow in the emitter 63 when the transistor is off.

The PWM duty cycle may, for example, be around 50%, with a square wave profile, and a 2 kHz modulation frequency. Of course, other emitter driving schemes can be used as preferred. For example, in an embodiment, the emitter may be driven at reduced duty cycle (e.g. 30%) in order to limit the power dissipated by the resistor R0. Similarly, the modulation frequency may be adjusted When driven in the 'on' state, the emitter 63 has a drive current of around 59 mA. The emitter device described above (i.e. QRE1113) has a maximum continuous diode current of 50 mA (at an ambient temperature of 25 deg. C.). Thus, while the selected drive current (e.g. 59 mA) is above this maximum allowable continuous level, it is not driven continuously. It will, of course, be appreciated that different drive levels may be selected (and that an appropriate value resistor may be chosen for the resistor R0).

The modulation frequency is selected so as to provide a fast sensor response, while not being too high such that the receiver and associated circuitry cannot respond (as described in more detail below with reference to the receiver circuit). It will be understood that the modulation frequency may be selected on the basis of multiple factors. For example, the frequency may be increased so as to allow more frequent sensor readings to be taken.

The receiver circuit 74 also makes use of the positive supply rail 75, and the ground rail 76. It will be appreciated, however, that separate power supply arrangements may be provided if required.

The receiver circuit 74 further comprises the receiver 64 and a resistor R2 connected between the collector of the receiver 64 and the positive supply rail 75. A node 78 is formed between the receiver 64 and the resistor R2. The emitter of the receiver 64 is connected directly to the ground rail 76. The resistor R2 has a resistance value of 100Ω. The resistor R2 and receiver 14 are thus connected in series, with any photo-current generated within the photodiode flowing through the resistor R2, and causing a voltage drop to develop across the resistor R2.

The receiver circuit 74 further comprises an operational amplifier (op-amp) OP1. The op-amp OP1 may, for example, be provided by CMOS operational amplifiers with low noise, rail-to-rail inputs/outputs optimized for low-power, single-supply applications such as an NCS20061 device manufactured by ON Semiconductor, Phoenix, Ariz., United States. For example, the op-amp OP1 may suitably be an NCS20061SN2 device.

The node 78 is connected to a non-inverting input of the op-amp OP1. The op-amp OP1 is arranged to form a current amplifier, amplifying the current flowing in the receiver 64. In addition to the op-amp OP1, the current amplifier comprises a capacitor C1, resistors R3, R4 and R5, and a transistor Q2. The current amplifier may also be considered to include a further resistor (R6) provided remote from the other components of the amplifier, as described in more detail below with reference to FIG. 19.

The capacitor C1 is connected between the output of the op-amp OP1 and the inverting input of the op-amp OP1. The capacitor C1 has a capacitance value of 270 pF, and is provided to stabilise the op-amp OP1.

The output of the op-amp OP1 is also connected, via the resistor R5 to a base terminal of the transistor Q2. The transistor Q2 is a high gain PNP transistor in which the collector current and the emitter current are substantially equal. The transistor may, for example, be provided by a BC856B general purpose transistor, as manufactured by NXP Semiconductors, Eindhoven, The Netherlands. Given the high-gain of the transistor Q2, only a small current will flow into the base via the resistor R5. The resistor R5 has a resistance value of 100Ω. The resistance of the resistor R5 is preferably selected in order to limit any transient current out of the op-amp OP1 if there is a sudden change in receiver current level. It will be appreciated, therefore, that this value is not critical to the working of the amplifier circuit, and that the circuit will work over a large range of resistance values of resistor R5.

A collector terminal of the transistor Q2 is coupled to an output node 79, which is in turn coupled to an input of the printer controller 50 via the ribbon cable 71 for subsequent processing (as described in more detail below).

An emitter terminal of the transistor Q2 is coupled, via the resistor R4, to the positive supply rail 75. A node 80 is formed between the emitter terminal of the transistor Q2 and the resistor R4. The node 80 is connected, via the resistor R3, to the inverting input of the op-amp OP1. The resistor R3 has a resistance value of 100Ω. The resistance of resistor R3 is selected so as to provide substantially equal input impedance to both inputs of the op-amp OP1, so as to negate any voltage offset due to bias current. In the arrangement described above, the non-inverting input of the op-amp OP1 is connected to the resistor R2 and the receiver 64, and will thus only have a small current flowing though it (e.g. a few micro amps). Given this small level of current, the input impedance matching is not critical, especially given the low bias current of the selected operational amplifier.

The resistor R4 has a resistance value of 4.3Ω. The resistance of the resistor R4 is selected, in combination with the resistance of the resistor R2, to set the current gain of the amplification circuit. In particular, the ratio of the resistances of resistors R2 and R4 determines the current gain. Thus, a resistance of 4.3Ω for R4, coupled with a resistance of 100Ω for R2, provides a current gain of around 23.

Moreover, the resistor R4 is selected so as to ensure that across an operating range of the receiver 64, the voltage drop across the resistor R4 is maintained within a range determined by the voltage supply level (e.g. 5V). This ensures that the output of the amplifier is not saturated. The resistance of resistor R4 is sufficiently small that a convenient output current level is generated for detection at the printhead controller 50.

For example, if a current output level of 20 mA is expected, it will be appreciated that this corresponds to a voltage drop of 86 mV across the resistor R4, and allows a voltage drop of around 4.8 V to be developed at the input to subsequent processing stage (assuming a collector-emitter voltage in transistor Q2 of around 0.1 V).

The op-amp OP1 is provided with positive and negative power supply connections from the positive and ground rails 75, 76 respectively. A capacitor (e.g. 0.1 pF, not shown) may be provided between the power supply terminals so as to provide supply de-coupling (i.e. to reduce supply noise).

The op-amp OP1 is configured such that if the voltage at the node 80 (which is connected, via the resistor R3, to the inverting input) exceeds the voltage at the node 78, the output of the op-amp OP1 will be driven low. Driving the output of the op-amp OP1 low will cause the transistor Q2 (which is a PNP transistor) to be turned on. This will in turn cause a current to flow through the resistor R4, and a voltage drop to develop across the resistor R4. Thus, the voltage at the node 80 will drop, until it is the same as that at node 78. The current caused to flow through the resistor R4 varies based upon the photo-current, but is significantly larger in magnitude than the photo-current (i.e. the photo-current is amplified).

In this way, the receiver circuit is arranged to amplify a photo-current, allowing the receiver signal to be provided to the printer controller 50 via the ribbon cable 71. Such amplification significantly improves the noise immunity.

Prior to being converted to a digital signal for subsequently processing by the printer controller 50, the amplified current signal may be further processed by an amplifier 90 provided on a main PCB (not shown) upon which the controller 50 is mounted. An example of such an amplifier 90 is shown in FIG. 19. The amplifier 90 comprises a second operational amplifier (op-amp) OP2. The op-amp OP2 may, for example, be provided by a CMOS operational amplifier with rail-to-rail inputs/outputs such as an NCS20062DMR2G device manufactured by ON Semiconductor, Phoenix, Ariz., United States.

The amplified current signal (as present at node 79 and provided along ribbon cable 71) is provided to a non-inverting input of the op-amp OP2. The non-inverting input is also connected to a local ground 91 via a resistor R6. The resistor R6 has a value of 130Ω, and allows the amplified current signal to be converted to a voltage level for amplification by the op-amp OP2.

The amplifier 90 also comprises a resistor R7 provided between an output of the op-amp OP2 and an inverting input of the op-amp OP2. The amplifier 90 also comprises a resistor R8 provided between the inverting input of the op-amp OP2 and the local ground 91. As is well known in the art, the gain of amplifier 90 is determined by the ratio of the sum of the values of resistors R7 and R8 and the value of resistor R8.

In a preferred embodiment, the resistors R7 and R8 may each be provided by a digital potentiometer DP. The digital potentiometer DP is connected so as to provide a configurable resistance between the output of the op-amp OP2 and the inverting input of the op-amp OP2, and a further configurable resistance between the inverting input of the op-amp OP2 and the local ground 91. In this way, the digital potentiometer DP is configured to cause the amplifier 90 to have a variable gain characteristic. The digital potentiometer DP may, for example be provided by a device such as part MCP4013T-103E/CH as manufactured by Microchip Technology Inc., Chandler, Ariz., United States. In an embodiment, the digital potentiometer DP (and thus the values of resistances R7 and R8) may be controlled by a gain control signal generated by the controller 50. The gain of the amplifier 90 may be adjusted during a calibration process so as to take into account expected variations in sensor performance or other factors.

For example, in an embodiment, during the testing of a printhead, sensor readings may be taken with a target being provided at one or more predetermined distances from the sensor (e.g. at distances which correspond to nominal printhead separations from a printing surface of 0 mm and 4 mm), and the amplifier gain adjusted so as to provide a predetermined signal output level. Such calibration allows a single sensor reading to be used to normalise all subsequent sensor output values. Of course, alternative calibration techniques may be used where appropriate. For example, a single sensor reading may be obtained, or a plurality of sensor readings may be obtained with different target distances and a calibration curve generated.

In some embodiments, the sensor may be recalibrated more frequently than described above. For example, the sensor may be recalibrated before every print stroke (e.g. during the period when the printhead is retracted from the printing surface). It will be understood that the characteristics of various sensor circuit components (especially the emitter and receiver) may vary significantly as a function of temperature. As such, regularly modifying the amplifier gain to compensate for such variations may provide for more reliable operation.

In some embodiments, the sensor gain may be adjusted by reference to a lookup table. For example, a printhead temperature reading may be used to index a lookup table storing appropriate gain values (or gain control signal values).

Alternatively, the gain may be adjusted to provide a predetermined output signal from the amplifier 90 in a known configuration. For example, the gain may be adjusted between each printing stroke so as to provide an output signal of 3.2 V when the printhead is in the retracted position.

Frequent adjustment of the gain may also reduce the likelihood that dirt present on the sensor 61 (or target 62) will interfere with the correct operation. In some embodiments, the calibration routine may be configured to provide useful information to a user. For example, if a gain value that exceeds a normal range is required to achieve a target output signal level this may be used to generate an alert to a user that the sensor and/or target need to be cleaned.

The output of the op-amp OP2 is connected to an analog-to-digital convertor ADC1. The voltage level of the output of the op-amp OP2 is sampled by the printer controller 50. By sampling the voltage provided to the controller 50 by the ADC1, a measure of the receiver current can be obtained.

As noted above, the emitter 63 is typically driven by a PWM signal. FIG. 20 shows an example waveform of the signal received at the controller 50 from the receiver 64 (via amplifier 90) during one PWM cycle. It can be seen that at around time t30 the signal begins to rise rapidly from an 'off' level ($LED_{OFF}$) to an 'on' level ($LED_{ON}$), where the signal stabilises during an 'on' pulse. This pulse corresponds to the emitter 63 being driven on. Then, at a time t31, the current falls from the $LED_{ON}$ level to the $LED_{OFF}$ level (again, under the control of the PWM signal). At a time t32, the current again rises. In this way, the signal received at the controller 50 from the receiver 64 pulses 'on' and 'off' in accordance with the emitter current being pulsed on and off, which, in turn, causes the radiation emitter by the emitter 63 to be pulsed on and off.

As can be seen in FIG. 20, the signal rise at time t30 is not instantaneous. In particular, the signal rises quickly at first, before gradually stabilising at the level $LED_{ON}$. Then, at a time t31, when the signal falls from the level $LED_{ON}$ to a level $LED_{OFF}$, the fall begins quickly before the rate of decrease slows, and the signal level eventually stabilises at the level $LED_{OFF}$. It can be seen that the rise time (i.e. the time taken to rise from $LED_{OFF}$ to $LED_{ON}$) is shorter than the fall time (i.e. the time taken to fall from $LED_{ON}$ to $LED_{OFF}$).

It will be understood that the signal level $LED_{ON}$ is indicative of the intensity of radiation received at the receiver 64. The received radiation comprises radiation which originates from the emitter 63 and is reflected by the target 62 and which is then incident upon the receiver 64, The received radiation may also comprise ambient radiation which is incident upon the receiver 64. It will be appreciated that the ambient radiation level will vary between various printer configurations.

The signal level $LED_{OFF}$ is indicative of the intensity of radiation received at the receiver 64, and represents an 'off' state. That is, the signal level $LED_{OFF}$ corresponds to only ambient radiation being incident upon the receiver 64, and does not include any reflected radiation which originates from the emitter 63 (via target 62).

To determine an accurate measure of the receiver current level (and thus an indication of the intensity of incident radiation), the current level should be sampled towards the end of each cycle, where the current level is substantially stable. Moreover, to increase noise immunity, the signal level may be sampled a plurality of times and an average taken.

In an embodiment, the signal level is sampled eight times during each 'on' pulse during the period when the signal level is substantially stable at $LED_{ON}$. During an 'off' pulse, the signal level is sampled four times when the signal level is substantially stable at $LED_{OFF}$ The reduced number of samples during the 'off' phase takes into account the longer fall time of the receiver circuit described above (and thus shorter period in which the signal level is stable). Of course, different sampling strategies can be adopted as appropriate for a particular circuit configuration.

Thus, the ADC1 is caused to sample the signal level within a relatively flat and stable portion of the current waveform, allowing an accurate representation of the current level during each 'on' and 'off' state to be obtained. This process may be repeated during each PWM cycle.

In this way, the controller 50 is able to obtain signal level measurements which are representative of the photo-current flowing within the receiver 64. By subtracting the signal value representative of $LED_{off}$ from that representative of $LED_{on}$ it is possible to obtain a value $LED_{diff}$ that is representative of a photocurrent received at the receiver 64 as a result of reflection of radiation emitted by the emitter 63 (which value excludes the effect of ambient radiation).

The value $LED_{diff}$ varies based upon the proximity of the target 62 to the sensor 61 and may thus be considered to be printhead position data. The value $LED_{diff}$ may then be processed to identify the distance of the target 62 from the sensor 61, and from this work out the position of the printhead relative to the printing surface (as described in more detail below).

The PWM frequency of 2 kHz used in this example is also the frequency with which $LED_{diff}$ values are obtained (the ADC sampling rate being determined based upon the PWM frequency). It will be understood that the sampling frequency will also determine the rate at which the printhead position data can be obtained and updated and thus the lag in controlling the printing based upon this data.

The use of a PWM frequency of 2 kHz is descried above. This may be suitable for a particular arrangement, However, as can be understood from the waveforms shown in FIG. 20, if the rise time is such that during an 'on' or 'off' period the current has not reached a stable value, it may be necessary to reduce the pulse rate accordingly. The response time is, to some extent, controlled by the characteristics (including bias conditions) of the phototransistor which forms the receiver 64.

It will, of course, be understood that the above described circuitry provides one possible implementation. However, the skilled person will readily appreciate that alternative emitter driver and receiver circuits may be used as appropriate for a particular application, or to accommodate an alternative sensor arrangement.

Further, in some embodiments, for example where there is negligible ambient radiation, the emitter may be constantly driven, rather than being pulsed. In such an arrangement, the ADC may be sampled at any convenient frequency. Further, the ADC may be provided as a separate device to the controller 50, or a part of the controller 50. It will also be understood that while above descried circuitry provides driving and amplification for a single sensor (i.e. a single emitter and a single receiver) multiple circuits or sensors may be provided as required.

As described above, the sensor 61 is configured to generate a signal indicative of the position of the printhead relative to the printing surface. However, it will be appreciated that the signal amplitude may not vary in direct proportion to the printhead position. For example, where the emitter 63 emits radiation in a broad beam, the portion of radiation emitted by the emitter 63 which is incident upon the target 62 may be expected to vary according to an inverse square relationship with the separation between the sensor 61 and the target 62 (i.e. $1/r^2$). Moreover, the distance travelled by the radiation is twice the separation between the sensor 61 and the target 62.

As such, the averaged sensor readings obtained by the controller 50 may be linearised according to the following relationship:

$$r_{real} = \frac{1}{\sqrt[2]{Q_{sensor}}}, \tag{1}$$

Where $r_{real}$ is the linearised reading; and $Q_{sensor}$ is the raw sensor reading.

In this way, the geometric characteristics of the particular sensor arrangement can be taken into account. Of course, alternative adjustments can be made as required for a particular arrangement. Alternatively, a lookup table may be used to convert a sensor reading to an apparent intensity, or suitable position reference value.

The linearised sensor reading obtained in this way may be considered to be data indicative of the printhead position and may thus be referred to as printhead position data. Of course, it will also be understood that the receiver current signal, the output signal produced by amplifier 90, or the averaged output signal (or other data items derived from one or more of those signals) may also be considered to be and/or referred to as printhead position data.

In some embodiments, the apparent printhead position data is also converted to a velocity value. Such data may be referred to as printhead velocity data, and may be used to control the printhead position and/or velocity. It will, however, be understood that the printhead velocity data may be considered to be printhead position data, and vice versa.

As described briefly above, the controller 50 may process information indicating the position of the printhead 4 and use this information to determine the required current to be supplied to the coil 24, and/or the force to be generated by the printhead drive assembly 22. FIG. 21 illustrates one such possible printhead drive assembly control arrangement. It will be appreciated that control blocks identified in FIG. 21 do not need to be performed by a single component. Indeed, as described above, some of the control functions are performed by dedicated hardware, while others may be performed by the controller 50. Alternatively, the controller 50 may be considered to encompass all control functions described with reference to FIG. 21 other than those performed by devices located on the printhead itself.

A printhead drive assembly controller 100 comprises three fundamental control blocks. These are an electromagnet current control block 110, a printhead position data block 120, and a position and velocity control block 130.

The printhead position data block 120 comprises optical sensor block 121. In an embodiment, the optical sensor block 121 comprises the sensor interface circuit 69 described in detail above (including emitter driver circuit 73 and receiver circuit 74).

The output of the optical sensor block 121 is provided to an amplifier block 122, which in the described embodiment comprises the amplifier circuit 90 described in detail above. The amplified output signal is provided from the amplifier block 122 to an ADC block 123, which in the described embodiment comprises ADC1. The output of the ADC block 123 is sampled and averaged (as described above) by an averaging block 124 in order to minimise the effects of noise and ambient radiation. A gain control signal GC may be provided from the averaging block 124 to control the variable gain of the amplifier block 122. A PWM control signal 'PWM' may be provided from the averaging block 124 to control the PWM signals applied to the emitter 63 by the emitter driver circuit 73 within the optical sensor block 121.

As described in detail above, the averaged ADC output signal (as generated by the averaging block 124) is passed to a linearisation block 125, where the signal is adjusted according to equation 1. The linearised output is passed to a calibration block 126 where any scaling is performed to provide an appropriate signal level (e.g. based upon calibration data).

The output from the calibration block 126 is provided as an actual position data output Pactual which is provided to the position and velocity control block 130. The output from the calibration block 126 is also provided to a position to velocity convertor block 127, which provides as an output an actual velocity data output Vactual, which is also provided to the position and velocity control block 130.

The operation of the position and velocity control block 130 will now be described in more detail. The printhead 4 may be controlled on the basis of a target position at some times, while at other times it is controlled on the basis of a target velocity. For example, position control may be used to retract the printhead 4 from the printing surface 11 after a printing operation. On the other hand, where the ultimate target position may not be known precisely, for example when driving the printhead 4 out towards the printing surface 11 (the position of which may vary) velocity control may be used. Thus, in an embodiment, the position and velocity control block 130 may receive a target printhead position input Ptarget and a target printhead velocity input Vtarget, each of which may be provided and used at appropriate times only.

A velocity adder 131 receives the target printhead velocity input Vtarget and the actual velocity data output Vactual and subtracts the actual velocity data output Vactual from the target printhead velocity input Vtarget to generate a velocity error signal Verror. This is passed to a velocity PID control block 132 which, in the illustrated embodiment comprises a proportional gain block 133 (which applies a proportional gain Kp-velocity) and a derivative gain block 134 (which applies a derivative gain Kd-velocity). The two modified error signals are combined in a velocity gain adder block 135 before being passed to a control mode selector 136.

In parallel, a position adder 137 receives the target printhead position input Ptarget and the actual position data output Pactual and subtracts the actual position data output Pactual from the target printhead position input Ptarget to generate a position error signal Perror. This is passed to a position PID control block 138 which, in the illustrated embodiment comprises a proportional gain block 139 (which applies a proportional gain Kp-position), an integral gain block 140 (which applies am integral gain Ki-position), and a derivative gain block 141 (which applies a derivative gain Kd-position). The three modified position error signals are combined in a position gain adder block 142 before being passed to the control mode selector 136.

As noted above, the printhead drive assembly may be controlled on the basis of position or velocity. The control mode selector 136 selects either of the position signal or the velocity signal for further processing depending on a control mode input (not shown).

Position control may be used to control the printhead position when driving to a known target position (e.g. retracted from the printing surface). The proportional, integral and derivative gain terms may be configured to cause the printhead to be retracted from the printing surface in a controlled way. For example, the control algorithm may be tuned so as to attempt to cause the printhead to move towards the retracted position and to complete the movement with a 'soft' landing, rather than causing the components of the printhead drive assembly 22 to collide with significant force.

The integral gain may be used to provide a fail-safe mechanism, so as to ensure that the printhead returns to the retracted position even if the use of an integral gain term causes the printhead to be retracted with more force than is optimal. In some embodiments the contribution of the integral term to the overall PID control algorithm may be monitored. For example, significant use of the integral term may be considered to be indicative of some systematic error in the control algorithm such as, for example, a dirty or degraded sensor 63. In some embodiments, excessive use of the integral term may be used to trigger appropriate corrective action such as, for example, one or more of: an indication to a user to clean the sensor during scheduled down-time, and recalibration of the sensor. In some embodiments, excessive use of the integral term may be used to trigger adjustment of or self-tuning of other gain values or control parameters.

It will, of course, be appreciated that each of the above described PID control blocks may omit one or more of the P, I and D terms. The nature of the control provided may depend upon the particular characteristics of other system components, such as for example, the responsiveness of sensors and controllers.

As noted above, velocity control may be used to control the printhead position when the precise target position is not known, for example when driving the printhead 4 out towards the printing surface 11 when the position of the printing surface 11 is not known. The proportional and derivative gain terms may be configured to cause the printhead to be moved towards the printing surface in a controlled way. For example, the control algorithm may be tuned so as to attempt to cause the printhead to move towards the printing surface at a target speed without significant overshoot or lag. Once the position of the printing surface 11 has been established (e.g. by monitoring the maximum printhead position), positional control may be used for subsequent head out operations.

The selected position or velocity signal is passed to a transfer function block 143. The transfer function block 143 also receives an input indicating the current printhead position from the calibration block 126. The position or velocity control signal as generated by the PID control blocks 132, 138 comprises a signal indicative of a force that is required to be applied by the printhead control assembly 22 to the printhead 4 to cause the printhead 4 to move in the desired way. This signal may be considered to be a target force signal Ftarget. However, as described in detail above, the position-force characteristic of the printhead control assembly 22 is highly non-linear. That is, as described in detail above with reference to FIG. 9, mechanical response of the printhead drive assembly 22 to a particular current level in the electromagnet 23 depends upon the position of the printhead 4.

For example, when the printhead 4 is in a position close to the printing surface, the force generated by the spring 28 will overcome the magnetic force provided by the permanent magnet 27, such that, in the absence of any current flowing in the coil 24 of the electromagnet 23, the printhead will be forced further towards the printing surface 11. On the other hand, when the printhead 4 is in a position spaced apart from the printing surface 11, the force generated by the magnet 27 will overcome the force provided by the spring 28, such that (again, in the absence of any current flowing in the coil 24 of the electromagnet 23), the printhead 4 will be forced further away from the printing surface 11.

Thus, in order to generate an appropriate control signal for the electromagnet 23 in order to cause a desired movement, the position-force characteristic of the printhead drive assembly 22 at the current printhead position is taken into account. The transfer function block 143 is configured, therefore, to generate a target current signal Itarget based upon the target force signal Ftarget, and the actual printhead position signal Factual.

The transfer function block 143 may generate the target current signal Itarget in any convenient way. For example, in an embodiment, the transfer function block 143 may refer to a lookup table which stores an appropriate current level for a plurality of position and force combinations (with interpolation being used as necessary to provide intermediate data points). The stored characteristics may be obtained by empirical analysis of a particular printhead drive assembly 22 with different current levels applied to the electromagnet 23.

FIG. 22 shows a set of reference characteristics obtained by taking measurements of the current required (y-axis) to cause a plurality of predetermined force levels to be exerted by the printhead drive assembly 22 at a plurality of different printhead positions (x-axis). The position range studied was a typical range of motion for a printhead (0-4 mm), while the forces (in printhead force in kgf) ranged from −3.5 kgf to 3.5 kgf.

Where a positive force is indicated, this will cause the printhead to be urged towards the printing surface 11. On the other hand, when a negative force is indicated, this will cause the printhead to be urged away from the printing surface 11. Where a positive current is caused to flow in the electromagnet, this causes the generated force to become more negative, and vice versa. Of course, the direction of current and force may be reversed as required.

The illustrated characteristics may be considered to take the form of a "transfer function". For example, for a given printhead position, an expression may be derived which describes a relationship between the desired force f and the current i required to generate such a force of the form i=mf+c, where coefficients m and c are stored in a lookup table.

It will be understood that the particular force-current-position characteristics will depend upon the particular implementation, and may, for example, be obtained by empirical studies or theoretical modelling as appropriate. Moreover the effect of the force-current-position characteristics may be applied to the control system in other ways than those described above. However, in general terms, it will be understood that the printhead position data (which may include printhead velocity data) can be used, along with a desired movement signal, to generate an appropriate control signal for the printhead drive assembly.

As noted above, the output of the transfer function block 143 is a target current signal Itarget. This signal is provided as an input to the electromagnet current control block 110. The electromagnet current control block 110 comprises a target current adder 111, a PID current control block 112, which, in the illustrated embodiment comprises a proportional gain block 113 (which applies a proportional gain Kp-current) and a derivative gain block 114 (which applies a derivative gain Kd-current).

The outputs of the two gain blocks 113, 114 are combined in a current gain adder block 115 before being passed to a PWM control block 116. The PWM control block 116 generates a PWM signal and a current direction signal to control the magnitude and direction of current flowing within the coil 24. The PWM and direction signals are passed to an H-bridge driver 117 of a conventional type, which comprises switching devices (not shown) arranged to connect the terminals of the coil 24 of the electromagnet 23 with a suitable power supply (not shown) so as to cause the desired magnitude of current to flow in the desired direction. The actual current flowing in the coil 24 of the electromagnet 23 is monitored by a current sensor 118, which generates a signal indicative of the actual coil current.

The current sensor 118, may, for example comprise a low value resistor (not shown) placed in series with the H-bridge driver and the power supply, and a voltage monitor (not shown) arranged to monitor the voltage developed in across the resistor when current flows through the resistor.

This voltage signal is digitised by an ADC 119 before being passed to the target current adder 111 as an actual current signal Iactual. The target current adder 111 receives the target current signal Itarget and the digitised actual current signal Iactual and subtracts the actual current signal Iactual from the target current signal Itarget to generate a current error signal Ierror. This is passed to the current PID control block 112 and processed further as described above.

The use of a closed-loop current controller of this type allows the impact of back-EMF signals induced in the electromagnet to be mitigated. It will be understood that the relative movement between the various components of the printhead assembly 60, and in particular the movement of the permanent magnet 27 and target 26 through the magnetic field created by the electromagnet 23 will cause a back-EMF signal to be induced in the electromagnet. This back-EMF signal may have the effect of reducing the current flowing through the coil 24, which would, in turn, reduce the magnitude of the force generated by the electromagnet 23.

However, so as to compensate for this effect, the current feedback signal enables the current control block 110 to increase the voltage signal (e.g. by causing the PWM control block 116 to adjust the PWM control signal) to overcome the back-EMF signal.

More generally, this form of closed-loop current control also allows the electromagnet force to be accurately controlled so as to deliver a controllable force both during printhead movements towards and away from the printing surface 11, and during printing operation (e.g. by increasing or decreasing the print force).

Further, the use of closed-loop current control also allows changes in desired electromagnet drive current (and thus generated force) to be achieved in a fast and accurate manner. It will be understood that the rate of change of current flowing within the coil 24 of the electromagnet 23 is limited by the coil inductance. However, by closely monitoring the actual coil current, it is possible to adjust the drive signals to optimise the rate of change of current.

It will, however, be understood that closed loop control of the printhead drive assembly (using current feedback, or position feedback, or both) is not essential. In particular, the printhead drive assembly described above can be operated without one or both of forms of feedback described above.

It will, of course, be understood that some blocks of the controllers 110, 120 and 130 may be implemented as hardware component (e.g. current sensor 118, ADC 119) whereas other components may be implemented as software routines running on a processor (e.g. a CPU or FPGA). These components may together form part of the controller 50.

Communications between various system components in some embodiments will now be described in more detail with reference to FIG. 23. For example, as shown schematically in FIG. 23, the controller 50 is connected to the various components of the printhead assembly 60 via flexible ribbon cable 71. It is described above that components provided on the printhead circuit board 68, and in particular the printhead controller 67, communicate with the controller 50 via the flexible ribbon cable 71 which connects to the circuit board 68 via the connector 72. The ribbon cable 71 may typically carry signals relating to the images to be printed by the printhead 4. Further, as described above in detail with reference to FIGS. 17*a* and 17*b*, the controller 50 receives signals from the sensor 61 (and sensor interface circuit 69), which are provided on the printhead circuit board 68 via the flexible ribbon cable 71.

However, in some embodiments, the ribbon cable 71 may also carry control signals for the printhead drive assembly 22, and in particular the coil 24. Flexible wires connected to the terminals of the coil 24 may be provided between the terminals of the coil 24 and the printhead circuit board 68, with a connection being made on the printhead circuit board 68 between those wires and wires provided to the components of the controller 50 via the flexible ribbon cable 71.

As described above, the controller 50 is also operative to control the motors 6, 7 to cause the ribbon 2 to advance between spools 3, 5, and the cause the motor 17 to cause the printhead carriage 13 to move in a direction parallel to the printing surface 11.

It has been realised that, rather than providing separate connections between the controller 50 (which is in a fixed position within the printer housing—not shown) and each of the printhead 4 and the printhead drive assembly 22, it may be beneficial to provide a single connection to the printhead assembly 60, with a further (flexible) connection being provided being the internal components of the printhead assembly 60 (i.e. between the printhead 4 and the printhead drive assembly 22). The printhead 4 may therefore be provided with a printhead drive assembly connector to allow this further connection to be made.

Various operations of the printer have been described above as being caused by electrical current being caused to flow in the coil 24 of the electromagnet 23. Such current can be considered to cause the electromagnet to become energised. As such, when a current of a particular magnitude and direction is caused to flow in the coil 24, the electromagnet can be considered to be in a first energisation condition. Similarly, when a current of a different particular magnitude and/or direction is caused to flow in the coil 24, the electromagnet can be considered to be in a second energisation condition. Thus, in general terms, at any particular time the electromagnet 23 can be caused to be in one of a number of different energisation conditions. It is noted that an absence of current flowing within the coil 24 may be considered to be an energisation condition.

Applying a current of plus 3 amps to the coil 24 in order to cause the printhead 4 to move from the first configuration to the second configuration may be considered to be an example of the electromagnet 23 being in a first energisation condition. Similarly, applying a current of minus 3 amps to the coil 24 in order to cause the printhead 4 to move from the second configuration to the first configuration may be considered to be an example of the electromagnet 23 being in a second energisation condition. Further, applying a current of plus 1 amp to the coil 24 in order to cause the printhead 4 to press against the printing surface 11 with an increased pressure while in the second configuration may be considered to be an example of the electromagnet 23 being in a third energisation condition. Further still, applying no current to the coil 24, in order to cause the printhead 4 to remain in whichever of the first and second configurations it is in may be considered to be an example of the electromagnet 23 being in a fourth energisation condition. It will be appreciated that there are a large number of possible energisation conditions, and that by switching the electromagnet between various ones of these energisation conditions, control of the printhead 4 can be achieved.

Where it is described above that a current of, for example +3 amps is caused to flow in the coil 24, it will be appreciated that this current can be provided in any convenient way, by any suitable power source. Further, given the inductive nature of the coil 24, changes in current will not occur instantaneously. In some embodiments, a pulse width modulated voltage supply may be used to cause a desired current to flow within the coil 24. For example, a fixed voltage (e.g. 24 V) maybe applied to the coil 24 in a pulsed manner, with the pulse duty cycle (e.g. the duration of each pulse, where the pulses are applied at a fixed frequency) being varied so as ensure that the average current flowing within the coil is substantially equal to the desired current. It will be appreciated that where it is described that a current is applied to the coil, it is meant that a current is caused to flow within the coil. How this is achieved will depend upon the nature of the power supply. Further, current sensing and feedback may be used to control the power supply, so as to achieve a desired current (in order to achieve a desired energisation condition). The power supply may be operated under the control of the controller 50.

While it is described above that a printing force of around 1.2 kgf may be used in a particular embodiment, it will be understood that the optimal printing force may be different in different embodiments, and that controlling the printing force can have a significant effect on the print quality. It will also be appreciated that friction between the printhead 4 and the ribbon 2 can affect the printing force generated. In particular, for a predetermined force generated by the spring 28, different forces may be generated between the printhead 4 and the printing surface 11 based upon the geometry and material properties.

FIG. 24 illustrates some of the forces acting on the printhead 4 as it interacts with the printing surface 11. A force $F_m$ is generated on the printhead 4 by the printhead drive assembly 22 (which force may, for example, be generated by the spring 28 and/or the electromagnet 23). This force acts along a line shown by arrow $F_m$, which is perpendicular to the support arm 21, and coincides with the axis A2 which lies along the centre of the target 26.

As a printing force is exerted by the printhead 4 on the printing surface 11, an equal and opposite reaction printing force $F_p$ is generated by the printing surface 11. Only this reaction force is shown in FIG. 24. The printing force $F_p$ is normal to the surface of the printing surface 11 at the point of contact between the printhead 4 and the printing surface 11.

Given the dynamic nature of the contact between the printhead 4 and the printing surface 11, and ribbon 2 and substrate 10 disposed therebetween, there is also a friction force $F_f$ generated. That is, during intermittent printing, the printhead 4 moves with respect to the ribbon 2 (or vice versa in continuous printing) in a direction indicated by arrow G. The friction force $F_f$ acts in a direction opposite to the print movement direction, and is proportional to the printing force $F_p$, with a constant of proportionality equal to the coefficient of friction p between the printhead and the surface against which it moves. That is, the friction force is related to the printing force as shown in equation 2:

$$F_f=\mu F_p \tag{2}$$

Further, by applying moment equilibrium to the forces acting on the printhead 4 about the pivot 14, it can be understood that the action of the printhead drive assembly force $F_m$, which acts at a radius r from the pivot 14 in a counter-clockwise direction must be balanced by the sum of forces acting on the printhead in a clockwise direction about the pivot 14. Those forces are the printing force $F_p$, which acts at a distance x from the pivot 14, and friction force $F_f$, which acts at a distance y from the pivot 14. These forces can be equated according to equation 3:

$$F_m r=F_p x+F_f y \tag{3}$$

Substituting for $F_f$ using equation 2:

$$F_m r=F_p x+\mu F_p y \tag{4}$$

Which can be rearranged as follows:

$$F_m r=F_p(x+\mu y) \tag{5}$$

Rearranging for $F_p$:

$$F_p = \frac{F_m r}{x+\mu y} \tag{6}$$

Thus, the relationship between the force $F_m$ generated by the printhead drive assembly 22 and the printing force $F_p$ can be determined, allowing system geometry and friction to be taken into account when selecting appropriate components and determining the appropriate current with which to drive the electromagnet. The controller 50 may additionally process information indicating the friction of the ribbon 2 against which the printhead 4 presses and use this information to determine the required force to be generated by the printhead drive assembly 22. Or course, where no ribbon is present (e.g. in a direct thermal printer), friction between the printhead and substrate (rather than the ribbon) can be taken into account.

In parts of the foregoing description, reference has been made to a magnetic field having north and south poles. It will, of course, be appreciated that the magnetic fields described can be arranged differently, such that each north pole is replaced by a south pole and vice versa. Similarly, where reference is made to positive and negative currents, it will be appreciated that currents may be caused to flow in a different direction than that described.

In parts of the foregoing description, reference has been made to printing force. Where the surface against which the printhead presses has constant area it will be appreciated that force and pressure generated as a result of that force are directly proportional, such that pressure may in practice be defined in terms of the force applied. However, the pressure applied will depend upon the width of the printing surface 11 (i.e. the dimension extending into the plane of the paper in FIG. 2) against which the printhead 4 applies pressure. The pressure—for a given force generated by the printhead drive assembly 22—is greater the narrower the printing surface 11, and so is the extent of compression of the printing surface 11, and vice versa. The printer may provide for several mounting positions for the printhead 4 and the ability to vary the width of the printhead 4 or printing surface 11. As such, the controller 50 may additionally process information indicating the width of the printing surface 11 against which the printhead 4 presses and use this width information to determine the required force to be generated by the printhead drive assembly 22.

A controller 50 has been described in the foregoing description. It will, of course, be appreciated that functions attributed to the controller 50 can be carried out by a single controller (for example as shown in FIG. 23) or by separate controllers. It will further be appreciated that a controller can itself be provided by a single controller device or by a plurality of controller devices. Each controller device can take any suitable form, including ASICs, FPGAs, or microcontrollers which read and execute instructions stored in a memory to which the controller is connected.

While embodiments of the invention described above generally relate to thermal transfer printing, it will be appreciated that in some embodiments the techniques described herein can be applied to other forms of printing, such as, for example, direct thermal printing. In such embodiments no ink carrying ribbon is required and a printhead is energised when in direct contact with a thermally sensitive substrate (e.g. a thermally sensitised paper) so as to create a mark on the substrate. It will of course be appreciated that in such embodiments, adjustments may be made as required to the operation of the embodiments described herein to accommodate such a change.

While various embodiments of the invention have been described above, it will be appreciated that modifications can be made to those embodiments without departing from the spirit and scope of the present invention. Further, it will be appreciated that various embodiments and alternatives described herein may be used in combination with other alternatives and embodiments where appropriate.

The invention claimed is:

1. A printer comprising:

a printhead configured to selectively cause a mark to be created on a substrate provided adjacent to the printer, the printhead having a first configuration in which the printhead is spaced apart from the printing surface and a second configuration in which the printhead is configured to press the substrate against a printing surface during a printing operation; and a printhead drive assembly configured to cause movement of the printhead towards and away from the printing surface between the first and second configurations, the printhead drive assembly comprising a permanent magnet and an electromagnet;

wherein, when the electromagnet is in a first condition, an attractive magnetic force is generated between the permanent magnet and the electromagnet, and when the electromagnet is in a second condition, a repulsive magnetic force is generated between the permanent magnet and the electromagnet, each of said attractive and repulsive magnetic forces being configured to one of urge the printhead away from and towards the printing surface; and the printhead drive assembly is configured such that, when the printhead is in each of the first and second configurations, it is retained in that configuration by the printhead drive assembly when the electromagnet is in the first condition, the printhead being retained in one of the first and second configurations by said attractive magnetic force generated between the permanent magnet and the electromagnet.

2. A printer according to claim 1, wherein the printhead drive assembly further comprises a resilient biasing member, the printhead being retained in the other one of the first and second configurations by a force generated by the resilient biasing member.

3. A printer according to claim 2, wherein the printhead drive assembly is configured to cause the printhead to press against the printing surface during a printing operation with a printing force, wherein the printing force is at least partially generated by said resilient biasing member.

4. A printer according to claim 3, wherein the printing force comprises a first force component generated by the resilient biasing member and a second force component generated by the electromagnet.

5. A printer according to claim 1, wherein in the first condition the electromagnet is de-energised, and the permanent magnet is configured to cause an attractive force to be generated between the permanent magnet and the electromagnet.

6. A printer according to claim 1, wherein in the second condition the electromagnet is energised in a first direction, such that a repulsive force is generated between the permanent magnet and the electromagnet.

7. A printer according to claim 1, wherein in a third condition the electromagnet is energised in a second direction, such that a second attractive force is generated between the permanent magnet and the electromagnet.

8. A printer according to claim 1, wherein the printhead is urged in a direction away from the printing surface by a magnetic force at least partially generated by the permanent magnet.

9. A printer according to claim 1, wherein the first and second configurations are stable configurations, and wherein:

when the printhead is in the second configuration, the urging force generated by the resilient biasing member is greater than the urging force generated by the permanent magnet; and when the printhead is in the first configuration, the urging force generated by the permanent magnet is greater than the urging force generated by the resilient biasing member.

10. A printer according to claim 1, wherein when the printhead is in the first configuration, the printhead is caused to move towards the second configuration by a magnetic force generated by the electromagnet.

11. A printer according to claim 1, wherein when the printhead is in the second configuration, the printhead is caused to move towards the first configuration by a force generated by the electromagnet.

12. A printer according to claim 1, further comprising a printhead position sensor configured to generate a printhead position signal, the electromagnet being controlled based upon said printhead position signal.

13. A printer according to claim 12, further comprising a controller arranged to control the printhead drive assembly, wherein the controller is configured to receive the printhead position signal and to generate a control signal for said printhead drive assembly based upon said printhead position signal.

14. A printer according to claim 13, wherein the controller is further arranged to receive a target printhead position and to generate a control signal for said printhead drive assembly based upon said target printhead position.

15. A printer according to claim 1, wherein the electromagnet is controlled so as to control an impact force of the printhead with the printing surface.

16. A printer according to claim 1, further comprising a controller arranged to control the printhead drive assembly, wherein the controller is arranged to monitor a property of the electromagnet and is arranged to generate a control signal for the electromagnet based upon said monitored property.

17. A printer according to claim 16, wherein the controller is arranged to:

monitor said property of the electromagnet during a first movement of the printhead drive assembly; and generate a control signal for the electromagnet in a second movement of the printhead drive assembly based upon said monitored property.

18. A printer according to claim 1, further comprising a controller arranged to control the printhead drive assembly, wherein the controller is arranged to generate data indicative of a target output force to be generated by the printhead drive assembly.

19. A printer according to claim 18, wherein the controller is arranged to generate data indicative of a target electromagnet current based upon said target output force and a position of the printhead.

20. A printer according to claim 1, further comprising a controller arranged to control the printhead drive assembly, wherein said controller is arranged to generate data indicative of a target electromagnet current based upon reference data indicative of a relationship between an electromagnet current; a printhead position and a printhead drive assembly output force.

21. A printer according to claim 1, further comprising a current sensor configured to generate an output indicative of an actual current flowing in said electromagnet, wherein the controller is arranged to generate a printhead drive assembly control signal based upon said data indicative of a target electromagnet current and data indicative of an actual electromagnet current.

22. A printer according to claim 1 wherein the printer is a thermal transfer printer and wherein the printhead is configured to be selectively energised so as to cause ink to be transferred from an ink carrying ribbon to the substrate so as to cause the mark to be created on the substrate.

23. A controller for a printer, the printer comprising:

a printhead configured to selectively cause a mark to be created on a substrate provided adjacent to the printer, the printhead having a first configuration in which the printhead is spaced apart from a printing surface and a second configuration in which the printhead is configured to press the substrate against the printing surface during a printing operation; and a printhead drive assembly configured to cause movement of the printhead towards and away from the printing surface between the first and second configurations, the printhead drive assembly comprising a permanent magnet and an electromagnet, wherein:

when the electromagnet is in a first condition, an attractive magnetic force is generated between the permanent magnet and the electromagnet, and when the electromagnet is in a second condition, a repulsive magnetic force is generated between the permanent magnet and the electromagnet, each of said attractive and repulsive magnetic forces being configured to one of urge the printhead away from and towards the printing surface; and the printhead drive assembly is configured such that, when the printhead is in each of the first and second configurations, it is retained in that configuration by the printhead drive assembly when the electromagnet is in the first condition, the printhead being retained in one of the first and second configurations by said attractive magnetic force generated between the permanent magnet and the electromagnet;

the controller being configured to control an energisation condition of the electromagnet so as to cause the printhead drive assembly to cause movement of the printhead towards and away from the printing surface; and to cause the printhead to be retained in each of the first and second configurations.

24. A method of controlling a printhead drive assembly of a printer, the printer comprising:

a printhead configured to selectively cause a mark to be created on a substrate provided adjacent to the printer, the printhead having a first configuration in which the printhead is spaced apart from a printing surface, and a second configuration in which the printhead is configured to press a substrate against the printing surface during a printing operation, said printhead drive assembly being configured to cause movement of the printhead towards and away from a printing surface between the first and second configurations, the printhead drive assembly comprising a permanent magnet and an electromagnet and being configured such that:

when the electromagnet is in a first condition, an attractive magnetic force is generated between the permanent magnet and the electromagnet, and when the electromagnet is in a second condition, a repulsive magnetic force is generated between the permanent magnet and the electromagnet, each of said attractive and repulsive magnetic forces being configured to one of urge the printhead away from and towards the printing surface; and when the printhead is in each of the first and second configurations, it is retained in that configuration by the printhead drive assembly when the electromagnet is in the first condition, the printhead being retained in one of the first and second configurations by said attractive magnetic force generated between the permanent magnet and the electromagnet;

the method comprising:

controlling an energisation condition of the electromagnet so as to cause the printhead drive assembly to cause movement of the printhead towards and away from the printing surface;

controlling said energisation condition of the electromagnet so as to cause the printhead to be retained in each of the first and second configurations; and controlling said energisation condition of the electromagnet to cause the printhead to press the substrate against the printing surface during a printing operation.

25. A computer readable medium carrying a computer program comprising computer readable instructions arranged to carry out a method according to claim 24.

* * * * *